US009824838B2

(12) United States Patent
Faulkner

(10) Patent No.: US 9,824,838 B2
(45) Date of Patent: Nov. 21, 2017

(54) COMMUTATING CIRCUIT BREAKER

(71) Applicant: Roger W. Faulkner, Melrose, MA (US)

(72) Inventor: Roger W. Faulkner, Melrose, MA (US)

(73) Assignee: Alevo International, S.A., Martigny, Valais (CH)

( * ) Notice: Subject to any disclaimer, the term of this patent is extended or adjusted under 35 U.S.C. 154(b) by 0 days.

(21) Appl. No.: 13/840,824

(22) Filed: Mar. 15, 2013

(65) Prior Publication Data

US 2013/0256274 A1 Oct. 3, 2013

Related U.S. Application Data

(63) Continuation-in-part of application No. 13/366,611, filed on Feb. 6, 2012, now Pat. No. 8,890,019.
(Continued)

(51) Int. Cl.

| | |
|---|---|
| ***H01C 7/00*** | (2006.01) |
| ***H01H 33/16*** | (2006.01) |
| ***H01H 33/59*** | (2006.01) |
| *H01H 33/32* | (2006.01) |
| *H01H 33/34* | (2006.01) |
| *H01H 33/38* | (2006.01) |

(Continued)

(52) U.S. Cl.
CPC ..... *H01H 33/16* (2013.01); *H01H 33/596* (2013.01); *H01H 9/542* (2013.01); *H01H 33/32* (2013.01); *H01H 33/34* (2013.01); *H01H 33/38* (2013.01); *H01H 33/6661* (2013.01)

(58) Field of Classification Search
CPC ..... H01H 33/16; H01H 33/32; H01H 33/34; H01H 33/38
USPC ..... 338/13
See application file for complete search history.

(56) References Cited

U.S. PATENT DOCUMENTS 6,751,078 B1 * 6/2004 Munakata et al. ..... 361/58
7,262,377 B1 * 8/2007 Wei et al. ..... 200/47
(Continued)

*Primary Examiner* — Kyung Lee
(74) *Attorney, Agent, or Firm* — Brian M. Dingman; Dingman IP Law, PC

(57) ABSTRACT

A commutating circuit breaker that works by progressively inserting increasing resistance into a circuit. This is done via physical motion of a shuttle that is linked into the circuit by at least one set of sliding electrical contacts on the shuttle ("shuttle electrodes") that connect the power through the moving shuttle to a sequence of different resistive paths with increasing resistance; the motion of the shuttle can be either linear or rotary. A feature of the commutating circuit breaker is that at no point are the shuttle electrodes separated from the matching stationary stator electrodes so as to generate a powerful arc, which minimizes damage to the electrodes. Instead, the current is commutated from one resistive path to the next with small enough changes in resistance at each step that arcing can be suppressed. The variable resistance can either be within the moving shuttle, or the shuttle can comprise a commutating shuttle that moves the current over a series of stationary resistors. In either case, a "soft" opening of the circuit can be accomplished, with low switching transients, provided that the maximum step change of resistance is limited until the current is nearly extinguished. Commutating circuit breakers work equally well for DC or AC power.

34 Claims, 18 Drawing Sheets

Related U.S. Application Data

(60) Provisional application No. 61/619,531, filed on Apr. 3, 2012, provisional application No. 61/541,301, filed on Sep. 30, 2011, provisional application No. 61/439,871, filed on Feb. 5, 2011.

(51) Int. Cl.
*H01H 9/54* (2006.01)
*H01H 33/666* (2006.01)

(56) References Cited

U.S. PATENT DOCUMENTS

| | | | | |
|---|---|---|---|---|
| 7,679,022 | B2 * | 3/2010 | Tsuchiya et al. | 218/120 |
| 2002/0070694 | A1 * | 6/2002 | Blum | 318/244 |
| 2007/0205182 | A1 * | 9/2007 | Hunger et al. | 218/65 |
| 2011/0233693 | A1 * | 9/2011 | Perruchot et al. | 257/417 |
| 2012/0199558 | A1 * | 8/2012 | Faulkner | 218/143 |

* cited by examiner

COMMUTATING CIRCUIT BREAKER

PRIORITY

This application is a continuation-in-part application of U.S. Utility application Ser. No. 13/366,611, filed Feb. 6, 2012, which claims priority from U.S. Provisional Application No. 61/541,301, filed on Sep. 30, 2011, and U.S. Provisional Application No. 61/439,871, filed on Feb. 5, 2011.

This application claims priority from U.S. Provisional Application No. 61/619,531, filed on Apr. 3, 2012, and international application No. PCT/US2012/058240 filed Oct. 1, 2012, now pending, which claims priority from U.S. Provisional Application No. 61/619,531, filed on Apr. 3, 2012, U.S. Provisional Application No. 61/541,301, filed on Sep. 30, 2011, and U.S. Utility application Ser. No. 13/366,611, filed Feb. 6, 2012, which claims priority from U.S. Provisional Application No. 61/541,301, filed on Sep. 30, 2011, and U.S. Provisional Application No. 61/439,871, filed on Feb. 5, 2011.

The entire disclosures of all of the above-referenced applications are incorporated herein by reference.

TECHNICAL FIELD

This disclosure relates to a circuit breaker.

BACKGROUND

In order to open any DC circuit, the inductive energy stored in the magnetic fields due to the flowing current must be absorbed; it can either be stored in capacitors or dissipated in resistors (arcs that form during opening the circuit are in this sense a special case of a resistor). Because of the rapid inrush of current in a short circuit, the inductive energy can easily be much greater than just the inductive energy stored in the system at normal full load; if the current goes to five times the normal full load amps before being controlled, the inductive energy would be up to twenty-five times as large as in the circuit at normal full load (depending on the location of the short). The inductive energy that must be dissipated to open a high voltage DC (HVDC) transmission line circuit can be in the hundreds of megajoules (MJ). The other major problem with opening a DC circuit is that (unlike AC power), the current and voltage do not go through zero periodically, so it is very difficult to extinguish a DC arc.

Several prior art strategies are known for breaking a high power DC current. Arc chute breakers (U.S. Pat. Nos. 2,270,723; 3,735,074; 7,521,625; 7,541,902 for example) are effective to break DC currents up to 8000 amps (8.0 kA, kiloamps) at 800 volts (0.8 kV, kilovolts) DC, or 4 kA at 1.6 kV. One can go to higher voltage with arc chute breakers, but the needed physical separation of the electrodes and the number of plates in the arc chute increases linearly with voltage in such devices, and so they become very large at voltage higher than 3.5 kV.

The concept behind arc chute breakers is to spread the arc current out into many small arcs over a large surface area between parallel metal plates. Since the arc is quite hot, the higher surface area of the many small arcs implies far greater radiative cooling. As the arcs cool, the resistance goes up so high that the arc current is ultimately quenched; this process takes a while: 50-300 milliseconds (ms) is a typical time between striking the arc and arc extinction in a megawatt (MW) scale arc chute breaker. This long time to open the circuit has little to do with the speed of motion of the electrodes; in a Gerapid™ circuit breaker from GE, for example, the electrodes are separated within 3 ms (milliseconds), but cooling the arc takes up to 100 times as long as that, and the current can continue to increase in case of a short for up to ten ms in an arc chute circuit breaker before it begins to decrease.

Another means known in the prior art to create a high power DC circuit breaker is to use the charging or discharging of a capacitor to momentarily reduce the voltage and current to a level that a fast acting AC-type switch can open the circuit. U.S. Pat. No. 3,809,959 describes an arrangement in which two AC-type switches, a resistor, a spark gap, and a capacitor are combined to give an effective DC circuit breaker that can work up to HVDC voltage. This is faster than an arc chute breaker, and is applicable up to HVDC voltage levels. Later refinements of this idea include precharging the capacitor to an opposite polarity compared to the flowing current to be interrupted.

U.S. Pat. No. 3,534,226 describes a particular way to insert resistance and capacitance into a DC circuit, to open the circuit; this patent is included herein by reference in its entirety. The basic concept of switching in resistors to reduce the current in a stepwise manner so as to control the magnitude of voltage transients during opening of a DC circuit is well described in U.S. Pat. No. 3,534,226, which envisions using many individual switches and resistors. The method of U.S. Pat. No. 3,534,226 involves two different kinds of switches that must be opened in a precise sequence: first a low resistance mechanical switch (through which most of the power flows when the circuit breaker is closed) is opened. This is a conventional switch in which the electrical contacts are separated. Although a plasma arc may briefly form between the separating electrodes of the low resistance switch, this arc is quickly extinguished as the current is commutated onto a parallel path through the resistors, which are switched via fast acting switches. The initial resistance in the resistive network must be quite low for the initial arc to extinguish and commutate to the parallel resistive path. By the time the last fast acting switch is opened the current has been reduced to less than 10% of its maximum value (which implies that >99% of the magnetic energy has been dissipated), which allows the final capacitor snubber to be relatively small and economical compared to the size it would have to be if it had to absorb most of the magnetic energy stored in the circuit at the time of initial opening. U.S. Pat. No. 3,534,226 forms the basis for several subsequent patents, including U.S. Pat. Nos. 3,611,031 and 3,660,723 (both of which also use a low-loss mechanical switch to commutate the current to a resistive network based on fast electronic switches), and U.S. Pat. No. 6,075,684 which uses a fast electronic switch in place of the commutating mechanical switch.

SUMMARY

Commutating circuit breakers work by switching increasing resistance into a circuit in a pre-determined sequence until the current is sufficiently reduced so that a final circuit opening can be performed using a relatively small snubbing circuit such as a varistor or a capacitor to absorb the last bit of stored magnetic energy. The resistance needs to increase slowly enough that the inductive energy can be quenched without creating voltage spikes that are above the maximum voltage that the system can tolerate. In the commutating circuit breaker the sequential switching of resistance into the circuit is accomplished by the motion of a shuttle. As the shuttle moves, the resistance increases because of one of these three "Cases":

1. The resistance across a variable resistance shuttle increases as the shuttle moves;
2. The resistance across the circuit breaker increases as a commutating shuttle commutates the current over a sequence of stationary resistors; or,
3. A commutating variable resistance shuttle is used to commutate over a sequence of stationary resistors, but part of the inserted resistance is on board the shuttle.

In the commutating circuit breaker, the current flows between a first Side A through a first stator electrode (stator electrode #1) to a first shuttle electrode on the shuttle; this part of the current path from Side A of the circuit breaker on to the shuttle can be accomplished by any workable means, either via a commutating connection or a stable continuous connection; the stable continuous connection can be accomplished by a flexible wire, a telescoping tube, or a slip ring, for example. Once the current is on the shuttle, it flows to a second shuttle electrode which connects to one or a series of second stator electrodes to complete the circuit to Side B in such a manner that electrical resistance increases as the shuttle moves.

In Case #1 above of a variable resistance shuttle, a variable resistance portion of the shuttle connects Side A of the commutating circuit breaker to Side B through stationary stator electrodes. Motion of the shuttle could be linear or it could be rotary. The points of electrical connection between the stationary stator electrodes and the moving shuttle electrodes include at least one discrete stator electrode along which the shuttle slides during operation of the circuit breaker, through which the current is transferred. The other connection of the shuttle to the circuit can also be a sliding contact, but may also be a flexible wire connection or a telescoping tube that remains attached to the shuttle as it moves (on only one side of the shuttle circuit).

Case #1 of a variable resistance shuttle differs from prior art rheostats (which are sometimes used in electric motor soft starters) mainly in that the envisioned circuit breakers are automatically triggered, and move ballistically between an on position to an off position, and so the resistors need not be designed for continuous duty as in a rheostat.

In Case #2 above of a commutating shuttle, the resistors remain stationary, and the commutating shuttle delivers the power to different stator electrodes as it moves, which connect the power flow through a sequence of stationary resistors in such a way that resistance increases repeatedly during opening of the commutating circuit breaker. In this case, at least one of the shuttle electrodes on the commutating shuttle must be a discrete electrode which is bounded by insulation on at least one side, though in the simplest case the surrounding insulation can be a fluid or vacuum. Insofar as the mass of resistors required to open a circuit depends on the total energy that must be absorbed, and can be in the hundreds of kilograms for a commutating circuit breaker designed for a high power, high voltage line, it is preferable in high power applications not to accelerate the resistors as in Case #1, but to rely instead on a commutating shuttle as in Case #2 to commutate the power over a series of stationary resistors. The commutating shuttle can both weigh less and be conveniently composed of stronger materials than the variable resistance shuttle of Case #1. The lower mass of a commutating shuttle compared to a variable resistance shuttle implies less momentum needs to be transferred to accelerate the shuttle, which minimizes the jolt due to acceleration of the shuttle, and also reduces shock, vibration, and fatigue for the structure that holds the commutating circuit breaker.

A commutating variable resistance shuttle as in Case #3 above is useful for snubbing arc currents that might otherwise arise as the trailing edge of a commutating stator electrode leaves its electrical connection to a particular moving shuttle electrode; part of the energy absorption is on board the moving shuttle (thus increasing its mass), but typically less than 10% of the total. Making the last part of a shuttle electrode lower in conductivity compared to the first part can suppress arcing while still preserving a low resistance path through the first part of the shuttle electrode to conduct electricity efficiently when the circuit is closed. Except for the very last commutation, shuttle electrodes are always in contact with at least two stator electrodes linking to parallel paths with different resistance at any time during the on-state or during operation of the circuit breaker prior to the final shut off. The trailing edge of a shuttle electrode can desirably have a gradient of resistivity that causes the path which is initially the most conductive parallel Path P1 through stator electrode E1 and then through stationary resistance X1 to increase its total resistance smoothly due to the increasing resistivity of the trailing edge of the moving electrode so that most of the current is commutated from the path P1 to the parallel path P2 through stator electrode E2 and then through stationary resistance X2, even though X2 resistance>X1 resistance. The total resistance through X1 is the sum of X1+shuttle electrode resistance (which is graded)+the electrode/electrode resistance connecting the path through X1. Making the trailing edge of an electrode much more resistive than a metal implies either placing a portion of the resistance insertion of a commutating circuit breaker on board the shuttle in the trailing portion of the shuttle electrodes, or within the trailing portion of the stator electrodes, or both.

Insofar as the mass of the shuttle must be accelerated during operation of a commutating circuit breaker, it is desirable to minimize the mass of the shuttle, and therefore to prefer that the trailing edge resistive gradient is primarily limited to the stator electrodes because adding said gradient on the trailing edge of the shuttle electrodes increases shuttle mass, which makes the launching mechanism heavier, and the momentum transferred to accelerate the shuttle greater. Grading the resistivity on the trailing edges of both the shuttle electrodes and the stator electrodes provides the best possible arc suppression as a particular stator electrode loses contact with a particular shuttle electrode. The graded resistivity on the trailing edges of the electrodes connecting through Path P1 commutates the current primarily to a different higher resistance electrical Path P2 through next neighbor stator electrodes that share a parallel connection through a common shuttle electrode which is wider than the stator electrodes. Well before the final separation of the electrodes that are in Path P1, it is desirable that the resistance through Path P2 has increased to at least ten times the resistance through parallel Path P1, and this may be accomplished by graded resistivity in the trailing edges of the separating Path P1 electrodes.

There must be at least one commutation zone in a commutating circuit breaker wherein the movement of the shuttle changes the electrical path through the circuit breaker, so that the current is shunted onto paths of increasing resistance during opening of the circuit breaker. This zone may commutate the power from a shuttle electrode through a series of electrically separated stationary stator electrodes onto paths having increasing resistance, or the stator commutation zone may comprise a stack of electrically series connected stationary stator electrodes such that the path length through the resistor stack increases, leading to increased inserted resistance as the commutating shuttle moves, or the movement of a variable resistance shuttle may simply place greater resistance between Side A and the stator electrode that links to Side B.

Commutating circuit breakers enable high power DC power transmission and distribution above 3.500 kV. Medium voltage DC (MVDC) power distribution at 2-36 kV would be both capital efficient and energy efficient compared to MVAC power distribution, but has up until now been economically infeasible due in part to the high cost, low efficiency, and/or slow action of DC circuit breakers. MVDC enables microgrids with many different generators, power demands, and storage units tied into a single grid, whereas this is far more difficult to do with AC power.

MVDC allows efficient power distribution in factories and processing plants that use a lot of variable speed motors; on board ships; at mine sites; and other isolated off-grid sites. The provision of DC power to many variable speed motor drives saves both capital and energy costs compared to the normal mode of operation in which each motor controller for a variable speed drive must first produce DC power from AC power within the drive, then either drive a DC motor or convert to AC at a controlled frequency to drive the variable speed motor. Variable speed drives are less expensive and more efficient if they are powered by MVDC, which has previously been impractical due to the lack of fast, efficient, economical MVDC circuit breakers.

High voltage DC (HVDC) power transmission is the most efficient way to transmit high power levels, over one gigawatt (GW) for example, for distances greater than 1000 km. Unlike AC power, DC power lines can readily go underground or undersea, and for these reasons HVDC is the most efficient and feasible way to transmit vast amounts of renewable electricity from distant wind farms and solar arrays to cities and economical remote energy storage sites, as will be needed to build an efficient energy economy based on renewable energy. Until recently, HVDC power transmission was strictly via "line commutated converters" (LCC) which only work as point-to-point power lines, connecting two or a few nodes of the AC grid, with LCC converters at each connection point to the AC grid. An LCC HVDC system does not need HVDC circuit breakers, because the current can be broken on the AC side. A newer type of AC/DC converter, "voltage source converters" (VSC) allows for the first time, true multi-terminal HVDC; however these multi-terminal HVDC systems require HVDC circuit breakers. Development of multi-terminal HVDC power lines and eventually, HVDC supergrids, has been inhibited by the high cost, low efficiency, and poor reliability of prior art HVDC circuit breakers.

The commutating circuit breaker is a breakthrough in terms of capital cost and operating characteristics (fast quenching of magnetically stored energy, long life, low switching transients) that will enable DC grids all the way from the modest voltage relevant for data centers and vehicles (~48 to 400 volts) to MVDC for electric trains, microgrids, ships, drilling platforms, factories and processing plants, to HVDC for long distance power sharing.

DESCRIPTION OF EMBODIMENTS

In a commutating circuit breaker it is necessary to accelerate a shuttle. The shuttle can be either a variable resistance shuttle as in Case #1, or a commutating shuttle as in Case #2, or a blending of these cases in which part of the insertion of variable resistance occurs on the shuttle, and part via stationary resistors, as in Case #3.

Figure 1:
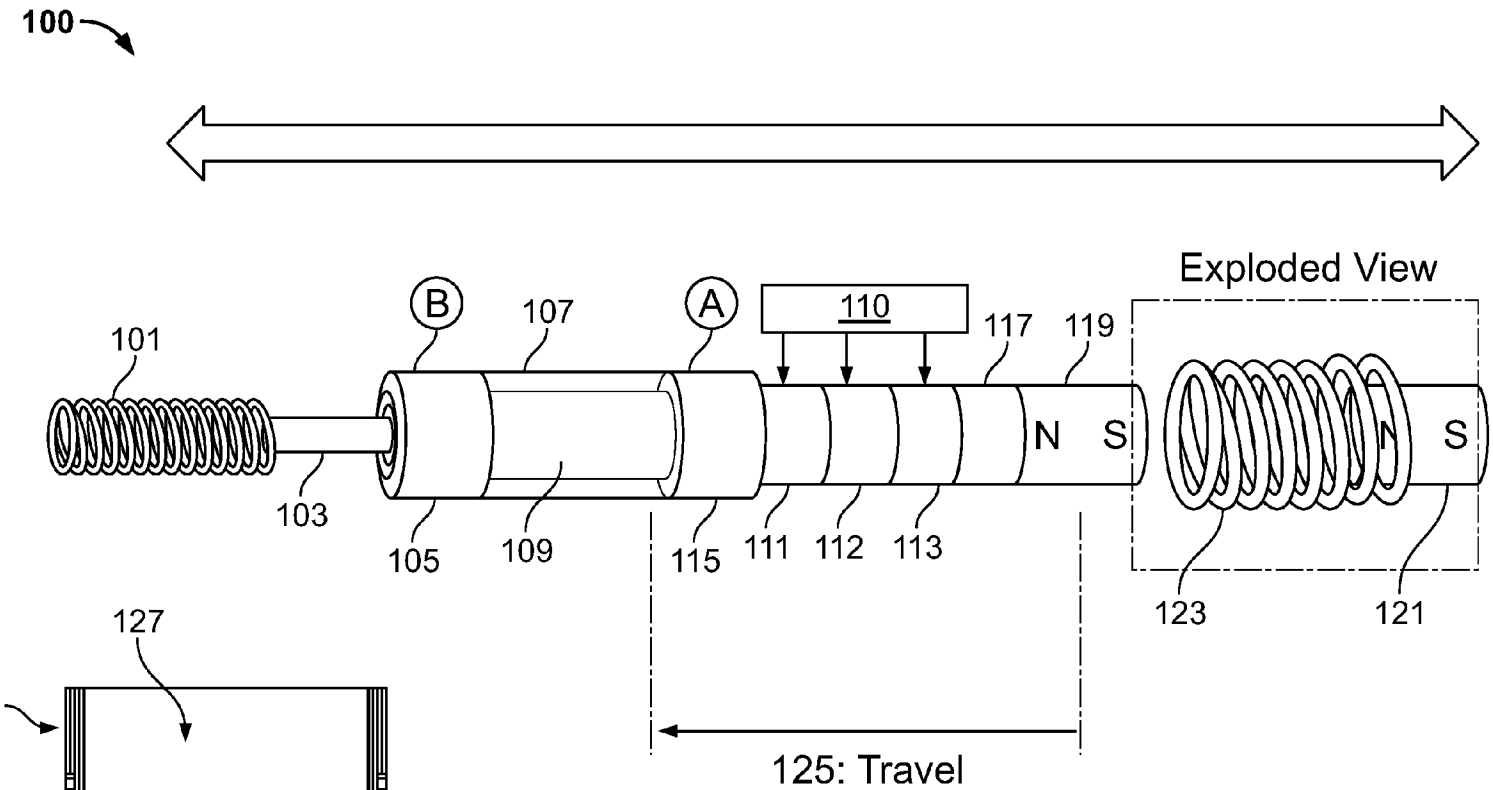
FIG. 1 shows a linear motion ballistic circuit breaker with variable resistance shuttle having step changes of resistivity in the shuttle; two stator electrodes are arranged in a circularly symmetrical manner to avoid a Lorentz force torque.

Commutating circuit breakers for relatively low power circuits of less than about one hundred kilowatts (kW) can be made with a variable resistance shuttle (Case #1) that connects between two sets of contacts, as in FIG. 1. This simplifies the design of the circuit breaker mechanism and wiring, but requires fabrication of a fairly complicated shuttle with higher strength than is normally required for resistors. Stronger springs or launching mechanisms are required than for commutating shuttle (Case #2) designs for the same power level because the entire mass of resistors must be accelerated. The variable resistance shuttle must withstand high acceleration loads, and must have a surface that slides on the stator electrodes without excessive wear.

FIG. 1 is a partially exploded view of a commutating circuit breaker 100 in which the inserted resistance is on board the shuttle. In FIG. 1 a spring 101 is under tension, pulling on the shuttle through a non-conductive rod 103; this rod extends to the back end of the shuttle and is connected to permanent magnet 119, the "shuttle magnet." Shuttle magnet 119 is in contact with stator magnet 121 when the circuit breaker is closed, prior to triggering the breaker. Electromagnet coil 123 is oriented to repel the shuttle magnet and to trigger opening of the circuit breaker by the spring 101 when a DC current passes through the coil. FIG. 1 shows a variable resistance portion 110 of the shuttle having step changes of resistivity in the shuttle core segment layers 111, 112, and 113. Stator 107 has cylindrical electrodes 105 and 115 that are arranged in a circularly symmetrical manner around the shuttle to avoid torque on the shuttle by Lorentz forces. The two circular stator electrodes 105 and 115 are at a set distance apart, far enough to prevent arcing during opening of the circuit breaker.

During the time that a single resistivity layer is exiting stator electrode 115, the resistance increases smoothly due to insertion of a greater length of resistive segments between Side A and Side B as the shuttle moves left. As each resistive material boundary passes out of contact with stator electrode 115, there is a discontinuity in the resistance versus time curve, but no step changes in resistance.

The shuttle in FIG. 1 is shown in its closed circuit position, but an exploded view is applied to the stator magnet 121 and the electromagnet trigger 123 to make it easier to depict; by exploded view I mean that the two magnets 119 and 121 are shown as not touching just to make it easier to depict this end of the device; however, in actuality these magnets are touching each other in the closed circuit position. In the closed circuit, power flows from Side A to the stator electrode 115, then through the portion of the shuttle 109 to stator electrode 105; 109 is composed of a good electrical conductor with low resistivity ~$10^{-8}$ ohm-meter. After the shuttle begins to move, the resistance increases as the boundary between material 109 and material 111 exits the left side of stator electrode 115; this is the first commutation. After this, resistance rises smoothly while the 111 material exits the left side of the stator electrode 115, then with increasing slope at the time of the second commutation when the boundary between material 111 and 112 exits the left side of stator contact 115, then again resistance rises smoothly for a while until the boundary between 112 and 113 exits stator electrode 115. The circuit is finally opened when insulating material 117 extends from the left side of electrode 115. When the circuit is finally opened a snubber of some kind, as is familiar to one skilled in the prior art, such as a varistor or a capacitor absorbs the last bit of inductively stored energy. Total travel during opening of the circuit is distance 125. Not shown is the means to arrest the forward motion of the shuttle.

Two commutating circuit breakers of the type shown in FIG. 1 can be arranged on a common support so that the momentum effect of accelerating one shuttle to the left is balanced by the momentum effect of accelerating the second shuttle to the right.

Figure 2:
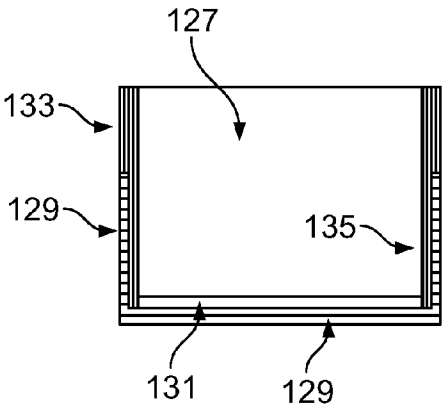
FIG. 2 shows a container for a resistor that is sometimes called a "Can" herein. This Can is filled with a potted disc shaped resistor to form a resistor cell.
Figure 3:
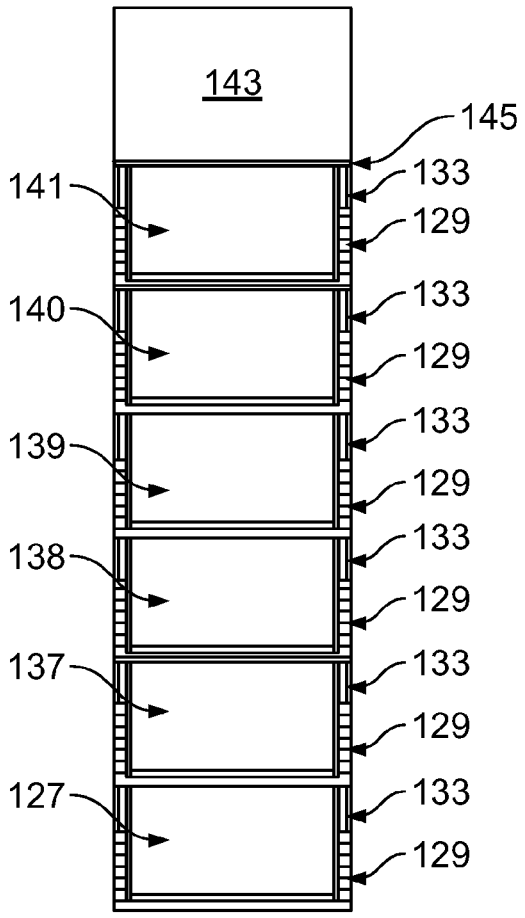
FIG. 3 shows a stack of resistor cells as in FIG. 2 that are series connected in such a way as to facilitate commutation by a moving shuttle that fits around the stack as in FIG. 4.

FIG. 2 shows a single resistor cell of a stacked resistor column (shown in FIG. 3) in which a disc-shaped resistor 127 is potted into a Can that facilitates stacking and commutation. Resistor 127 is desirably an alumina/carbon resistor, such as those available from HVR Advanced Power Components of Cheektowaga, N.Y., USA. These resistors can handle pulsed power very well, as is needed during operation of a Commutating Circuit Breaker, and are available over three orders of magnitude in resistivity. The physical properties of this class of resistor (especially density and strength) would not be desirable for a design such as FIG. 1 in which the resistor per se is accelerated to accomplish the circuit opening, and the stator electrodes ride on the surface of the resistor. The Can of FIG. 2 is comprised of a conductive lower portion 129, an insulating upper portion 133, and an insulating sleeve portion 135. Said Can provides a nesting site for a disc-shaped resistor 127 (or 137, 138, 139, 140, or 141, as shown in FIG. 3) which is attached by conductive adhesive 131 to the bottom of the Can 129. The conductive adhesive 131 is desirably a metal brazing compound, a solder, or a conductive adhesive that is lower in volume resistivity than the resistive material that comprises disc resistor 127. Said bottom of the Can 129 is metallic and has a metal lip that extends part way up along, but some distance away from the sides of the disc resistors 127, 137, 138, 139, 140, or 141. Above and adjacent to the metal part of the can 129, and extending to nearly the same outer radius as the metal part of the can 129 is an electrically insulating section 133. Between the common inner radius of the upper lip of the metallic portion of the Can 129 and the insulating upper portion of the Can 133 and the outer radius of the disc resistor 127, 137, 138, 139, 140, or 141, an insulating sleeve 135 is inserted; this sleeve guarantees that current flows vertically from top to bottom of each resistor, so that $I^2R$ resistive heat generation is distributed over the entire volume of the disc resistor such as 127. The resistors (127, 137, 138, 139, 140, or 141) are potted into six Cans that each contain components 129, 131, 133, and 135 with a void-free insulating polymeric system (as is commonly practiced in potted transformers, for example) to form the final potted resistor cell, as in FIG. 2.

Six resistor cells similar to the one shown in FIG. 2 are then stacked as in FIG. 3 to form a stator; the entire outside radial wall of each Can and the entire stator formed by stacking the Cans plus a special top cell is a concentric sliding surface that is smooth. The bottom resistor cell contains disc resistor 127; the next cell up contains disc resistor 137; the next cell contains disc resistor 138; the next cell contains disc resistor 139; the next cell contains disc resistor 140; the next cell contains disc resistor 141. At the very top of the stack of resistor cells there is a special variable resistivity resistor cell that differs from the other cells in that it is comprised of a metal base plate 145, and on top of that is a graded resistivity cermet element 143 that has resistivity at the bottom that is approximately equal to the resistivity of disc resistor 141, with resistivity that increases until it is an excellent insulator at the top, with resistivity $>10^{12}$ ohm-meter (ohm-m). All these cells are mechanically and electrically bonded together, so that the metal base of each cell is attached to the entire upper surface of the disc resistor below it in the stack.

Figure 4:
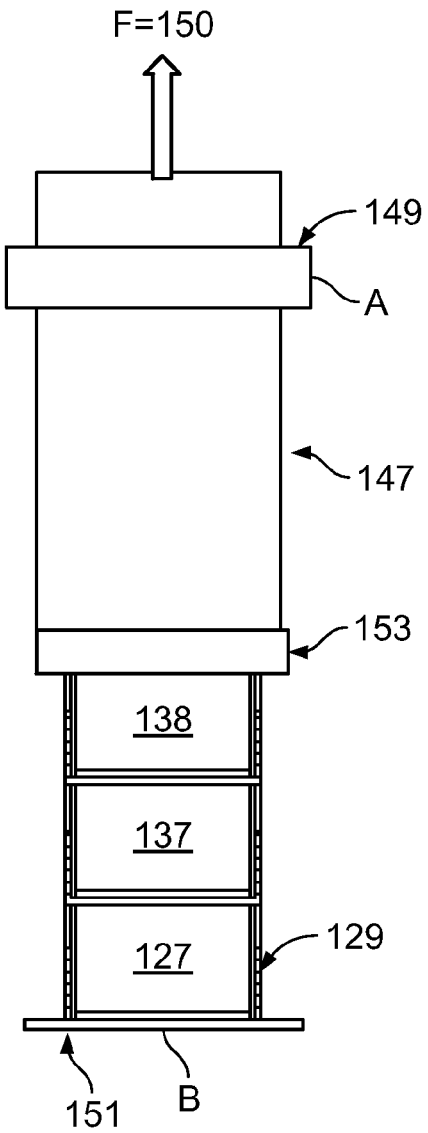
FIG. 4: Linear motion commutating circuit breaker with a pipe-shaped commutating shuttle that fits around a stationary column of disc-shaped resistors.

FIG. 4 shows how the stack of resistor segments of FIG. 3 is combined with a commutating shuttle 147, which in this case takes the form of a metallic sleeve that fits over the column of resistor segments, a conductive slip ring 149 that is connected to Side A and to commutating shuttle 147, and a conductive base plate 151 that is connected to Side B, to form a commutating circuit breaker. FIG. 4 shows an intermediate state that occurs during opening of the commutating circuit breaker of FIGS. 2, 3, 4; in this intermediate state three resistor cells containing disc resistors 127, 137, and 138 are in a series-connected state between the moving commutating shuttle 147 and the base of the resistor stack 151. Note that the metallic sleeve commutating shuttle 147 is lower in mass than the column of resistor segments, and therefore takes less force 150 to accelerate than would be required to accelerate the resistor stack at the same rate. Current flows from Side A to the movable commutating shuttle 147 through slip ring 149 (in this case the entire length of 147 is the shuttle electrode). The connection of the commutating shuttle 147 to Side A could also be via a wire in principle. When the commutating circuit breaker of FIG. 4 is closed, current flows with low resistance from Side A through the slip ring 149, then through the commutating shuttle 147 to the metal portion 129 at the bottom of the lowest resistor cell (which contains resistor disc 127), in the on-state case (not shown), the current mostly flows directly into the metallic base plate 151 and on to Side B through said metal portion 129 at the bottom of the lowest resistor cell, bypassing all the disc resistors. Not shown is the attachment method holding shuttle 147 down against base plate 151 in the on-state, which is rapidly released when the control system triggers the release of commutating shuttle 147 to move upwards under the influence of force 150.

When the circuit breaker of FIG. 4 is triggered, the commutating shuttle 147 is rapidly accelerated upwards, causing the current to pass first through resistor 127, then 127+137, then 127+137+138 (this is the state illustrated in FIG. 4), and so on. The commutating shuttle continues to move upwards until it has moved beyond the last metallic portion of the resistor stack column, 145 of FIG. 3, after which the final small remaining current is quenched by the graded resistivity cell 143. At the bottom of the commutating shuttle 147 is a semiconductive or insulating sleeve 153 that fits closely around the resistor column to suppress arcing when the conductive portion of the commutating shuttle 147 pulls apart from one of the metallic parts 129 found at the bottom of each resistor shell. Said sleeve 153 is desirably semiconductive where it touches the commutating shuttle 147, but has a resistivity gradient such that it becomes a high dielectric strength, high resistivity material (greater than $10^{12}$ ohm-meter) at the opposite end (lower end in FIG. 4). Said sleeve 153 can be made of a variety of materials; a particularly desirable composition is a high strength fabric-reinforced elastomer with a slippery inner surface. A second particularly desirable composition of said sleeve 153 can be a sequence of plasma-sprayed mutually adherent layers ranging from $10^{-5}$ to $10^{12}$ ohm-meter resistivity. Not shown in FIG. 4 are the means by which the commutating shuttle is pulled upwards, the sensors to detect a fault condition, and the means of triggering the circuit opening; these functions can all be accomplished by means known in the prior art. Not shown, but optionally present on the inner surface of the commutating shuttle 147, are flexible electrodes that facilitate better electrical contact between the commutating shuttle 147 and the outer surface of the stack of resistors shown in FIG. 3.

Figure 5:
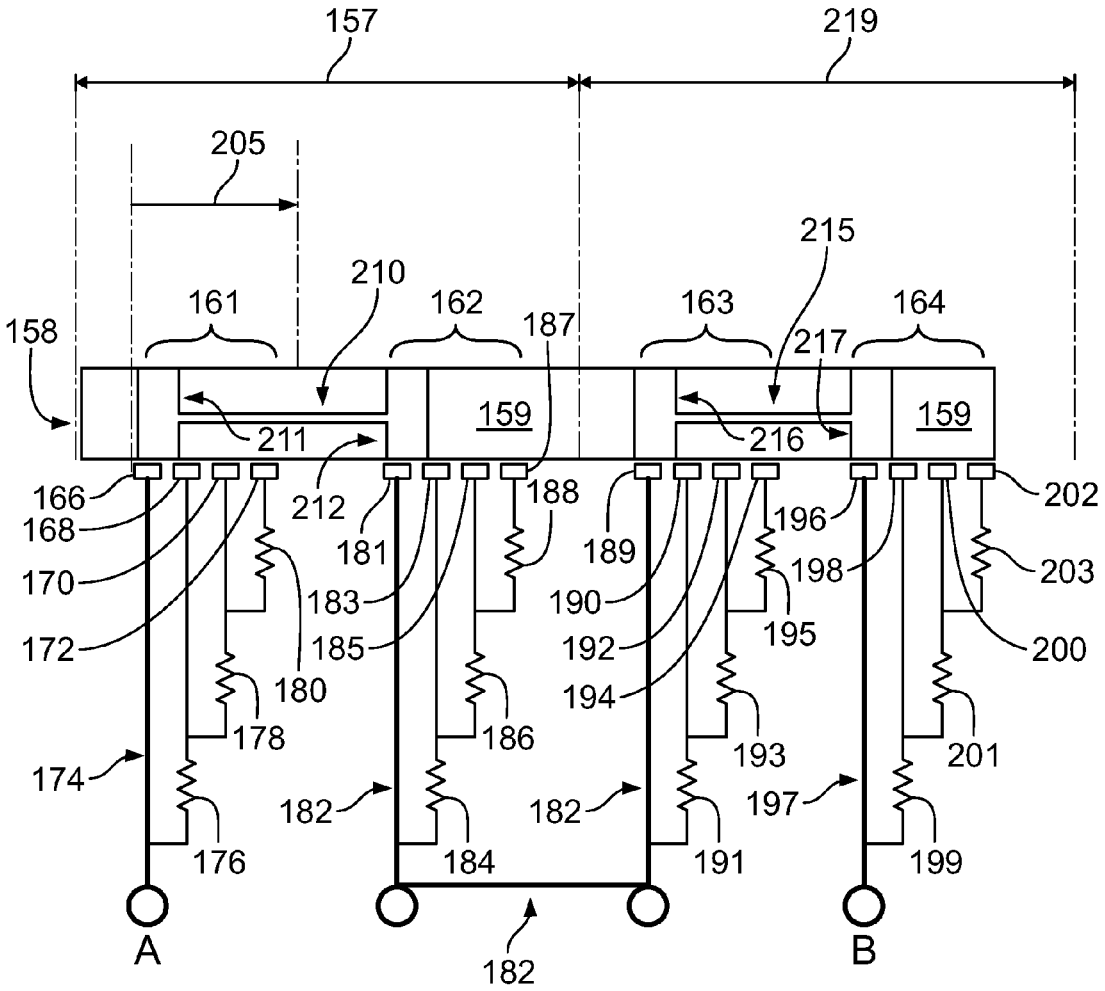
FIG. 5: Linear motion multistage commutating circuit breaker with four commutation zones in two stages.

FIG. 5 is a two-stage four-zone commutating circuit breaker that has a commutating shuttle 158 that moves a distance 205 to open the circuit. The commutating shuttle contains two shuttle electrode pairs comprised of 210, 211, and 212 (shuttle electrode pair #1), and 215, 216, 217 (shuttle electrode pair #2), both of which are embedded in a structural insulator 159 that is between the shuttle electrode pairs and also surrounds the connectors 210 and 215 which connect the two electrodes in each electrode pair. There are four commutation zones 161 to 164: 161 and 162 together form the first stage 157; 163 and 164 together form the second stage 219 of this two-stage commutating circuit breaker. In each of these zones there are four stator electrodes. Commutation zone 161 contains stator electrodes 166, 168, 170, and 172; stator electrode 166 connects through low resistance conductor 174 to Side A. Stator electrode 168 connects to Side A through resistor 176; stator electrode 170 connects to Side A through resistors 178 and 176 in series; stator electrode 172 connects to Side A through resistors 180, 178, and 176 in series. Commutation zone 162 contains stator electrodes 181, 183, 185, and 187. Stator electrode 181 connects to stator electrode 189 through low resistance conductor 182. Stator electrode 183 connects to low resistance conductor 182 through resistor 184; stator electrode 185 connects to low resistance conductor 182 through resistors 186 and 184 in series; stator electrode 187 connects to low resistance conductor 182 through resistors 188, 186, and 184 in series. Commutation zone 163 contains stator electrodes 189, 190, 192, and 194. Stator electrode 189 connects to stator electrode 181 through low resistance conductor 182; stator electrode 190 connects to low resistance conductor 182 through resistor 191; stator electrode 192 connects to low resistance conductor 182 through resistors 191 and 193 in series; stator electrode 194 connects to low resistance conductor 182 through resistors 195, 193, and 191 in series. Commutation zone 164 contains stator electrodes 196, 198, 200, and 202. Stator electrode 196 connects to Side B through low resistance conductor 197. Stator electrode 198 connects to Side B through resistor 199; stator electrode 200 connects to Side B through resistors 201 and 199 in series; stator electrode 202 connects to Side B through resistors 203, 201, and 199 in series.

When the circuit is closed there is a low resistance path from Side A to Side B through the commutating circuit breaker in this way: Side A connects through conductor 174 to stator electrode 166 to shuttle electrode 211, which then connects through insulated conductor 210 to shuttle electrode 212, which then connects to stator electrode 181 and from there through conductor 182 to stator electrode 189, then to shuttle electrode 216, then through insulated conductor 215 to shuttle electrode 217, then to stator electrode 196, then through conductor 197 to Side B. The commutating shuttle in this case is essentially a rigid body that maintains a set geometric relationship between the four shuttle electrodes 211, 212, 216, and 217 as it moves to the right to open the circuit. It is desirable to have the times at which the four shuttle electrodes lose contact with the four on-state stator electrodes that correspond to a closed circuit (166, 181, 189, and 196) not to be simultaneous, since simultaneous commutation in all four sets of electrodes will increase the magnitude of the switching transient. The trailing edges of the four shuttle electrodes 211, 212, 216, 217 can have their axial positions adjusted to time the four first commutations off the on-state electrodes, during which electrical connection is lost with stator electrodes 166, 181, 189, 196; in fact, all the subsequent commutations can be timed by also adjusting the spacing between second, third, and forth electrodes within each commutation zone. Said timing may be accomplished by adjusting both the spacing between the shuttle electrodes and the stator electrodes; or, a standard spacing can be adopted between the shuttle electrodes, with all the timing control being done by adjusting the trailing edge positions of the stator electrodes only. It is optimal to insert the twelve resistors at controlled time intervals. After the twelve resistive insertions implied by FIG. 5, the current is low enough so that the shuttle electrodes can move beyond their last connection through resistors without damaging arcs as the then greatly diminished current is cut off. It is desirable to grade the resistivity of the trailing edges of the stator electrodes, especially the particular stator electrode that does the final power shutoff. In FIG. 5, the final shutoff occurs when shuttle electrode 211 loses its connection to stator electrode 172, which is the last electrode in Zone 1. (It is best to define which of the four final commutations [one in each Zone] is the one that opens the circuit, so that the extra high voltage insulation that will be needed can be deployed only in this particular zone; this saves cost.) Since stator electrode 172 is the one to open the circuit, it is highly desirable to grade the resistivity of the trailing edge of this electrode all the way from semiconducting to high resistivity to provide a soft final shutoff of the residual current still flowing after the twelfth commutation of the commutating circuit breaker of FIG. 5.

A long multistage chain of commutating circuit breakers as in FIG. 5 can be used to break an arbitrarily high voltage. In order to efficiently move a long commutation shuttle such as this implies, it is desirable to use multiple drives along the length of the commutating shuttle, such as multiple springs positioned to accelerate the shuttle between the commutating zones, or multiple linear motors acting between the commutating zones. A long multistage breaker with embedded permanent magnets can be driven by known electromagnetic means, for example (however, greater force can be exerted with springs or electromagnets than by electromagnetic coupling to permanent magnets). A combination of drive mechanisms can also be used to achieve greater acceleration than can be produced by one means alone. A variety of triggers and releases can be deployed in such a multistage linear breaker, as is discussed in more detail later.

Figure 6:
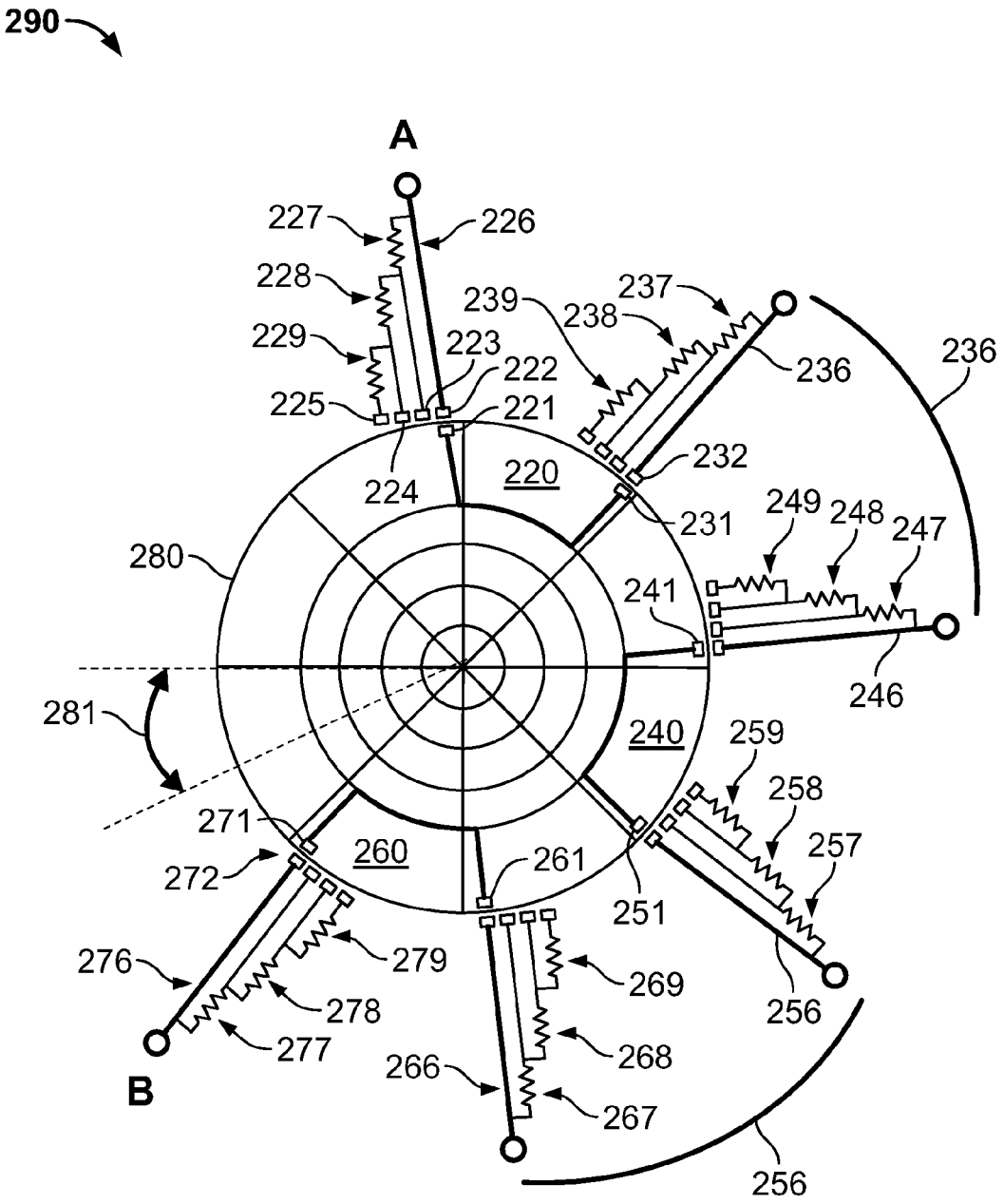
FIG. 6: Rotary Motion Multistage commutating circuit breaker with six commutation zones in three stages.

FIG. 6 represents a notional rotary multi-stage commutating circuit breaker designed for one pole of a medium to high voltage DC or AC power circuit breaker. In this case, six commutation zones are shown, 221-229 (comprising shuttle electrode 221; stator electrodes 222, 223, 224, and 225; conductive lead 226; and resistors 227, 228, and 229); 231-239 (comprising shuttle electrode 231; stator electrodes 232, 233, 234, and 235; conductive lead 236; and resistors 237, 238, and 239); 241-249 (comprising shuttle electrode 241; stator electrodes 242, 243, 244, and 245; conductive lead 246; and resistors 247, 248, and 249); 251-259 (comprising shuttle electrode 251; stator electrodes 252, 253, 254, and 255; conductive lead 256; and resistors 257, 258, and 259); 261-269 (comprising shuttle electrode 261; stator electrodes 262, 263, 264, and 265; conductive lead 266; and resistors 267, 268, and 269); and 271-279 (comprising shuttle electrode 271; stator electrodes 272, 273, 274, and 275; conductive lead 276; and resistors 277, 278, and 279). Because of crowding on FIG. 6, stator electrodes 233, 234, 235, 243, 244, 245, 253, 254, 255, 263, 264, 265, 273, 274, and 275 are not labeled in FIG. 6, but follow the same pattern set by 222, 223, 224, and 225. These zones are arranged in pairs that comprise commutation stages: the first commutating zone (defined by 221-229 in FIG. 6) is closest to Side A, and is linked via insulated conductor 220 to the second commutating zone (defined by 231-239 in FIG. 6); the first commutating zone and the second commutating zone together with insulated conductor 220 form the first of three commutation stages in the commutating circuit breaker of FIG. 6; this entire commutation stage is later referenced as stage 220. The other two stages include components 240-259 and 260-279, and are later referenced as stage 240 and stage 260. A stage is defined as a complete circuit that moves power on to the commutating shuttle and then off of the shuttle. In FIG. 5 there are two stages, and in FIG. 6 there are three stages.

The multistage rotary commutating circuit breaker of FIG. 6 works in much the same way as the linear multistage commutating circuit breaker of FIG. 5, except that actuation is via counterclockwise rotation of a cylindrical commutating rotor 280 rather than linear motion of a commutating shuttle as in FIG. 5, and there are three stages rather than two as in FIG. 5. (As used herein, "commutating rotor" is a special case of a "commutating shuttle;" a "shuttle electrode" refers to any moving electrode, whether it moves linearly as in FIG. 5, or via rotation, as in FIG. 6.) The circuit breaker of FIG. 6 has six commutation zones, each of which works in the same way as does each of the four linear motion commutation zones of FIG. 5. In this case, the commutating shuttle rotates about 18.2 degrees counterclockwise to open the circuit, then a further 7.9 degrees to a final open circuit position, so that the total rotation during actuation of the rotary commutating circuit breaker is 29.1 degrees (281). The rotor is composed of strong, electrically insulating materials such as a fiberglass reinforced polymer composite, an engineering grade thermoplastic compound, or a polymer-matrix syntactic foam, except for the shuttle electrodes 221, 231, 241, 251, 261, and 271 and the insulated conductive paths shown with heavy black lines (220, 240, and 260) within the shuttle that connect pairs of shuttle electrodes (such as 221 and 231). The shaft is desirably metallic, but electrically insulated from the conductors 220, 240, and 260. The entire rotating part is surrounded by a stator 290 in which the stator electrodes are mounted. The resistors are preferably outside the stator to facilitate heat removal after the circuit breaker trips.

The view in FIG. 6 is an end-on view of a commutating shuttle which has the shape of a cylinder. The length of the cylinder (perpendicular to the cross-section shown in FIG. 6) can be adjusted to keep the normal full load amps per $cm^2$ of electrode contact area within design limits; thus, depending on the current, the cylinder 280 can look like a disc or a barrel. The circumferential insulated distance between stator electrodes (for example 222, 223, 224, 225) can be adjusted to deal with the voltage gradient at each commutation; in principle, both the width of each stator electrode and the distance between each next neighbor pair of stator electrodes would be adjusted to reach an optimum design. Not the distances between stator electrodes, the width of the stator electrodes, nor the composition of different stator electrodes needs to be the same for any two stator electrodes. Multiple series-connected commutating circuit breakers such as that of FIG. 6 can be mounted on a single shaft, to create more commutation stages (6, 9, etc.). In this case, each of the shuttle electrodes 221, etc, and their mating stator electrodes 222, etc. only span a fraction of the length of the drive shaft separated by intervening insulating sections. There can in this case be torque drives or bearings between the commutating components.

In the particular design of FIG. 6, the on-state stator electrodes 222, 232, 242, 252, 262, and 272 are desirably liquid metal electrodes; these are the only stator electrodes which carry high current in the on-state. Liquid metal electrodes are about $10^4$ times as conductive as sliding solid metal electrodes in terms of contact resistance. Liquid metal electrodes can therefore also be narrower than sliding solid contact electrodes, which is a major advantage for the first few commutation steps of a commutating circuit breaker. Let's consider a specific case: in FIG. 6 the liquid metal stator electrodes 222, 232, 242, 252, 262, and 272 can be one tenth as wide as the solid stator electrodes 223, 224, and 225 for example, and still have one thousandth of the contact resistance of the solid stator electrodes. As a particular example, consider the case where the commutating rotor of FIG. 6 is a 31.5 cm diameter barrel-shaped commutating shuttle designed for 30 kV DC or AC power. Making one of the liquid metal stator electrodes 222, 232, 242, 252, 262, and 272 one millimeter (mm) wide in the circumferential direction means that it would be possible to achieve the first commutation by only rotating the shuttle 280 by 0.36 degrees if the first stator electrode is aligned with the rotor electrode so that there is only one mm to move to cause the first commutation (for example). This first commutation is very important in any circuit breaker in which it is critical to control the maximum fault current, since as soon as the first resistance is inserted the fault current is controlled. Using narrow liquid metal electrodes is one way to speed up the first commutation by reducing the distance that must be moved by the commutating shuttle to get to the first commutation.

A consideration when using liquid metal electrodes is to avoid oxidized solid metal contacts to connect with the liquid metal electrode. One way to avoid oxidation at the shuttle electrode surface that mates with the liquid metal electrode is to enclose the circuit breaker in a sealed oxygen free environment; in this case, conventional copper- or silver-based shuttle electrodes can be used with a liquid electrode, as long as the liquid metal electrode does not react with copper or silver. Another known method is to use a "noble metal" such as gold, platinum, or palladium in air. A particularly desirable solution is to use a molybdenum-surfaced electrode, since molybdenum does not oxidize in air below 600° Celsius; even though molybdenum has low conductivity for a metal (resistivity 85 times higher than copper), a thin coating of molybdenum on a substrate metallic electrode results in an oxide-free surface that couples very well with liquid metal electrodes, without the added resistance due to a surface oxide layer; the resistance through the molybdenum per se is negligible if it is only a mm or less thick on the electrode, as may be easily obtained by plasma spray or various PVD (physical vapor deposition) processes.

Liquid metal electrodes typically comprise a sintered porous metal structural component formed by a powdered metallurgy processes that is wetted and flooded by a liquid metal such as gallium or a low melting gallium alloy. Sodium, sodium/potassium eutectic, and mercury have also been used in liquid metal electrodes, but are less desirable than gallium-based based liquid metal electrodes. Gallium, gallium alloys, sodium, or sodium/potassium eutectic will oxidize, so such electrodes must be protected within an oxygen-free container which may contain gas, liquid, or vacuum in addition to the solid movable parts of the rotary motion multi-stage commutating circuit breaker of FIG. 6. The added cost of the gas-tight containment structure in order to be able to use gallium or sodium based liquid electrodes is well justified in the case of high power circuit breakers, such as that of FIG. 6. If an oxygen-free environment must be maintained for the liquid metal, then there is also no need for the sliding surfaces of the non-liquid-metal electrodes to be oxidation resistant materials in principle (the non-liquid-metal electrodes include all the shuttle electrodes and potentially all but one of each commutation zone's stator electrodes); in such a design the sliding electrode surface could be based on an copper, nickel, chromium or silver pure metal or alloy, or a cermet composite containing one of these metals or an alloy thereof, rather than molybdenum. Even if an oxygen-free environment is provided in the final commutating circuit breaker however, an oxidation-resistant surface on the electrodes that contact the liquid metal electrodes in the on-state may be important to make it convenient to fabricate the device without having to maintain an oxygen-free environment between the time that the electrodes are manufactured and the circuit breaker is fabricated.

The six commutation zones of FIG. 6, each of which can shut off the power, give this design a high shut-off redundancy and reliability. As a particular example, consider again the case where the commutating rotor of FIG. 6 is a 31.5 cm diameter barrel-shaped commutating shuttle designed for 30 kV DC or AC power. The barrel-shaped rotary commutator 280 in this particular example is 99 cm in circumference and contains 6 conductive shuttle electrodes that are 1.25 cm wide in the circumferential direction (occupying 4.55 degrees at the outer radius of the commutating rotor). The shuttle electrodes are wide enough to be touching two stator electrodes at all times except for the final commutation; all the shuttle electrodes are embedded in an insulating polymeric material. The commutating rotor as a whole has a smooth outer surface to slide against the stator and its electrodes. The greater the number of amps, the longer the barrel has to be to pass the current in this design. In the specific case of the zone 1 commutation in FIG. 6, the stator electrodes 223, 224, and 225 are metallic electrodes that can be, for sake of demonstration 1.0 cm wide, with 0.25 cm of an insulator between each, so that the 1.25 cm wide shuttle electrodes are in full contact with the next stator electrode at the moment that contact is lost with a given stator electrode. The first stator electrode 222 is only 0.25 cm wide, and is a liquid metal electrode, followed by an insulating gap that is 0.25 cm wide between stator electrodes 222 and 223; this means that the commutating rotor only needs to rotate 0.91 degrees to the first commutation in zone 1. At the moment that electrode 222 loses contact with shuttle electrode 221, shuttle electrode 221 is in full contact with stator electrode 223; and at the moment that electrode 223 loses contact with shuttle electrode 221, said shuttle electrode is in full contact with electrode 224; and so on.

The trailing edges of the conductive electrodes of FIG. 6 may be graded in terms of composition and electrical resistivity to reduce the chance that an arc will initiate at the time the electrodes separate. This is true of all the designs of commutating circuit breaker discussed in this document, and the trailing edge resistivity gradient can be in only the shuttle electrodes, only in the stator electrodes, or in both the shuttle and stator electrodes. This is discussed more generally elsewhere; in the specific case of the FIG. 6 commutating circuit breaker a single graded resistivity zone at the trailing edge of one of the stator electrodes could easily absorb the last bit of magnetic energy in the flowing current after the last commutation of Table 1, or a capacitor may be more economical to absorb this last bit of inductive energy.

The outermost surface of the shuttle electrodes is best made from a highly conductive metal or composite which is also wear resistant, and which does not oxidize, recrystallize, or interdiffuse with the facing on-state stator electrodes during use. Oxidation can either be prevented by excluding oxygen, or by using an oxidation resistant metal such as gold, platinum, or molybdenum. Where oxygen is excluded, a particulate hard particle/soft metal matrix composite with good electrical conductivity, such as silver- or copper-impregnated porous structures based on sintered metals; for example sintered chromium powder as in U.S. Pat. No. 7,662,208, or sintered tungsten powder, as in commercial electrodes from Mitsubishi Materials C.M.I Co. Ltd. are suitable. Aluminum/silicon carbide electrodes are also suitable in an oxygen-free environment. Where oxygen is not excluded, molybdenum is a favored contact surface for all the non-liquid-metal electrodes; molybdenum that is plasma sprayed onto aluminum/silicon carbide electrodes is especially favorable. Although a version of the commutating circuit breaker of FIG. 6 could be made to operate in an air environment, it would not be possible in that case to use any other liquid metal electrodes other than mercury.

To achieve a target of losing 1.0 kW to on-state losses at 2000 amps in the closed circuit condition, the total resistance of the path from Side A to Side B in FIG. 6 would be at most 2.5E-4 ohms. This low a resistance is only feasible with liquid metal on-state electrode junctions, or with much greater contact areas for the on-state electrodes than is required for all the other electrodes. Achieving lower resistance entails using a more massive rotor, which requires more torque to accelerate; there exists an optimum design basis on-state resistance target that will be somewhat different for each particular case; in some cases, higher heat production than one kW may be well justified in combination with fan or liquid cooling, which enables a commutating circuit breaker without resorting to liquid metal electrodes for the on-state electrode connections.

The spring or other driver used to cause the counterclockwise radial acceleration of FIG. 6 may accelerate the rotor throughout the time of the commutations, or alternatively, a very stiff spring could impart an initial acceleration using up only a small part of the 18.2 degrees of radial motion that the commutating rotor moves during commutation. In this scenario, the commutating rotor is in free ballistic flight during most of the time it is moving and causing commutations.

By making a few simplifying assumptions, an optimized sequence for the eighteen resistor cut-ins that the 18 commutations of the commutating circuit breaker of FIG. 6 enables, for a 300 kV commutating circuit breaker, can be modeled. Table 1 gives the calculated target commutation times and inserted resistances, based on these assumptions:

1. Assumed circuit inductance of 100 millihenries (realistic high side estimate);
2. Maximum allowed current is 10 kA at the first commutation;
3. Upper voltage limit of 500 kV (1.67× normal voltage); which then decays exponentially to a lower voltage limit of 360 kV (1.2× normal voltage) before the next commutation.

Since one cannot pick where a circuit fault occurs it is not logical to take the normal system inductance as being a realistic estimate of system inductance in a fault; part of the system inductance may not be available to slow the inrush of current in a fault, depending on where the fault occurs. This case allows us to consider a realistic high inductance fault (100 millihenries); in this case the inductively stored magnetic energy that must be dissipated to open a faulted HVDC circuit at 10 kA is 5 million joules (5 MJ). The previously mentioned carbon/alumina sintered resistors from HVR International can absorb 111 J/gram in routine service, which means that 45 kg of HVR disc resistors would be needed to absorb 5 MJ of inductive energy as modeled in Table 1. In order to be able to absorb the energy of three repeated circuit openings based on the above assumptions, 135 kg of HVR International pulse-rated resistors would be needed.

The first commutation of Table 1 inserts 50 ohms, which is based on limiting the voltage and current at the design basis maximum (500 kV and 10 kA); this first commutation needs to occur within 2.667 milliseconds (ms) in order to hold the fault current to no more than 10 kA (starting from normal full load of 2 kA at time zero). This is because it takes 2.667 seconds to build the current from 2000 to 10000 amps given the assumed high-side estimate of inductance (100 mH) for the calculations used for Table 1. An important corollary is that if the fastest time to the first resistive insertion is one millisecond rather than 2.667 milliseconds, then the minimum inductance in a fault must be no more than 1/2.667×100 mH, or 37.5 mH; we will discuss this in more detail below. After the first insertion of 50 ohms, it takes 0.657 ms for the voltage to decay from 500 kV to 360 kV; this is the time of the second commutation, after which the resistance is 69.4 ohms, and it takes only 0.473 ms for the voltage to decay from 500 kV to 360 kV, and each subsequent resistance level applies for less elapsed time, because at higher resistance, the exponential decay of current is faster. Each step of this repeated exponential decay of current (i) occurs according to this equation:

$$i(t)=Ie^{-(R/L)t} \tag{1}$$

Where I is the current when the resistance R (in ohms) is first inserted, and L is the inductance (0.10 Henry in this example), and t refers to time (in seconds) since resistance R is first inserted. Resistance R is repeatedly reset during the operation of the commutating circuit breaker (as in Table 1); this is a highly efficient way to absorb inductively stored magnetic energy during opening of a DC circuit with a lot of stored magnetic energy. By holding the voltage 20% above normal operating voltage during opening of the circuit breaker, we can guarantee that any batteries and/or high energy capacitors that may be on the circuit will not discharge through the fault during the time the circuit is being opened.

TABLE 1

Optimized Commutation Times & Resistance Steps for FIG. 6 Breaker

| commutation | time, ms | R (ohms) | Δ time at R, ms | amps | (inductive energy, joules) |
|---|---|---|---|---|---|
| #1 | 2.667 | 50.0 | 0.657 | 10000.0 | 5000000 |
| #2 | 3.324 | 69.4 | 0.473 | 7200.0 | 2592000 |
| #3 | 3.797 | 96.5 | 0.341 | 5184.0 | 1343693 |
| #4 | 4.138 | 134.0 | 0.245 | 3732.5 | 696570 |
| #5 | 4.383 | 186.1 | 0.177 | 2687.4 | 361102 |
| #6 | 4.560 | 258.4 | 0.127 | 1934.9 | 187195 |
| #7 | 4.687 | 358.9 | 0.092 | 1393.1 | 97042 |
| #8 | 4.778 | 498.5 | 0.066 | 1003.1 | 50307 |
| #9 | 4.844 | 692.3 | 0.029 | 722.2 | 26079 |
| #10 | 4.873 | 961.6 | 0.034 | 520.0 | 13519 |
| #11 | 4.907 | 1335.5 | 0.011 | 374.4 | 7008 |
| #12 | 4.918 | 1854.9 | 0.018 | 269.6 | 3633 |
| #13 | 4.936 | 2576.2 | 0.013 | 194.1 | 1883 |
| #14 | 4.948 | 3578.1 | 0.009 | 139.7 | 976 |
| #15 | 4.958 | 4969.5 | 0.009 | 100.6 | 506 |

TABLE 1-continued

Optimized Commutation Times & Resistance Steps for FIG. 6 Breaker

| commutation | time, ms | R (ohms) | Δ time at R, ms | amps | (inductive energy, joules) |
|---|---|---|---|---|---|
| #16 | 4.967 | 6902.1 | 0.005 | 72.4 | 262 |
| #17 | 4.972 | 9586.3 | 0.003 | 52.2 | 136 |
| #18 | 4.975 | 13314.3 | 0.002 | 37.6 | 71 |
| final circuit open | 4.978 | >1E8 | | 27.0 | 37 |

Figure 7:
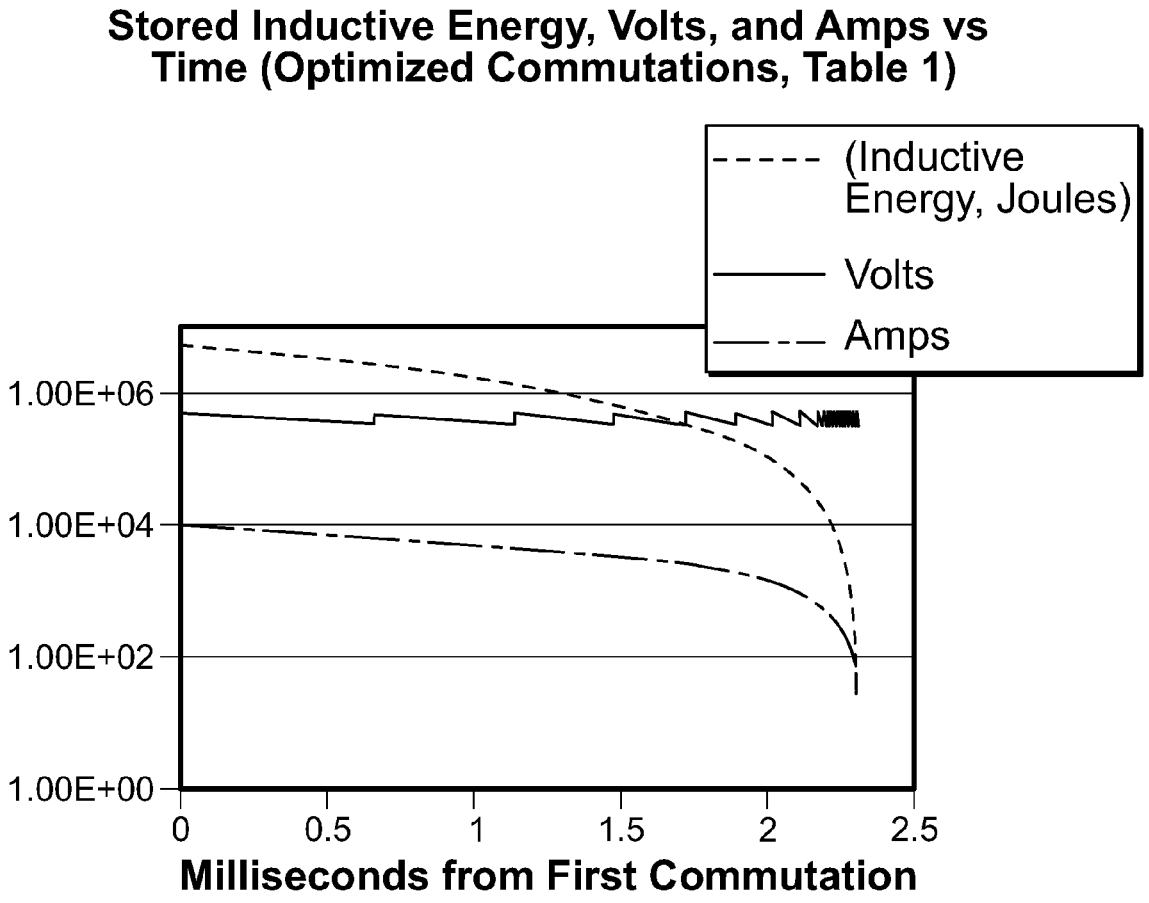
FIG. 7: Quenching of current and energy for an optimized 18-stage commutating circuit breaker of FIG. 6 and Table 1.

Eighteen resistance insertions occur during the opening of the circuit in Table 1; the resultant voltage, current, and inductive energy changes are as shown in FIG. 7; the first six commutations can be timed precisely by adjusting the exact angles of rotation at which each of the first six separations of stator electrode and shuttle electrode occur, as the trailing edge of a shuttle electrode moves away from the trailing edge of a particular stator electrode. This fine timing adjustment capability for the first switching event in each of the six commutation zones can be determined down to the microsecond time scale by careful design of the structure of the rotating commutating shuttle 280 and the mating commutating stator 290; however, after that the needed minimum spacing between stator electrodes to maintain electrical isolation creates limitations on timing subsequent commutations in each commutating zone.

In a realistic opening of a rotary circuit breaker as per FIG. 6, switching will not be fast enough to keep up with the pace of the last several commutations of Table 1, since for the last few resistance levels, the indicated time delay between switching is only a few microseconds. If switching rate is uniform and slower than indicated in Table 1 for the last twelve commutations, 130 microseconds between each commutation after Commutation #6, then the final shutoff would occur at 3.453 ms after the first commutation rather than at 2.311 ms after the first commutation as indicated in Table 1. The range of voltage from 500 kV to 360 kV is an unusually narrow control range for voltage excursions during opening of a circuit breaker (voltage switching transients), which is enabled in this case by the eighteen small commutation steps of Table 1 that the design of FIG. 6 allows. It is also true that a linear multistage design like that of FIG. 5 but with three stages rather than two (as shown in FIG. 5) would be electrically equivalent to the FIG. 6 design, and so could also deliver the first six switching event timings shown in Table 1. The final open circuit condition occurs when one of the shuttle electrodes slides past the last of that zone's sequence of stator electrodes into its highly insulating final resting zone. Although in the design of FIG. 6 all six shuttle electrodes slide past the last of each zone's sequence of stator electrodes into a highly insulating final resting zone, the remaining final five commutations that occur in the other five zones are redundant final circuit openings. Note from Table 1 and FIG. 7 that the commutating circuit breaker with 18 commutations through resistors reduces the stored inductive energy from 5 million joules to just 37 joules at the time when the circuit is opened; the current is squeezed down from 10 kA to 27 amps via the 18 commutations. One still needs to deal with the last bit of inductive energy; this can be accomplished with a small capacitor, or by using a graded resistivity in the trailing edge of the stator electrode that does the final circuit opening. In order to accomplish the commutations implied by Table 1, it will be necessary to use resistivity gradients in the trailing edges of all the electrodes, and to surround the electrodes by high dielectric strength fluids, as discussed in more detail subsequently.

Although FIG. 6 shows the shuttle electrodes on the outer radius of the commutating shuttle, it is equally possible to put the shuttle electrodes on the flat ends of the shuttle. Both designs have advantages and disadvantages. The design of FIG. 6 is analogous to a drum brake, where the brake pads have an analogous role to that of the stator electrodes, and the drum is analogous to the rotary commutating shuttle. The alternative design with the shuttle electrodes on the ends of the commutating shuttle is analogous to a disc brake; however, unlike a disk brake, the wedge shaped electrodes cannot extend all the way to the center of rotation, since this would put neighboring electrodes too close together to maintain electrical isolation near the center.

It is easier to submerge the cylindrical commutating rotor of FIG. 6 in an arc suppressing fluid compared to a linear movement commutating circuit breaker such as that of FIG. 5 because rotation of a circularly symmetrical cylinder does not produce form drag, whereas linear motion in a fluid necessarily involves form drag, which can significantly inhibit rapid motion of the commutating shuttle in a liquid. The cylindrical design also enables a liquid submerged system with a very low volume of liquid compared to a linear actuated design. Sparking can be highly inhibited by fluid surrounding the separating electrodes, especially if the fluid has been degassed and is held at high pressure. Limiting the dielectric fluid to less than a liter is feasible in a cylindrical commutating circuit breaker such as that of FIG. 6. This means that high dielectric strength fluids such as perfluorocarbon fluids or liquid sulfur hexafluoride could be economically used. The major advantage of using high pressure lubricants in a commutating circuit breaker is that the standoff distance between neighboring electrodes can be reduced if the gap between the neighboring electrodes is flooded with a very high dielectric strength high pressure fluid. This will allow more compact commutating circuit breakers. It has not been practiced commercially in the prior art to operate switchgear at high liquid pressure, but the unique shape of the rotary commutating circuit breaker of FIG. 6 allows for a very small volume of high pressure liquid, which is not dangerous in terms of stored energy.

The needed separation distance between next neighbor commutating electrodes depends mainly on the voltage change that occurs during the commutation step as current flowing through one resistive path is shunted to the next path when the separation of the shuttle electrode and stator electrode occurs. The voltage difference between these two alternate paths carrying the same current is a reasonable estimate of the actual voltage difference driving arc formation as two electrodes separate; this driving force to form an arc has little to do with the medium surrounding the electrodes (vacuum, gas, or liquid) but whether an arc actually does form also depends on the dielectric strength of the fluid surrounding the separating electrodes. This in turn depends on such factors as the pressure and chemical composition of the fluid and the dissolved gases present in the fluid if it is a liquid. Particularly desirable fluids to surround the separating shuttle electrode and stator electrode include paraffinic hydrocarbons, including mineral oil and kerosene; vegetable oils; methyl esters of fatty acids; perfluorocarbon fluids; and liquid or gaseous sulfur hexafluoride (including gas mixtures), and a high vacuum. Sulfur hexafluoride-containing gas mixtures are well known in the prior art for their high dielectric strength (for a gas) and excellent arc quenching properties, but liquid phase sulfur hexafluoride is not used commercially at present as far as I know as an intentional liquid dielectric. The low liquid volume required in rotary design commutating circuit breakers such as that of FIG. 6 make it feasible to use $SF_6$ in the liquid state as a dielectric fluid.

The properties that influence whether an arc, a small spark, or no spark at all will be struck at the moment of separation of shuttle electrode and stator electrode include:

1. the current that is flowing at the moment of separation;
2. the resistivity profiles of the parting electrodes;
3. the dielectric strength of fluids surrounding the parting electrodes;
4. the availability of a parallel path for the current to take.

Each time a commutation occurs the total voltage across the circuit breaker is redistributed over the six commutation zones proportional to the fraction of the total resistance from Side A to Side B that applies to the given commutation zone. When a new, higher resistance is switched into the circuit, the largest proportion of the total voltage gradient will be across the most recently switched commutating zone with the highest resistance. In the design of FIG. 6, configured as a stand-alone circuit breaker for 300 kV as implied by Table 1, the first commutation represents such a large increase in resistance that effectively the entire 500 kV could be across the first switched-in resistor, and voltage withstand must be suitably high in that commutation zone.

It is desirable to create multistage commutating circuit breakers as in FIG. 5 (linear motion) and FIG. 6 (rotary motion), especially for high voltage applications; the multiple stages divide the voltage, thus allowing for lower voltage per stage. In order to accomplish this, commutating shuttles containing pairs of shuttle electrodes which are connected to each other electrically but are insulated from each other at the surface of the commutating shuttle are required. Said insulating material can comprise a polymer, an inorganic glass, a ceramic, a cementitious material, or a composite of two or more of these components. Specific examples of insulators that may be used to insulate around the shuttle electrodes include:

1. fiber-reinforced composites based on a matrix phase curing polymer (such as fiberglass-epoxy, polyaramid-epoxy, boron fiber-epoxy, fiberglass-polyester, etcetera);
2. engineering-grade moldable plastics (defined as polymers with tensile modulus >2.5 GPa and tensile strength >40 MPa, which may be unreinforced polymers or polymers reinforced by non-conductive reinforcing fillers;
3. cement composites, including fiber-reinforced and polymer latex toughened cement composites;
4. plasma sprayed or flame-sprayed coatings on metals;
5. polymeric syntactic foam (low density and high compressive and shear strength);
6. nanocomposites.

Each shuttle electrode aligns with several different stator electrodes as the shuttle moves, and in most cases each shuttle electrode is also connected to a second shuttle electrode at a different location on the commutating shuttle, such that the two shuttle electrodes are insulated from each other on the surface plane.

The shuttle electrodes of a multi-zone commutating shuttle occupy less than half of the total surface area of the commutating shuttle, and in most cases occupy less than 20% of the surface area of the commutating shuttle. The commutating shuttle can be fabricated from previously formed metallic and insulative components; or, the commutating shuttle can be obtained by overmolding or coating an insulator onto a metallic core. Overmolding can be accomplished via reaction injection molding (RIM) of fast-polymerizing systems, by casting of slow-polymerizing systems, or by thermoplastic molding, for example. Thermoplastic molding can be by compression molding, injection molding, spin casting, or rotational molding for example.

Figure 8:
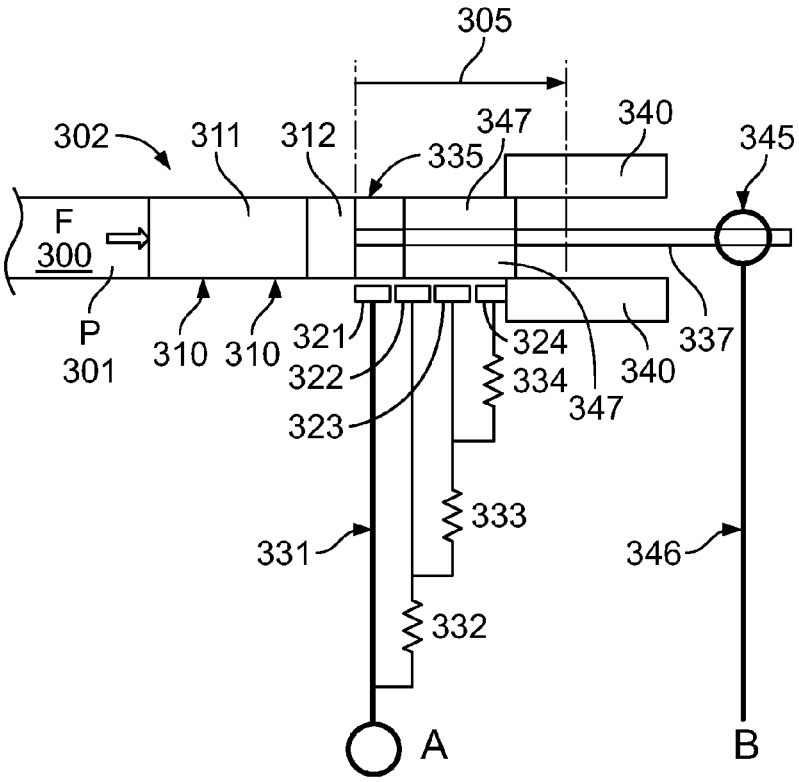
FIG. 8: Single stage commutating shuttle with electrical stress control behind moving electrode; circuit shown just prior to actuating motion of the commutating shuttle.
Figure 9:
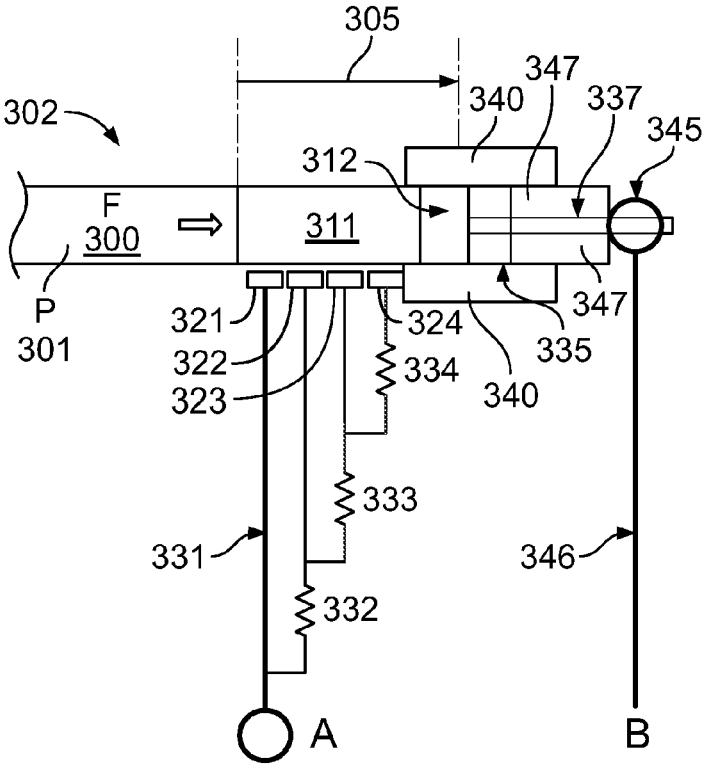
FIG. 9: Single stage commutating shuttle with electrical stress control behind moving electrode; circuit shown at the end of the motion of the commutating shuttle.

FIGS. 8 and 9 depict a single stage commutating circuit breaker with commutating shuttle 310 (which includes a highly conductive shuttle electrode 335, a semiconductive transition plug 312, an insulating plug 311, and an insulating sleeve 347 that surrounds part of a highly conductive connecting rod 337). Connecting rod 337 attaches the shuttle electrode 335 to Side B through a conductive slip ring 345 and a wire lead 346. Shuttle electrode 335 connects the various stator electrodes 321, 322, 323, 324 to Side B as the shuttle electrode 335 moves to the right. The stator electrodes are connected through paths of varying resistance to Side A of the commutating circuit breaker; in the on-state (FIG. 8), stator electrode 321 connects through low resistance lead wire 331 to Side A; as the commutating shuttle moves to the right, stator electrode 322 connects shuttle electrode 335 through resistor 332; next, the connection is through stator electrode 323 through resistors 333 and 332 to Side A; then the connection is through stator electrode 324 through resistors 334, 333, and 332 in series. The commutating shuttle 310 is actuated by pressure P (301) behind insulating plug 311 and within the barrel 302, which applies force 300 to the commutating shuttle and causes it to move distance 305 from the closed (on) state shown in FIG. 8 to the open (off) state shown in FIG. 9. Insulating plug 311 must lie over all the stator electrodes (321, 322, 323, 324) at the end of travel of the commutating shuttle, and overlap with insulating layer 340, as in FIG. 9, in the fully open state to create a total resistance between Side A to Side B greater than $10^8$ ohms in the fully open state.

FIGS. 8 and 9 depict a simplified commutating circuit breaker with just one commutation zone; these simplified depictions of a single commutation zone with only three resistance insertions prior to opening the circuit simplify the discussion of certain aspects of commutating circuit breakers. The commutating circuit breaker of FIGS. 8 and 9 has only 5 primary resistance levels. Power is linked from Side B through slip ring 345 to the shuttle electrode 335, and from there through a series of different stator electrodes connected to increasing resistances given approximately by:

1. Resistance Level One is shown in FIG. 8: current flows with minimal resistance through stator electrode 321 and then through the circuit breaker via 331.
2. Resistance Level Two: current flows primarily through stator electrode 322 and then through resistance 332 to the opposite Side A of the circuit breaker.
3. Resistance Level Three: current flows primarily through stator electrode 323 and then through resistances 332+333 to the opposite Side A of the circuit breaker.
4. Resistance Level Four: current flows primarily through stator electrode 324 and then through resistances 332+333+334 to the opposite Side A of the circuit breaker.
5. Resistance Level Five is the open circuit condition shown in FIG. 9 in which total resistance $>10^8$ ohms (see FIG. 9).

Actuation of the circuit breaker begins with the commutating shuttle 310 (composed of components 311, 312, 335, 337, and 347) in the closed circuit state of FIG. 8; the resistance through the commutating circuit breaker in the closed circuit case is also known as the "on-state resistance" of the circuit breaker. The on-state resistance of the circuit breaker of FIG. 8 is actually comprised of two component resistances R1 and R2 through parallel circuits:

R1 is resistance of slip ring 345+lead resistances 346+337+contact resistance between shuttle electrode 335 and stator electrode 321+lead wire resistance 331

R2 is resistance of slip ring 345+lead resistances 346+337+contact resistance between shuttle electrode 335 and stator electrode 322+resistance 332;

the total on-state resistance is then given by:

$$Rtotal = \frac{R1 \times R2}{R1 + R2} \tag{2}$$

Thus, in general, when the shuttle electrode 335 is touching two stator electrodes, the actual resistance should be calculated as a parallel path resistance. In the on-state closed circuit condition, R2>>R1 (because R2 includes resistance 332, the first in a series of inserted resistances); so most of the current goes through the low resistance path R1, and the total resistance Rtotal is only a little less than the resistance through this path alone. To make this concrete, consider the case of a normal voltage of 1200 volts, with normal full load of 1200 amps, and a design basis maximum current of 6000 amps, max voltage=2400 volts, and max heat loss in the on-state due to ohmic losses ($I^2R$) of 100 watts; this requires that Rtotal in the closed circuit case (on-state) can be no more than 69 micro-ohms. The first inserted resistance would be 0.40 ohms (based on maximum current/maximum voltage on a fault), so equation 2 implies that the resistance of the parallel circuit of equation 2 would only be 0.017% lower than the simple connection through only one resistive path (R1). Note though that in subsequent commutations, for example when there are parallel paths available through stator electrodes 323 and 324, the current is more evenly split between the parallel paths, though even in this case the major portion of the current will flow through the less resistive path through electrode 323.

During commutation, the contact area between shuttle electrode 335 and stator electrode 331 goes to zero, and the resistance through electrofr 331 (R1) increases until is surpasses R2, just before commutation [because contact resistance scales with 1/(contact area)]. By grading the resistivity of the trailing edges of shuttle electrode 335 and stator electrode 331, the desired commutation can be forced to occur well before the two electrodes lose contact; in this case, a semiconductive trailing portion of shuttle electrode 335 is provided by transition plug 312.

As the commutating shuttle 310 moves to the right from the initial position of FIG. 8, there will also be an electric current path through transition plug 312 to a sequence of stator electrodes (321, 322, 323, and 324). This means that at some points during the opening of the circuit breaker there will be electrical paths through three different stator electrodes, with the leftmost connections being through the semiconductive transition plug 312. When shuttle electrode 335 leaves contact with stator electrode 321, there is a sudden increase in resistance through 321 and 331 as current through this path must then pass through the transition plug 312 after the metal electrodes 335 and 321 separate, which quickly commutates the current to the path through R2, but much more softly than if the trailing (left) edge of shuttle electrode 335 would abut an insulator such as 311 rather than semiconducting transition plug 312.

A consideration during this commutation is that current through the semiconducting transition plug 312 must not cause melting or damage to the material used to create semiconducting transition plug 312. This can be avoided by making the resistivity of transition plug 312 high enough so that only a minor portion of the current flows through transition plug 312 in every commutation except the last one. At the end of the motion of commutating shuttle 310, semiconducting transition plug 312 performs the final quench of the last of the inductive energy. At the final commutation, as shuttle electrode 335 moves to the right of stator electrode 324, the only electrical connection remaining between Side A and Side B goes through the semiconducting transition plug 312. Because of the graded resistivity in transition plug 312, a soft shut off can be provided if current and voltage is low enough to not damage the semiconducting material that makes up transition plug 312 during the shut off.

At equilibrium in the commutating circuit breaker of FIGS. 8 and 9 (which can only occur when the shuttle electrode 310 is stationary), the current is partitioned between all parallel-connected resistive paths in inverse proportionality to the path resistance. During a commutation a true equilibrium does not actually pertain, but it is nonetheless useful to consider a pseudo equilibrium condition which is evaluated moment by moment during opening of the commutating circuit breaker. In general, electrical equilibration is fast compared to mechanical motion of the commutating shuttle, or resistive heating of conductive shuttle components, so this pseudo-equilibrium condition is at least reasonable. It is desirable to minimize the inductance of the resistive paths shown in FIGS. 8 and 9, since each pathway will store an amount of magnetic energy $Lpath \cdot I^2$ when the current is flowing which must be dissipated in order to commutate the current to a different path. In this case, Lpath refers just to the inductance of the current path from the point where the current turns from another alternative path to go through the given path, such as L331, which is the inductance from stator electrode 321 through connector 331 to Side A, or L332, which is the inductance from stator electrode 322 through resistor 332 and its lead wires to Side A. It is thus desirable in particular that resistors 332, 333, and 334 have relatively low inductance, as will be familiar to a person skilled in the art of electrical engineering.

Let's step through the actuation process for the device of FIGS. 8 and 9: pressure 301 creates force 300 by acting on the surface area of insulator 311; the force 300 moves the shuttle to the right inside the barrel 302, for a total distance 305; the electrical resistance increases in stages:

1. prior to the first commutation the resistance is the parallel path resistance between R1 and R2 as defined by equation 2 above, with R1, R2 as defined just below equation 1;
2. after the contact between shuttle electrode 321 to 335 is lost, the resistance is nearly R2 for a time, but slightly reduced by the parallel path through the semiconducting plug 312 to electrode 321;
3. next there is a period in which the resistance corresponds to a parallel path between R2=332 and R3=333;
4. after the contact between shuttle electrode 322 to 335 is lost, the resistance is nearly R3=333 for a time (and so on through the sequence of resistive connections).

As described previously, the application of equation 2 to calculating the actual resistance through parallel paths as described above only slightly modifies the resistance steps defined at the beginning of the discussion of FIGS. 8 and 9. The designation of the two poles (meaning electrical connections) in FIGS. 8 and 9 as Side A and Side B may equally well be reversed; the polarity through a commutating circuit breaker may be reversed due to the arbitrary nature of the poles of a circuit breaker. For any of the figures shown, Side A can be exchanged with Side B and the commutating circuit breaker will still work, though a particular polarity may give the best performance. Depending on which pole is live after the commutating circuit breaker has opened the circuit, there will be different portions of the commutating circuit breaker that are de-energized in the case of only one pole being energized when the circuit is opened. If the power source is on the A side of the breaker of FIGS. 8 and 9 then when the circuit breaker is open as in FIG. 9, shuttle electrode 335 and the slip ring 345 are de-energized (which facilitates maintenance of the slip ring 345). If on the other hand the power source is on the B side of the breaker of FIGS. 8 and 9, then when the circuit breaker is open as in FIG. 9, the stator electrodes 321-324 will be de-energized (which facilitates maintenance of the stator electrodes 321-324).

Three particularly desirable kinds of material for dielectric insulating plug 311 are:

1. Rigid syntactic foam is especially desirable for insulating plug 311, due to its high strength to density ratio, in terms of both compressive strength and shear strength;
2. A hollow insulating tube that is quite strong and rigid, and capped with a strong end at the boundary with transition plug 312 could also work as insulating plug 311.
3. A highly insulating elastomeric plug which is compressed when pressure is applied to drive the commutating shuttle forward may also be used for insulating plug 311; in the case where elastomeric plugs are employed for insulating plug 311 or semiconductive transition plug 312, it is critical that the interface between said plugs and the wall 302 be friction with said elastomer plugs.

Elastomers are desirable for at least a portion of transition plug 312, both because of the convenience of preparing chemically similar elastomer layers with controlled resistivity, and because compression of an elastomer layer such as transition plug 312 results in a pressure against the wall which facilitates tight contact with the stator barrel 302, which inhibits arcing between the plug 312 and the tube wall 302. The relative convenience of creating a stack of layers of elastomer compounds which are:

1. mutually cure compatible;
2. mechanically similar;
3. all with good sliding properties makes it fairly inexpensive to process, mold and fabricate cured elastomer plugs such as may be used in transition plug 312 with graded resistivity from $10^{-2}$ to $10^{12}$ ohm-m; it is much easier than creating all those layers in a plastic, for example. Two compatible elastomer masterbatches can be used to create the graded resistance portion of transition plug 312. This elastomeric portion of the transition plug may be bonded to a more conductive material, such as amorphous carbon or a sintered alnico layer for example, to cover the range of resistivity down to $10^{-4}$ ohm-m, which may be desirable at the leading edge of transition plug 312, where it abuts against shuttle electrode 335. It is a conventional, known method to blend two elastomer masterbatches in various ratios to get elastomers ranging from being good insulators to being semiconductive with resistivity as low as $10^{-2}$ ohm-meter. It is difficult to create intimate electrical contact between two separately molded semiconductive thermoplastic polymer discs, or between a thermoplastic, semiconductive polymer and a metal or ceramic surface, but the high compliance of elastomers facilitates better electrical connection to a surface, as long as the elastomer/metal interface is under pressure (as it will be during actuation of the circuit breaker of FIGS. 8 and 9).

It is helpful to have a lubricant available to fill the surface voids that always are present in sliding friction. This interfacial lubricating layer between the shuttle and the stator barrel 302 can be thinner if the mating surfaces of the shuttle and the stator are smooth, and match each other's shape. Insofar as the surfaces of the shuttle and the stator are not perfectly smooth, the boundary layer can also be thinner if plugs 311 and 312 are elastomeric and are compressed against the wall 302. It is desirable in this case that both 311 and 312 are elastomer compounds with similar mechanical properties derived from two cure compatible elastomer masterbatches A and B. Ideally, conductive masterbatch A has electrical resistivity of ~$10^{-2}$ ohm-m and resistive masterbatch B has electrical resistivity of $>10^{12}$ ohm-m. The two pure cured compounds derived from curing the pure masterbatches are conductive cured compound A made from conductive masterbatch A and resistive cured compound B made from resistive masterbatch B. Insulating plug 311 would be made of pure resistive compound B, and would be bonded to the graded resistivity transition plug 312. Graded resistivity transition plug 312 is composed of pure conductive cured compound A made from conductive masterbatch A on the right hand edge of 312, behind which are a series of different elastomer layers, compounds AB1, AB2, AB3, ABx and etcetera, perhaps comprising a dozen or so layers of different resistivity elastomer compounds ABx, Each individual ABx layer is made from a sheet of uncured rubber that has been produced by a rubber blending process that combines defined amounts of masterbatch A and masterbatch B. The combining of the precisely weighed portions of masterbatch A and masterbatch B can be done on a mill or in an internal mixer, for example. Resistivity can be measured in the uncured rubber for each of these masterbatches during processing, so that small adjustments to the blend ratio of masterbatch A and Masterbatch B can be made prior to curing these compounds in production.

When insulating plug 311 and transition plug 312 are integrated into a single elastomer plug with consistent mechanical properties from the left side of insulating plug 311 to the right side of transition plug 312 then a uniform pressure against the wall of the surrounding tube 302 can be established by elongating the unified plug 311-312 prior to putting it into the stator barrel 302. One way to accomplish this is to elongate a cured elastomer cylinder comprising 311 and 312 layers using a tensile stress, and then freeze the elongated elastomer below its glass transition temperature before cutting it up into individual pieces which each comprise a unified plug 311-312. These frozen, elongated plugs can either inserted into a device such as that of FIGS. 8 and 9, or the frozen elongated unified plugs 311-312 can be put inside a thin metal tube that is close to the same diameter as the frozen elongated unified plugs 311-312, and then warmed above the glass transition of the elastomer so that the elongated unified plugs 311-312 are held in an elongated condition by the radial restraint of the metal tube until inserted into the stator barrel.

A useful design feature of a commutating shuttle or a variable resistance shuttle is to use a polytetrafluoroethylene (PTFE) coated elastomer on some of the sliding surfaces between the shuttle and the stator such as on the outside of an elastomer cylinder like 311. Pure or formulated PTFE can be sintered and then skive cut to create a PTFE film which can then be used to create a sleeve. PTFE and/or PTFE compounds can also be ram extruded to form a thin-walled tube that can then be cut in lengths to use as a sleeve. Such a sleeve may then be adhered to an elastomer by first chemically etching it, for example with FluoroEtch® available from Acton Technologies, Inc., and then co-molding it with a curing elastomer. It is however not nearly as easy to vary the resistance level of a PTFE layer as is the case for ordinary elastomers, so PTFE coating of elastomer surfaces is more desirable in purely insulating segments, such as 311 of FIGS. 8 and 9, rather than for semiconductive components such as transition plug 312 of FIGS. 8 and 9.

Figure 10:
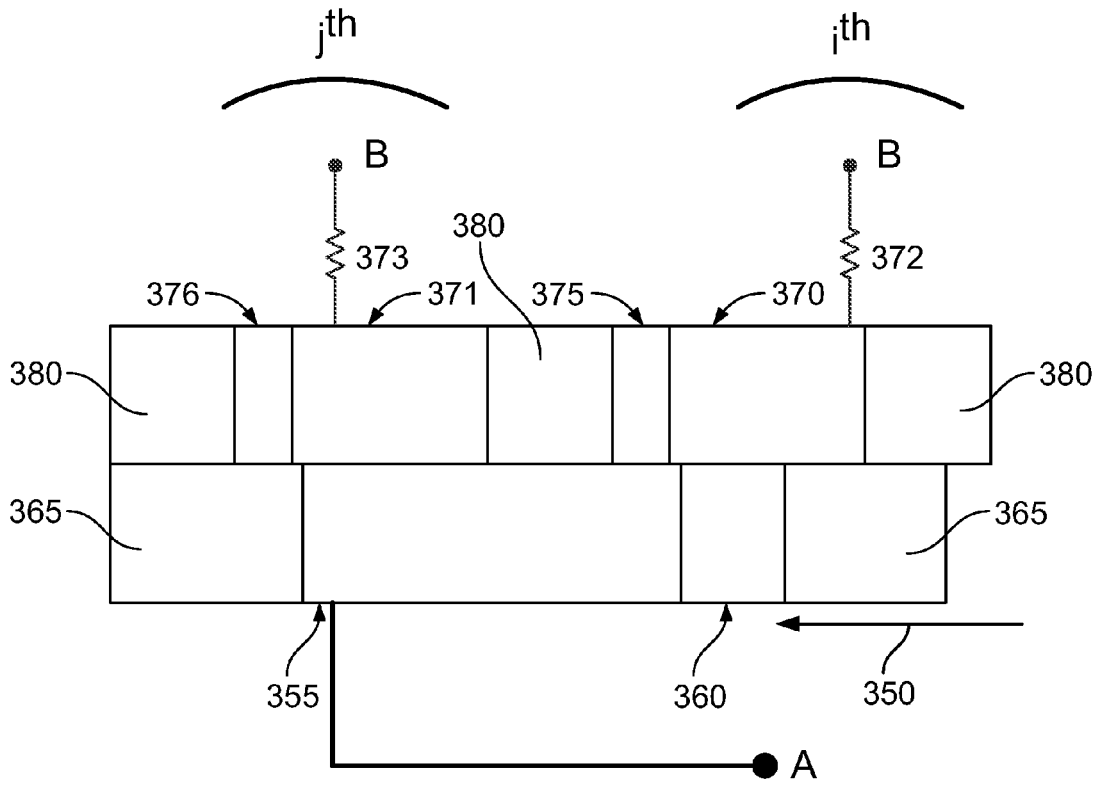
FIG. 10: Shuttle electrode/stator electrode interface with increased resistivity trailing edges.

FIG. 10 shows diagrammatically a sliding connection between two stator electrodes and one moving shuttle electrode; 355, 370, and 371 are highly conductive metallic electrodes, while 360, 375, and 376 are semiconductive electrodes that are functionally similar to 312 of FIGS. 9 and 9. Components 375 and 370 together form the $i^{th}$ stator electrode, and 371, 376 together form the $j^{th}$ stator electrode, with stator insulator 380 between and surrounding them; the $i^{th}$ stator electrode connects through resistance 372, while the $j^{th}$ stator electrode connects through resistance 373, which is higher resistance than 372. A sliding shuttle electrode (composed of the two layers 355 and 360) is electrically connected to both the $i^{th}$ and the $j^{th}$ stator electrode at the moment shown in FIG. 10. The shuttle electrodes 355 and 360 are surrounded by highly insulating regions of the shuttle 365. The shuttle electrode slides to the left (indicated by 350) below the stator electrodes and the trailing edge of the highly conductive portion of the shuttle electrode 355 is about to lose electrical connection to the highly conductive first portion of the $i^{th}$ stator electrode 370. One can see that this event will not completely open the circuit connection through the $i^{th}$ stator electrode through resistor 372, since the circuit is still open through the semiconductive electrode portions 360 and 375. By the time the final opening of the circuit through resistor 372 occurs, when the two semiconductive electrodes 360 and 375 separate, the current flowing through resistor 372 will have been reduced to less than one ampere.

FIG. 10 illustrates another case for how electrical smoothing layers may be implemented on the trailing edges of electrodes, showing the case where electrical smoothing elements (360, 375, and 376) are connected to the trailing edges of both a shuttle electrode 355 and two stator electrodes (370, 371). Here is a partial list of materials that may be used to modify the resistivity of electrodes as is useful in this invention:

1. Cold sprayed silver (resistivity ~$1.5\times10^{-8}$ ohm-meter), or other low resistivity metal or composite;
2. Nichrome alloys (resistivity ~$1.5\times10^{-6}$ ohm-meter) or another high resistivity metallic alloy or composite;
3. Cermet resistors (resistivity ~$10^{-6}$ to $10^{-3}$ ohm-meter) or another high resistivity metallic alloy or composite;
4. Alnico alloy #8 (resistivity ~$4.7\times10^{-3}$ ohm-meter);
5. Quasicrystalline alloys (resistivity ~$10^{-4}$ to $10^{0}$ ohm-meter)
6. Amorphous carbon (resistivity ~$10^{-4}$ to $10^{-2}$ ohm-meter);
7. Semiconductive filled polymer layers (resistivity ~$10^{-2}$ to $10^{12}$ ohm-meter);

These materials or a subset thereof can be deployed in the trailing edges of metallic electrodes, or in semiconductive components such as 153, 312, 360, 375, and 376. It is possible to use however many resistivity steps are needed.

The variable resistivity layer 360 is part of the moving shuttle, and so needs to be stronger than the stationary graded resistivity layers 375 and 376 at the trailing edges of the stator electrodes 370 and 371. Appropriate materials for the shuttle electrode graded resistivity feature 360 include cermets, quasicrystalline metal alloys, or highly loaded, stiff, slippery polymers, whereas transition plugs 375 and 376 can be made of weaker materials. It is also desirable to keep the stiffness and wear rate of all the layers that are engaged in frictional relative motion in a commutating circuit breaker approximately equal (for long device life).

A particular stator electrode is relevant to minimizing on-state heat generation due to ohmic losses only if a major portion of the on-state current flows through that particular stator electrode when the circuit is fully closed and the shuttle is stationary in the on-state (such as electrode 321 in FIG. 8). The stator electrodes that carry the main current in the closed circuit on-state such as 321 should be highly conductive (like copper or silver, or a liquid metal electrode as discussed previously), but the other stator electrodes such as 322, 323, 324 can be made of a variety of metals and/or cermets, chosen more for friction, wear, cost, and corrosion resistance properties rather than for especially low resistivity. Nickel and/or nickel alloys are particularly useful electrode materials, for stator electrodes that only carry current for a short time.

Figure 11:
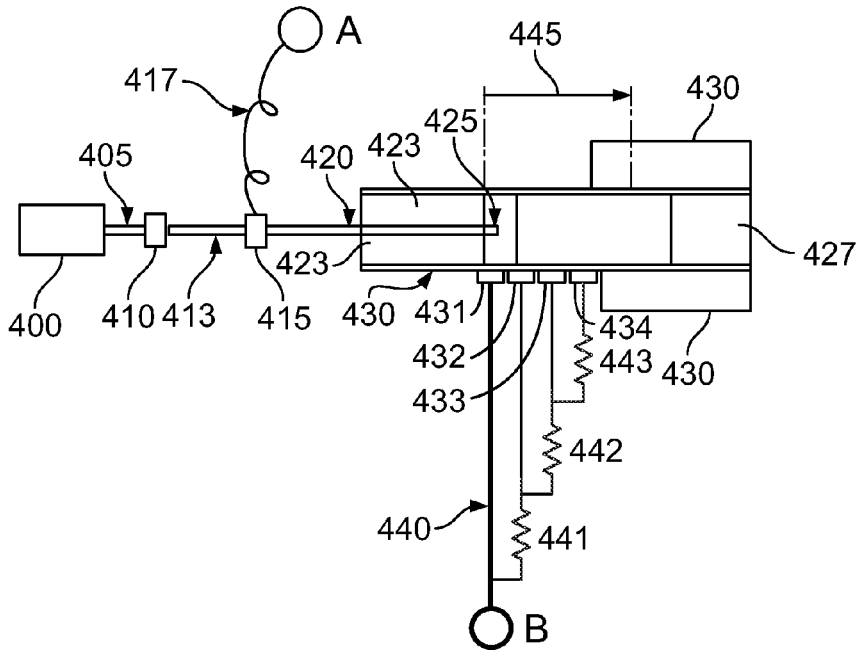
FIG. 11: Commutating circuit breaker with flexible wire lead from Side A to the shuttle.

FIG. 11 shows the case where electric power is delivered to the shuttle of a commutating circuit breaker by a flexible wire 417 from Side A. In this case, a commutating shuttle design with sharp conductor/insulator boundaries is depicted, but variable resistance electrodes as in FIGS. 8, 9, and 10 can also be used with a tethered wire attachment mechanism as in FIG. 11. The connecting wire 417 must have high strength and very good fatigue resistance. Total movement of shuttle electrode 425 to the right is such that at the end of its travel 445 the electrode is surrounded by a high dielectric strength, high resistivity tube 430. A shock absorbing insulating element 427 is at the end of the travel of the front (right hand) face of electrode 425. In the closed state, which is depicted in FIG. 11, nearly all the current from shuttle electrode 425 flows through stator electrode 431 and then through low resistance current path 440 to a second terminal B of the circuit breaker. As the shuttle electrode 425 moves to right; the current is sequentially diverted through stator electrodes 432, 433, and 434 and the respective resistor sequence; at the first commutation resistance increases from 440 to 441, then to 441+442, then to 441+442+443, before the current is quenched in a small spark or by charging a small capacitor (not shown) as shuttle electrode 425 passes beyond the edge of stator electrode 434. The actuator of motion 400 could be any suitable fast acting device; the thrust delivered by the actuator passes through a metal shaft 405 to an electrical isolation coupling 410, and from there via a non-conductive shaft 413 to the coupling 415 which links the metal shaft 420 to Side A of the circuit breaker via the wire lead 417. Shaft 420 is surrounded by an insulating sleeve 423 that aligns and supports the shaft within the non-conductive stator barrel 430, through which the stator electrodes 431, 432, 433, and 434 are installed.

Figure 12:
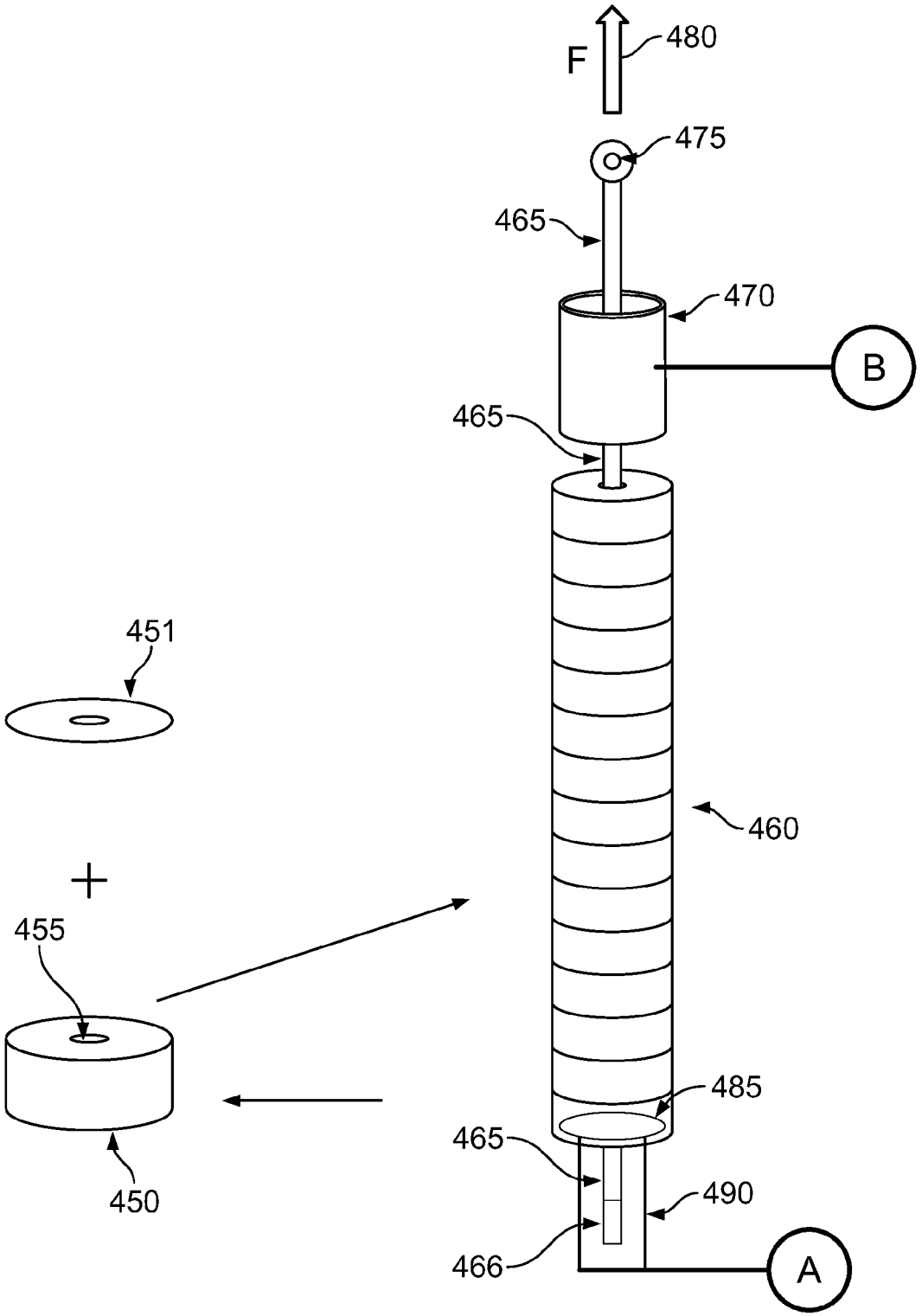
FIG. 12: Commutating circuit breaker with shuttle having the shape of a rod, tube, or wire.

FIG. 12 shows a variant on the simple commutating circuit breaker concept shown in FIG. 4. A cylindrical shaped stack of hollow disc resistors 460 with metal washers 451 between each pair of next neighbor disc resistors (such as 450) is bonded together by some suitable means such as conductive adhesive, soldering, or brazing. This is simpler and less expensive to implement than the disc resistor stack of FIG. 3, based on a metal Can to hold each disc resistor as shown in FIG. 2. The metal washers 451 are very simple examples of stator electrodes, and if the resistors are ceramic hollow discs as implied by FIG. 12, it is preferable to have a slightly smaller hole through the metal washers than the hole 455 through the disc resistors themselves (such as 450), so that the washers protrude into the central cavity through the resistors; this protects the inner surfaces of the disc resistors from damage via direct contact with the moving shuttle electrode 465, which in this case is simply a metal rod or tube that extends clear through the stack of resistors 460. At the bottom end of the shuttle electrode is an optional end 466 of the commutating shuttle 465 which may function as an electrical stress control device with a similar function to 312 in FIGS. 8 and 9, but which may also have additional functionality as described below, by providing a gripping surface to hold back the rod 465 in the on (closed circuit) state. In the closed circuit state, electrical connection to Side A is made by low resistance stator electrode 490 which can be a high conductivity metal electrode or a liquid metal electrode that mates with the end of commutating shuttle 465. There is a parallel path from Side A to the bottom of the stack of resistors 485. Connection from Side B to the commutating shuttle 465 can be made through electrical slip ring 470, or by other means as described below. The upper end of the commutating shuttle 475 is a feature for connecting to a force 480 that pulls the commutating shuttle out of the disc resistor stack 460 to open the circuit. Although FIG. 12 shows all the disc resistors as having the same outside diameter, that is not necessarily the case; in particular, because the first disc resistors inserted into the circuit absorb far more inductive energy than subsequent resistors. It is desirable that the lowest disc resistor in FIG. 12 (this is the first one inserted into the circuit) should have the greatest mass and therefore the largest outside diameter. It is important that the metal discs such as 451 cover the entire face of the resistors to which they are attached, so that the current can flow evenly through the entire volume of each disc resistor.

Although FIG. 12 shows a particular shape factor for the resistive discs such as 450 and the metal washers 451, the invention is not limited by that. In particular, the thickness of the layers can be reduced by orders of magnitude (more than a factor of 100) compared to that which is illustrated in FIG. 12. Metallic foils can be stacked with semiconductive plastics to form resistive stacks that are fundamentally similar to the stack shown in FIG. 12 (460), but with far more resistive layers. It is particularly noteworthy that the electrical resistance between next neighbor metal washers such as 451 depends on the area of contact, the thickness of the intervening disc such as 450, and the resistivity of the material making up the disc resistor. Much thinner semiconductive polymer film hollow discs may be substituted for 450 and the conductive layers 451 may comprise foil discs. Bonded laminates consisting of alternating layers of metal foils with semiconductive polymer films, with optionally varying outside radius of the foil/resistive film discs, are specifically envisioned as being embodiments of the design of FIG. 12. In this case, the semiconductive polymer layers will generally be at the same inner radius as the foils at the point where contact is made with the inner commutating electrode 465, 466.

The circuit breaker of FIG. 12 has several unique features. It uses the simplest possible commutating shuttle, a metal rod or tube. The maximum force 480 that can be applied to the rod or tube depends on the strength of the material, and the cross-sectional area of the rod or tube wall perpendicular to the applied force 480. If all the force on the commutating shuttle originates from acceleration, then the maximum acceleration that is possible for any given material is strictly a function of the strength/density ratio of the material forming the commutating shuttle, and the length of the commutating shuttle. If σ is the tensile yield strength of a material in pascals, D is its density in kg/m$^3$, and L is the commutating shuttle length in meters, then the maximum acceleration in meters/second$^2$ $A_{max}$ that can be applied to a commutating shuttle like 465 is given by:

$$A_{max}=\sigma/LD \tag{3}$$

Results from this equation appear in Table 2 for a 2 meter long column of metal pulled from one end as in FIG. 12; maximum feasible acceleration varies from less than 1000 m/s$^2$ for sodium to 114,000 m/s$^2$ for aluminum matrix alumina-fiber composite wire. Table 2 also shows the mass of various materials at 20° C. that are needed to create a 2 meter long 25 micro-ohm column of material; at this loss level the 2 meter long notional commutating shuttle would transmit 2000 amps with 100 watts of $I^2R$ waste heat production. (Waste heat scales linearly with conductor mass, one tenth as much mass conductor means ten times as much heat generation, for example.) The mass of metal required to create a 25 micro-ohm column of material varies from 3.7 kg of sodium up to 618 kg for the strongest alloy shown, titanium beta-C alloy (which enables maximum acceleration among the metals of Table 2). Table 2 also contains data on additional metals that are discussed in different parts of this document in reference to electrode surfaces or resistivity grading on the trailing edges of electrodes, for example.

The best overall solution for a commutating shuttle 465 as in FIG. 12 depends on the relative cost for conductive material versus mechanical structure (including springs and triggers and the structural supports that maintain 465 in a stressed state, or apply stress to it), and critically, on the needed acceleration. The structural cost scales with the mass of conductor that must be accelerated times the acceleration. Acceleration determines time to the critical first commutation, so there is a good reason to push towards high acceleration in order to minimize the time to first commutation, if and where that is important (it is more important to get to the first commutation very fast if the system inductance in a fault is low than if the system inductance in a fault is high). Simply pulling a conductive tube so fast that one comes to the engineering limit for maximum tensile strength of the material (see Table 2 "maximum acceleration" column) is the fastest theoretical way to accelerate a linear motion commutating shuttle.

TABLE 2

Data Related to Accelerating a Conductor as in FIG. 4 and FIG. 12

| Conductor | Density kg/m 3 | tensile yield strength (Pa) | maximum acceleration | resistivity ohm-m | kg to pass 2 kA | movement 4 ms (cm) | FIG. of Merit M | max force, pascals |
|---|---|---|---|---|---|---|---|---|
| sodium | 971 | 1.00E+06 | 5.15E+02 | 4.76E−08 | 3.7 | 0.41 | 0.047 | 1.905E+03 |
| calcium | 1550 | 1.11E+07 | 3.56E+03 | 3.36E−08 | 4.2 | 2.85 | 0.456 | 1.485E+04 |
| magnesium | 1738 | 2.00E+07 | 5.75E+03 | 4.39E−08 | 6.1 | 4.60 | 0.564 | 3.512E+04 |

TABLE 2-continued

Data Related to Accelerating a Conductor as in FIG. 4 and FIG. 12

| Conductor | Density kg/m^3 | tensile yield strength (Pa) | maximum acceleration | resistivity ohm-m | kg to pass 2 kA | movement 4 ms (cm) | FIG. of Merit M | max force, pascals |
|---|---|---|---|---|---|---|---|---|
| Magnesium AM60A,B | 1800 | 1.30E+08 | 3.61E+04 | 1.20E−07 | 17 | 28.89 | 1.294 | 6.240E+05 |
| Magnesium AZ91 C,E T6 temper | 1800 | 1.45E+08 | 4.03E+04 | 1.51E−07 | 22 | 32.22 | 1.147 | 8.758E+05 |
| aluminum | 2700 | 5.01E+07 | 9.28E+03 | 2.82E−08 | 6.1 | 7.42 | 1.415 | 5.651E+04 |
| 6061 aluminium alloy, T6 temper | 2700 | 2.21E+08 | 4.09E+04 | 3.99E−08 | 8.6 | 32.74 | 4.411 | 3.527E+05 |
| Aluminum matrix alumina-fiber wire (3M ACCR) | 3294 | 7.50E+08 | 1.14E+05 | 7.62E−08 | 20.1 | 91.07 | 6.424 | 2.286E+06 |
| AlSiC-9 (CPS Technologies) | 3000 | 4.88E+08 | 8.13E+04 | 2.07E−07 | 49.7 | 65.07 | 1.690 | 4.041E+06 |
| copper (annealed) | 8960 | 7.00E+07 | 3.91E+03 | 1.68E−08 | 12.0 | 3.13 | 1.000 | 4.704E+04 |
| copper (cold worked) | 8960 | 2.20E+08 | 1.23E+04 | 4.20E−08 | 30.1 | 9.82 | 1.257 | 3.696E+05 |
| titanium elemental | 4506 | 3.20E+08 | 3.55E+04 | 4.20E−07 | 151 | 28.38 | 0.363 | 5.371E+06 |
| titanium beta-C alloy | 4830 | 1.03E+09 | 1.07E+05 | 1.60E−06 | 618 | 85.41 | 0.287 | 6.602E+07 |
| Tantalum | 16600 | 2.10E+08 | 6.32E+03 | 1.35E−07 | 179 | 5.06 | 0.201 | 1.134E+06 |
| Invar 36 | 8050 | 2.07E+08 | 1.29E+04 | 8.23E−07 | 530 | 10.28 | 0.067 | 6.810E+06 |
| Stainless Steel 17-PH-900 alloy | 7800 | 1.00E+09 | 6.41E+04 | 7.70E−07 | 480 | 51.28 | 0.358 | 3.080E+07 |
| Nichome (20% chromium) | 8400 | 3.54E+08 | 2.10E+04 | 1.30E−06 | 874 | 16.84 | 0.070 | 1.839E+07 |
| molybdenum | 10240 | 4.80E+08 | 2.34E+04 | 1.44E−06 | 1,180 | 18.75 | 0.070 | 2.765E+07 |
| Nickel/Chromium (80/20 Nichrome) | 8400 | 3.45E+08 | 2.05E+04 | 1.25E−06 | 840 | 16.42 | 0.071 | 1.724E+07 |
| Alnico Grade 8 (cast, fully dense) | 7300 | 6.90E+07 | 4.73E+03 | 4.70E−03 | 730 | 3.78 | 0.000 | 3.450E+06 |

The fastest actuation commutating circuit breaker of FIG. 12 using a material from Table 2 would be based on the highest strength/density ratio material, aluminum matrix alumina-fiber wire. This cermet wire is the mechanical strength element (replacing steel in the more standard ASCR aluminum steel core reinforced wire) in 3M™ Aluminum Conductor Composite Reinforced (3M ACCR) wire, which is commercially available from 3M corporation. Using only the list of materials shown in Table 2, a desirable combination of fast actuation combined with a reasonably low total mass to accelerate can also be obtained by making commutating shuttle 465 from a high strength titanium alloy shell with sodium inside. Among the single component potential material solutions for commutating shuttle 465, pure aluminum and pure magnesium have essentially equal mass to meet the 25 micro-ohm resistance target, but pure aluminum is stronger and so is a better solution for commutating shuttle 465. The penultimate column in Table 2 is a dimensionless figure of merit M $$M=\{(\text{strength})/[\text{density } X \text{ resistivity}]\}/\{(\text{strength})/[\text{density } X \text{ resistivity}] \text{ for annealed copper}\}$$

This figure of merit M is indexed to a reference value for annealed copper of 1.00; of the single component materials (not composites or fabricated structures) shown in Table 2, cold worked copper has a modestly improved figure of merit M (1.257) compared to copper, and all the forms of magnesium and aluminum examined also have slightly higher M value than annealed copper, ranging from 1.147 to 4.411 for high strength aluminum alloy 6061-T6. The highest figure of merit M in Table 2 (43.4) is for a cermet wire, composed of alumina glass fibers in a matrix of pure aluminum. Similar wires that are comprised of carbon fiber reinforced aluminum have also been reported, but are much more difficult to prepare, and are not (as far as I know) commercially available at present. Such a cermet wire can serve as both conductor and actuator of the motion of the commutating shuttle 465 in FIG. 12.

Because the modulus of the cermet wire (core wire of 3M ACCR) is so high (4550 MPa), stretching it just a few percent can store a large amount of elastic energy (comparable to a very stiff spring) that could supply force 480 while obviating the need for slip ring 470. This design could be used for a very fast actuating design capable to very high voltage. In the most extreme version, it is possible to stress a cermet ACCR wire up to close to its breaking strength (1400 MPa), with the wire strung through a resistive stack such as that shown in FIG. 12, then release the wire below the stack of resistors to open the circuit. This design, in which a high strength fiber reinforced wire 465 extends through a stack of resistors 460, and is restrained below the stack, in a zone 466 that is strongly attached to the stressed wire 465 enables the fastest possible actuation of a linear motion commutating circuit breaker. There are several known options to rapidly release such a highly stressed fiber-reinforced wire version of 465:

1. The feature 466 can be a stiff, strong rod that is held in place by a ring of piezoelectric thrusters that hold 466 in place via a normal force that can be released within 20 microseconds (the needed normal force can be reduced if part of the restraint of 466 can be due to correlated magnetic domains on the surface of 466 that match up with similar domains that are imprinted on the surface of sleeve 490, as will be discussed later);
2. The wire 465 or a wire end 466 can be cut with high explosives;
3. Fracture of the wire per se or a wire end 466 can be initiated with pulsed lasers;
4. The bottom of the commutating shuttle 465-466 can be potted into a soft metal like tin or a solder alloy that is much weaker than the materials used for said commutating shuttle in such a way that the on-state electrical connection to Side A is through the solidified solder layer, and the solidified solder layer is able to hold most or all of the mechanical force 480 pulling on the commutating shuttle in the on-state; in this case the bond between the solidified solder layer is broken when the force 480 is augmented by a suddenly applied additional force adequate to cause rupture of the bond between the solidified solder layer and the commutating shuttle 465-466.

This type of circuit breaker would be resettable without replacing components only for option 1. The last three methods would still be useful as a form of fast fuse for HVDC circuits that only blow rarely; they too can be reset, however one part (the fuse) needs to be replaced each time (or, in method #4, the solder pool needs to be re-melted and the end of the commutating shuttle 465-466 needs to re-anchored into the solder). A commutating circuit breaker of FIG. 12 can be reset if piezoelectric grips are used to hold the bottom end of the commutating shuttle 465, through the abutting rod-shaped gripping surface provided by feature 466 in FIG. 12.

The design of FIG. 12 minimizes the mass of non-essential parts of a commutating shuttle, by eliminating most of the insulation attached to the commutating shuttle and minimizing the mass of the trailing edge electric field control technology described elsewhere in this disclosure. Only the conductor is absolutely required for the breaker of FIG. 12; the optional graded resistivity trailing edge component 466 is not a requirement, though it is expected to reduce arcing inside the core of the resistor stack during operation, and so is a desirable feature. This design can also be deployed with a high vacuum, or with an arc-quenching gas mixture containing sulfur hexafluoride surrounding the commutating shuttle 465 within and around the resistor stack 460.

A major consideration in accelerating and decelerating the shuttle of a commutating circuit breaker is the mechanical integrity of the shuttle under a given acceleration. The setups shown in FIGS. 1, 4, and 12 accelerate the commutating shuttle linearly strictly with a pulling force; in such a method of acceleration of the shuttle, there is no tendency for the shuttle to buckle, regardless of the slenderness ratio of the shuttle (length/diameter for a circular cylindrical commutating shuttle). Note though, that during deceleration the long, slender shuttles of FIGS. 1, 4, and 12 would have a high tendency to buckle if braking force is applied at the front, which would limit the maximum deceleration to a lower value than the maximum acceleration. Buckling of a long slender commutating shuttle such as 465 in FIG. 12 can be prevented by surrounding the commutating shuttle with a strong stiff stator; however making the stator perform a mechanical function in addition to its primary electrical function (greatly reducing the volume where arcing can occur) will make the entire device more expensive. This is one major advantage of a rotary motion commutating circuit breaker such as that of FIG. 6 versus a design in which the shuttle moves linearly. Insofar as long slender commutating shuttles have distinct advantages in terms of cost at very high power levels (FIG. 12), it is useful to discuss options for braking a linear motion shuttle from the rear.

The feature 466 at the end of the conductive rod 465 may comprise permanent magnets, as indicated for feature 119 in FIG. 1, which may both restrain the rod 465 from moving in the on-state and which can also provide a braking force (generated by inducing a current in metal, a well known means of braking) after the commutating circuit breaker has completed its motion through the stack of resistors. Other types of mechanical constraints, including a non-conductive rope attached to the end of the commutating shuttle, for example at the position 466 in FIG. 12, and attached at the other end to a mechanical brake that can arrest the forward motion of the commutating shuttle after the circuit has been opened, or friction brakes that only engage with feature 466 at the end of travel, are also viable options to brake from the rear.

Figure 13:
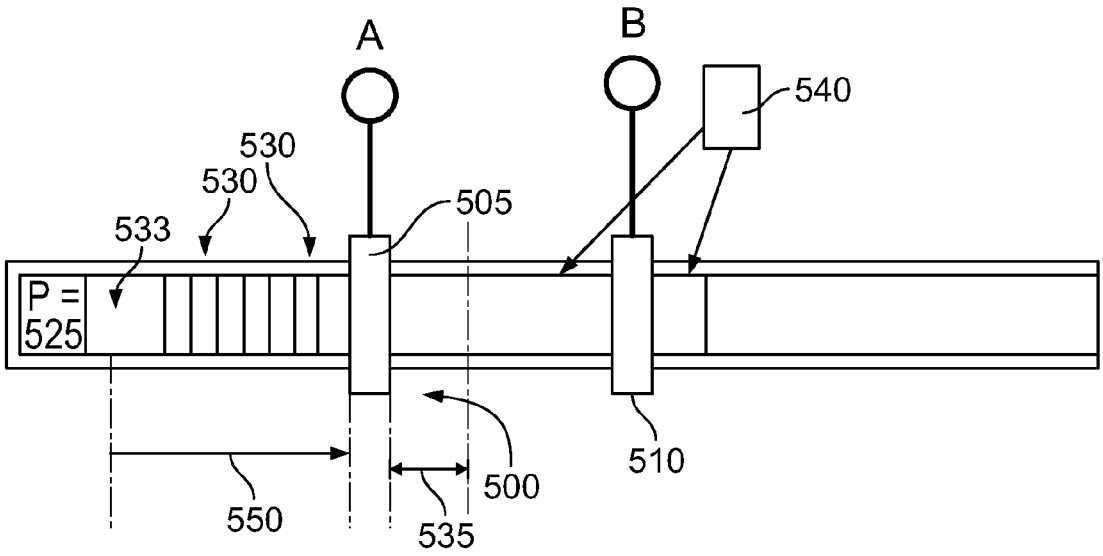
FIG. 13: Variable resistance shuttle with elastomer sleeve for voltage stress control.
Figure 14:
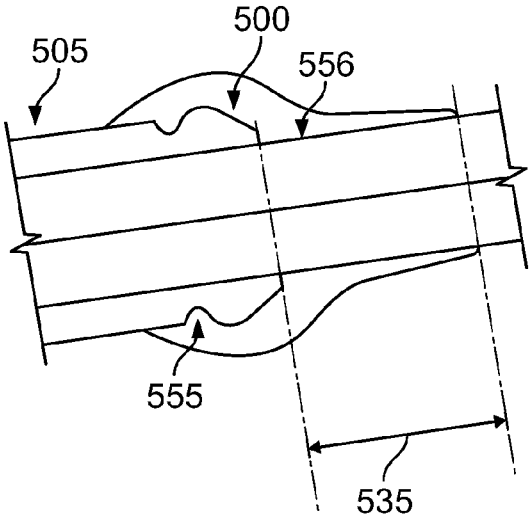
FIG. 14: Elastomer sleeve for voltage stress control following stator electrode.

FIG. 13 shows a variable resistance shuttle design of the commutating circuit breaker in the on-state, in which a highly conductive material 540 bridges between the two stator electrodes 505 and 510. There are two significant changes from the similar design of FIG. 1: first, a continuously variable resistance shuttle core 530 is used rather than the step-graded core 110 of FIG. 1. FIG. 1 illustrates the case of a moving resistive core 110 with well-defined boundaries between materials with different resistivity (111, 112, 113, 117), while FIG. 13 shows the case of a variable resistance core 530 that comprises a continuously graded resistivity from its left side, where it abuts against insulator 533 to its right side where it abuts against conductor 540. One way to create such a continuously graded resistivity is with sintered powders of changing composition to create a cermet that has resistivity increase smoothly from right to left, with no sudden changes in resistivity. Cermet resistors with stratified resistivity ranging from low to high resistivity can be prepared by known means (see for example, "Functionally Graded Cermets," by L. Jaworska et al, Journal of Achievements in Materials and Manufacturing Engineering; Volume 17, July-August 2006). Substituting a continuously graded resistor for step changes in resistance eliminates switching transients, so this is a desirable implementation of the invention that is feasible either with resistors on the shuttle (as in FIG. 13), or stationary resistors. Second, a new feature is shown in FIGS. 13 and 14, the stator electrode trailing edge elastomeric sleeve 500, which is functionally similar to the trailing edge feature 153 shown in FIG. 4. Said trailing edge elastomeric sleeve 500 overlaps with electrode 505, and occupies region 535 to the right of electrode 505. FIG. 14 shows a close-up view of stator electrode trailing edge elastomeric sleeve 500, which is attached to stator electrode 505 as shown in FIG. 14. The sleeve 500 inhibits arcing and makes it possible to operate the commutating circuit breaker of FIG. 13 in open air at a higher voltage differential between stator electrode 505 and downstream stator electrode 510 than would be possible in the absence of sleeve 500. By the time the variable resistance material 530 is exposed to the air upon exiting elastomeric sleeve 500, the voltage gradient at that point is greatly reduced compared to what the voltage gradient is upon exiting electrode 505. The maximum voltage gradient can be higher under the elastomer sleeve 500 without causing electrical breakdown compared to the voltage gradient that could be sustained without breakdown at an air interface at the trailing edge of 505 if the variable resistance portion of the commutating shuttle 530 exits the end of the metallic stator electrode 505 into air. The downstream stator electrode 510 does not need a sleeve like 500, because the current only flows between Side A and Side B. The total movement of the shuttle core 550 is far enough so that the highly insulative portion of the commutating shuttle 533 fills a zone that extends from left to the right of stator electrode 505, to somewhere under elastomer sleeve 500. FIG. 13 also provides an example of actuation of motion of the shuttle with gas pressure 525.

FIG. 14 shows how the sleeve 500 fits around the circular cross-section of the tube-shaped stator electrode 505, and has a lip feature 555 to attach the elastomer sleeve 500 to the trailing edge of said stator electrode. The shape of 500 as molded will be substantially different than how it looks in the deformed state shown in FIG. 14. As will be familiar to one skilled in the art of design of rubber boots for mechanical devices (steering boots and the like), it is possible to work backwards from the final deformed shape of the elastomer sleeve (FIG. 14) to calculate the dimensions of the mold to make the rubber sleeve. An example of an appropriate design criterion would be to set the extension ratio $\lambda$ (which is the ratio of diameter in the deformed state to diameter as molded) at the interface between the elastomer sleeve and the shuttle at location 556 to about 1.1 to 1.25. It is desirable that the inner surface of elastomeric sleeve 500 be coated by PTFE, and that the sleeve is made of a strong elastomer with a low rate of stress relaxation. In the case of sleeve 500, stress must be maintained for the life of the elastomer part, so slow relaxing elastomer types, such as peroxide cured elastomers with carbon-carbon crosslinks are preferred. It is also desirable that sleeve 500 has electrostatic dissipative resistivity between about $10^5$ to $10^9$ ohm-meter. In addition, the sleeve of FIG. 14 will have to last many years in a potentially high ozone environment around electrical equipment, in an extended state. Therefore this sleeve also must be highly ozone resistant; for these reasons, peroxide crosslinked HNBR (hydrogenated nitrile-butadiene elastomer), EPR (ethylene-propylene rubber), and EPDM (ethylene-propylene-diene monomer) are particularly appropriate elastomers for sleeve 500.

The method of using a flexible insulating material pressed into close contact with a moving electrode just behind a brush electrode to suppress sparks in a commutator was first described by Nikola Tesla in U.S. Pat. No. 334,823, using a mica board just behind the brushes of a DC motor. I have invented an improved version of this concept having a tight-fitting elastomeric insulating layer just behind the electrical stator electrode 505 to inhibit arcing as the most conductive part of the variable resistance shuttle moves away from the stator electrode. By creating contact pressure, elastomeric sleeve 500 increases the intimacy of contact between the sleeve and the outer surface of the variable resistance shuttle. This mechanism can be applied to commutating shuttles as well, as in the trailing edge feature 153 shown in FIG. 4 and a semiconductive elastomer plug such as one version of 312 in FIGS. 8 and 9.

Figure 15:
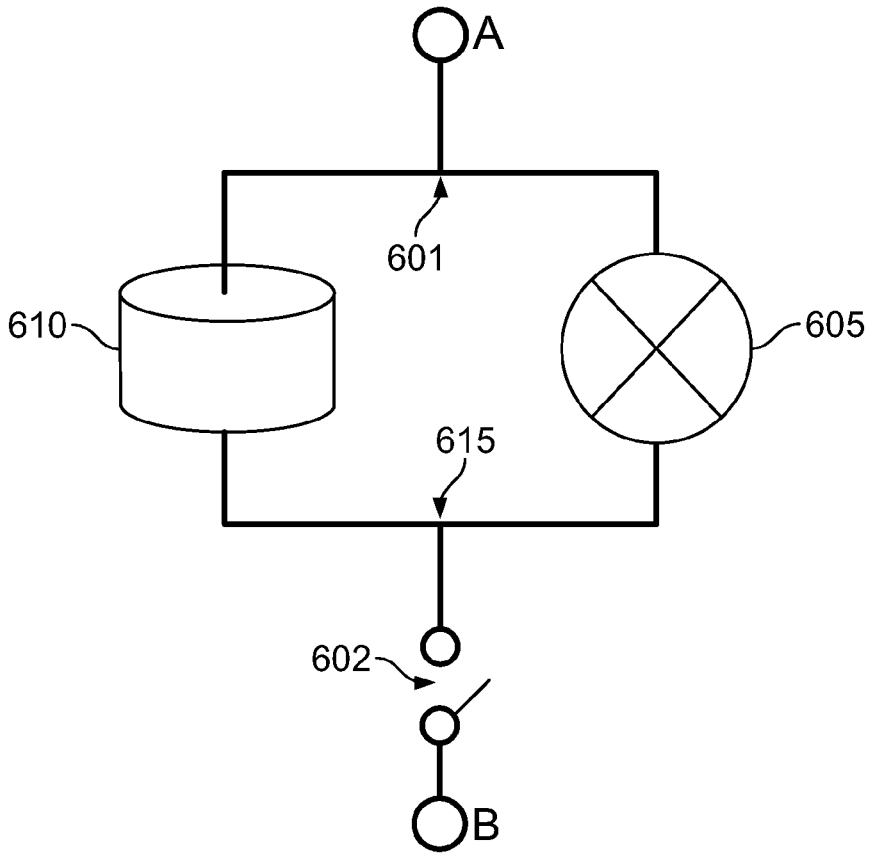
FIG. 15: Hybrid commutating circuit breaker with parallel fast switch.

Commutating circuit breakers can also be deployed in a hybrid circuit breaker design such as FIG. 15, in which the critical first commutation is done by a very fast switch 605; this fast commutation switch is connected to a common buss bar 601 that connects both fast switch 605 and commutating circuit breaker 610 to Side A. Similarly, Buss Bar 615 connects both 605 and 610 to Side B through a no-load disconnection switch 602, which is normally closed (but which is shown as open in FIG. 15). In the on-state, switches 602, 605 and commutating circuit breaker 610 are all closed, and current flows through both connections. When fast switch 605 opens, the full current is rapidly commutated to the commutating circuit breaker, which then finishes opening the circuit over a period of ~5-10 ms. After the current is quenched, no-load switch 602 is also opened, which facilitates re-setting of both fast switch 605 and the commutating circuit breaker. The hybrid switch of FIG. 15 still has the soft circuit opening capability of a stand-alone commutating circuit breaker, but can get to the first resistance insertion much faster than a purely electromechanical commutating circuit breaker. The hybrid circuit breaker design of FIG. 15 can relax the requirement of very low on-state resistance through the commutating circuit breaker 610, since in the on-state, most of the current flows through the parallel path through the fast switch 605. For example, when a rotary multistage commutating circuit breaker of FIG. 6 and Table 1 is used in a parallel circuit with a fast commutation switch as in FIG. 15, the resistor insertion sequence of Table 1 is modified so that the on-state resistance of the commutating circuit breaker (prior to actuation) is equal to the first inserted resistance of Table 1 (50 ohms in this example). In this case there is no need to use liquid metal or other very low resistance electrodes in the commutating circuit breaker, which significantly simplifies the design, because the fast switch carries most of the on-state current.

The fast commutating switch shown in FIG. 15 can be:

- a type II (ceramic) superconducting shunt that is designed so that resistance goes very high when current exceeds a pre-determined limit. [Such ceramic superconductors are used in superconductive fault current limiters (SFCLs)]; this is the fastest and preferred option where control of short circuit over-current is the primary risk, and is intrinsically failsafe even for low inductance short circuits);
- an electron tube including the type of cold cathode vacuum tube mentioned in U.S. Pat. No. 7,916,507 (as in Example 1);
- a mercury arc valve;
- a semiconductor switch such as a GTO (gate turn off thyristor), IGBT (insulated-gate bipolar transistor), or IGCT (integrated-gate commutated thyristor);
- a fast mechanical switch of a different type than the commutating circuit breakers of this invention, such as that of U.S. Pat. No. 6,501,635;
- a MEMS (Micro-Electro-Mechanical Systems) switch array;
- a vacuum circuit breaker (see for example U.S. Pat. No. 7,239,490);

In the case of a hybrid circuit breaker as in FIG. 15, based on commutating circuit breaker 610 having the design of FIG. 6 and the set of resistance insertions of Table 1, the initial resistance of the commutating circuit breaker (prior to any movement of the rotor) would be 50 ohms, which could be spread out among the six commutation zones equally by making the resistance of each of the six lowest resistance electrical links (226, 236, 246, 256, 266, and 276 in FIG. 6) 8.33 ohms each, for example. The 50 ohms initial resistance could also be divided between five of the six commutation zones; the remaining commutation zone with low resistance will then be the zone where the second commutation occurs (this second commutation is the first commutation caused by movement of rotary commutating shuttle 280 of FIG. 6); according to Table 2, this second inserted resistance would be 19.4 ohms (inserted in series with the previous 50 ohms, so that total resistance goes to 69.4 ohms). From this point forward, all subsequent commutations and resistance insertions would be handled by the commutating circuit breaker 610.

The fast switch 605 can in some cases commutate power to the commutating circuit breaker in less than one microsecond, and then the commutating circuit breaker shuttle begins to move and may take 5-50 ms to fully open the circuit, but is instantaneously able to clamp the current inrush due to a dead short to protect the connected components, such as a VSC (voltage source converter), or a transformer for example. This fast commutation feature is particularly important in a multi-terminal HVDC grid. In this application, superconducting fault current limiters and cold cathode vacuum tubes are especially desirable for fast switch 605.

Figure 16:
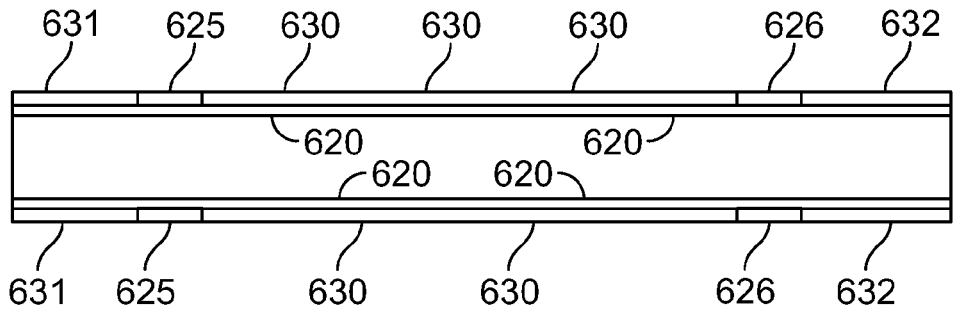
FIG. 16: Pipe-shaped commutating shuttle.

FIG. 16 illustrates a simple method to create a linear motion commutating shuttle that is functionally similar to a single stage 157 of the two stages of the linear actuated commutating circuit breaker shown in FIG. 5. The design of FIG. 16 is based on a piece of metallic or metal-matrix cermet pipe 620, onto which conductive sleeves 625, 626, and insulating sleeves 630, 631, and 632 are fitted and/or attached. Said conductive sleeves 625 and 626 correspond to shuttle electrodes 211 and 212 in FIG. 5, and are metallic sliding electrodes. Sleeves 630, 631, and 632 are electrically insulating sleeves that correspond to the insulating material 159 surrounding conductor 210 in FIG. 5. Said sliding metallic electrodes can be mechanically and electrically bonded to the pipe-shaped core 620 by a friction fit based on assembling accurately machined parts at different temperatures (shrink fit); by using solder or brazing; or by plasma or flame sprayed metal applied directly to the pipe-shaped core 620. The electrically insulating sleeves can be glazed onto the metallic substrate 620 as a glass; a preformed insulating sleeve that is accurately machined can be placed over the pipe-shaped core 620 by a friction fit based on assembling accurately sized parts at different temperatures (shrink fit); by plasma or flame sprayed ceramic insulation applied directly to the pipe-shaped core 620; or, an insulating, adherent polymer coating can be applied to the metallic substrate 620 to insulate it everywhere except at the sliding electrodes 625 and 626. Alternatively, the commutating shuttle of FIG. 16 can be prepared by lathe cutting a conductive pipe so as to leave raised ridges behind to form the two shuttle electrodes 625 and 626, followed by coating the remaining portion of the pipe with an insulator, such as epoxy or polyurethane resin, or by insert molding using a thermoplastic. After forming the conductive and insulating sleeves, it is important to smooth the surface of the coated pipe so that the outer radius of the insulating sections 630, 631, and 632 is equal to the radius of the two electrodes 625 and 626, and there are no sharp edges at the boundaries between conductive sleeves and insulating sleeves.

Figure 17:
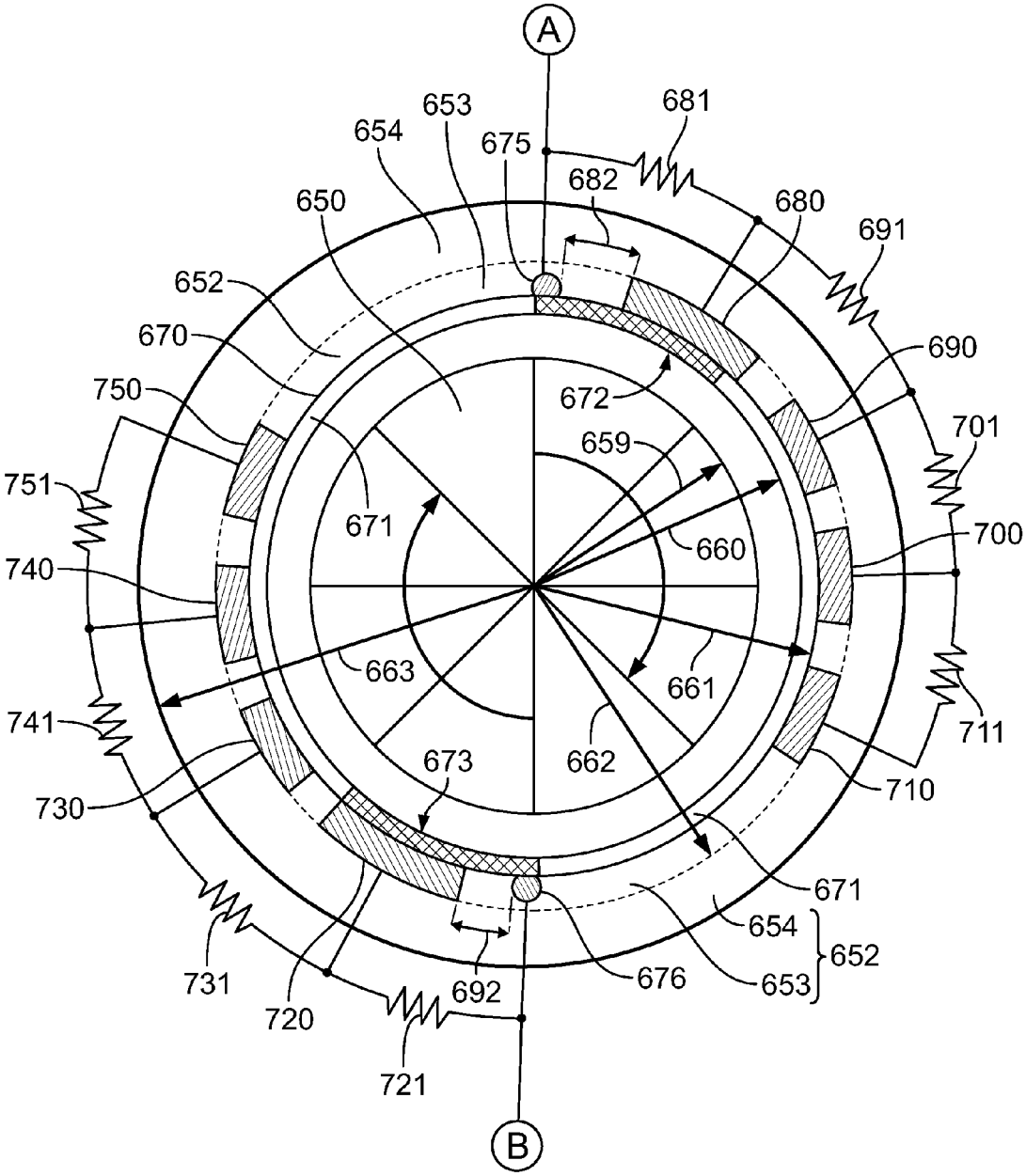
FIG. 17: Rotary commutating circuit breaker, with two commutation zones and external resistors.

FIG. 17 depicts a single stage, two zone rotary commutating circuit breaker with external resistors that is well suited to high current, medium voltage DC (MVDC) applications. FIG. 17 is similar to FIG. 6 in that it depicts an end-on view of a circular rotary commutating shuttle and the mating parts of the stator, but it is designed to have a smaller and simpler rotating commutating shuttle, to reduce cost and to push up the speed of actuation. The compact circular cross-section of the outermost surface 670 of the commutating rotor that lies at radius 661 (comprising major components 650, 671, 672, 673) of FIG. 17 is smooth on its outer surface, which enables it to fit snugly inside a stator insulation assembly 652 which holds all the stator electrodes (675, 676, 680, 690, 700, 710, 720, 730, 740, 750). The stator electrodes 680, 690, 700, and 710 connect to external resistors 681, 691, 701, and 711; similarly stator electrodes 720, 730, 740, and 750 connect to external resistors 721, 731, 741, and 751 as shown. The two on-state stator electrodes 675 and 676 are liquid metal electrodes that connect via low resistance lead wires to Side A and Side B of the commutating circuit breaker. The liquid metal electrodes 675 and 676 may either be liquid or solid at the moment the movement of the circuit breaker is triggered. To generalize, I use the term solder to mean any liquid metal that forms the liquid metal electrodes, whether liquid or solidified. In the case the solder has solidified, the resultant purely metallic solder phase interpenetrates strong porous metal structures in the on-state stator electrodes 675 and 676, and wets out the neighboring rotor electrodes 672 and 673, so that solder bridges between them. If the solder has solidified so that it now forms a bond (both mechanical and electrical) between the two electrodes, the circuit breaker can still work if the solder bond is weak enough to be sheared in two as soon as the operating torque is applied to the rotor.

The entire stator insulation assembly 652, which lies between radius 661 and radius 663 serves as the mounting for the stator electrodes, and the inner surfaces of the stator electrodes have a smooth inner surface in contact with the rotary commutating shuttle (650, 671, 672, 673). The entire stator surface other than the stator electrodes is composed of a highly insulating material, such as a polymer or polymer composite. A lubricating interfacial film (not shown in FIG. 17) desirably resides between the rotor outer surface 670 and the stator 652. The stator electrodes are desirably held against the shuttle with a uniform pressure, which can originate from an elastic force, a pressure on the outside of a flexible stator, or both.

In the case, shown in FIG. 17, that said stator electrodes are bonded to, and embedded in, a polymer sleeve 652, said polymer sleeve can be rigid or elastomeric. This paragraph addresses the case in which the polymer sleeve is rigid (Young's modulus >1.0 GPa); in this case it is important to match both stiffness and thermal expansivity between the stiff electrically insulating polymer sleeve 652 surrounding the stator electrodes, and the embedded stator electrodes (680, 690, 700, 710, 720, 730, 740, 750). It is especially desirable that polymer sleeve 652 match the mechanical and thermal properties of the stator electrodes in the case where 652 is a stiff polymer. A stiff polymer sleeve 652 can desirably be composed of a liquid crystal polymer (LCP), and/or polymeric formulations and composites based on an LCP matrix phase, because the low thermal expansivity of LCP polymers allows LCP and LCP composites to nearly match the thermal expansivity of a range of metals and metal-matrix composites. LCP polymers are also stiff, and can be formulated to nearly match the low strain mechanical properties of the embedded metallic-matrix electrodes (to get the best mechanical and thermal expansivity match, both the electrodes and the polymer-matrix based stator shell 652 can be formulated to match each other). In the case of a stiff polymeric sleeve 652 that matches the thermal expansivity and stiffness of the embedded stator electrodes, it is not desirable to have 652 be composed of distinct separate layers 653 and 654 as is depicted as an option in FIG. 17; rather in this case 653 and 654 represent a single continuous region though this region may contain small particles and/or fibers, and multiple phases from a thermodynamic perspective, and may be split into separate parts for ease of assembly.

In the case that a rubber elastic force is applied to hold the stator electrodes in against the shuttle body 650, this force can either originate in a tight fitting, extended elastomer band around the electrodes, but not bonded to the electrodes 654, or the stator electrodes can actually be bonded to, and embedded in, an elastomer sleeve 652. In the case that a rubber elastic force is applied to hold the stator electrodes in against the shuttle body by a tight fitting, extended elastomer band around the electrodes 654, then the portion of the elastomer sleeve 653 that lies inside 654 and between the electrodes could desirably be a different elastomer formulation optimized for low friction, low elastic modulus, or other specific properties.

In the case that the insulating polymer 652 surrounding the stator electrodes includes an elastomeric sleeve 654, which pushes the electrodes against the shuttle with a nearly uniform pressure, said uniform pressure could originate either from elastic retractile forces within the outer portion of the flexible stator 654 of FIG. 17 (the part of 652 that lies between radius 662 and 663), or a fluid pressure acting on the outside of 654 (discussed later), or both an elastic retractile force within 654 and fluid pressure from outside layer 654. The stator electrodes can only move inwards if the insulating material 653 between the stator electrodes is compliant, preferably elastomeric, and is compressed in the circumferential direction. This will tend to cause any elastomeric materials 653 that lie between the rigid embedded electrodes to bulge out in both directions, both inward towards the center of rotation and outward beyond the outer radius occupied by the stator electrodes during this circumferential compression. One must account for the nearly constant volume of elastomers during such a compression so that the innermost elastomer surface portion of 653 ideally lies parallel to the surface of the rotor at the intended interfacial radius 662. A compressive force of the elastomeric inner radius of 653 against the surface of 650 can be tolerated as long as the inward bulge of 653 towards and possibly against the commutating rotor 650 does not lead to too high friction or to damage to component 653 during tripping of the commutating circuit breaker of FIG. 17.

The commutating rotor core 650 is desirably composed of metal or a metal-matrix composite, such as for example an aluminum- or magnesium-matrix SiC or BC composite shaft or some other low density, low thermal expansivity, high electrical conductivity material which is coated on its outer perimeter with an adherent electrically insulating shell 671, except that the insulating shell is interrupted in the two shuttle electrode regions 672, 673 where the metallic shaft 650 (which may also be a hollow shaft in general) is coated with a thin layer of conductive metal or metal-matrix composite electrode material that is the same thickness as the insulating layer 671, but which is conductive and has good properties as a sliding electrode. Both the insulation layer 671 and the two shuttle electrodes are adhered to the outer surface of the metallic shaft 650, and lie between the outer radius of the shaft 660 and the outer radius of the commutating rotor 661. In the case that 650 comprises a hollow shaft, it must have a sufficiently thick wall so that it is stable in torsion; for example 659 could be the inner diameter of a hollow shaft comprising 650. Insulating layer 671 can be for example a ceramic such as plasma-sprayed alumina, aluminum nitride, quartz glass, or a flame sprayed polymer, glass, or ceramic. Insulating layer 671 can also be applied as a powder coating, by adhering an insulating sleeve onto the rotor core 650, or by rotational molding for example. It is most economical to coat the entire shaft with the insulating layer 671, and then to abrade or cut through 671 to expose the substrate metal shaft 650 where the rotor electrodes 672 and 673 are subsequently installed. Said rotor electrodes could desirably be installed by cold spraying silver onto these parts of the shaft, or by electroplating nickel, chromium, or some other metallic surface for example. In the case where a uniform stiff insulating layer 671 is first attached onto a shaft or tube 650, then removed by cutting, ablation, or abrasion in the regions where the rotor electrodes 672 and 673 are subsequently installed, there can be a significant mechanical stress at the interface between shaft 650 and adherent insulating layer 671 at the exposed edge. This stress must be controlled by the process in such a way that it does not cause a delamination fracture or damage to the interface between 650 and 671 during processing or after the electrodes 672, 673 are installed. Heating the interface between 650 and 671 at the line of contact between these two layers where that interface has been exposed due to cutting or abrading through 671 where the electrodes are to be installed is especially likely to initiate a crack at this interface if there is a mismatch of thermal expansivity between the metallic core 650 and the polymeric, glassy, or ceramic insulating shell 671. Therefore use of flame spray or plasma spray methods to lay down electrodes requires that there be a rough matching of the stiffness and thermal expansivity of the two layers 650 and 671 in the region where local heating of this interface occurs due to impingement of the flame spray or plasma spray plume on the interface at each edge of each electrode 672, 673. Flame or plasma spraying to create the electrodes 672 and 673 is desirable because then one can readily create a region of graded resistivity on the trailing edges of the rotor electrodes 672, 673 by spraying a sequence of different plasma sprays, ranging from a good conductor to a semiconductor, or even all the way to a good insulator, as is desirable to prevent arcing upon separation from a shuttle electrode (this is discussed elsewhere in this document). After the electrodes 672, 673 are installed, the entire rotor is ground smooth to a very round cross-section, with smooth transitions between conductors (electrodes 672, 673) and the insulating sleeve 671 that lies between and around the electrodes.

The shuttle electrodes 672 and 673 are wide enough to make full connection to the first two stator electrodes in the on-state. The timing of the commutations can be set by varying the width of the two on-state electrodes 675, 676 and by adjusting the gaps such as 682 and 692 between on-state stator electrodes and the next-neighboring stator electrodes 682, 692. Alternatively, and this is the case shown in FIG. 17, the two on-state electrodes 675, 676 can be narrow liquid metal electrodes that have identical circumferential width, so that the very first commutation occurs simultaneously on the A side and the B side of commutating circuit breaker of FIG. 17, commutating the power initially through resistors 681 and 721 in series. After this critical first commutation, subsequent commutations would be syncopated on the A and B side of the stator, due to differential offsets in the angular positions of the electrodes (as illustrated by gap 682 not equaling gap 692 in FIG. 17).

Figure 18:
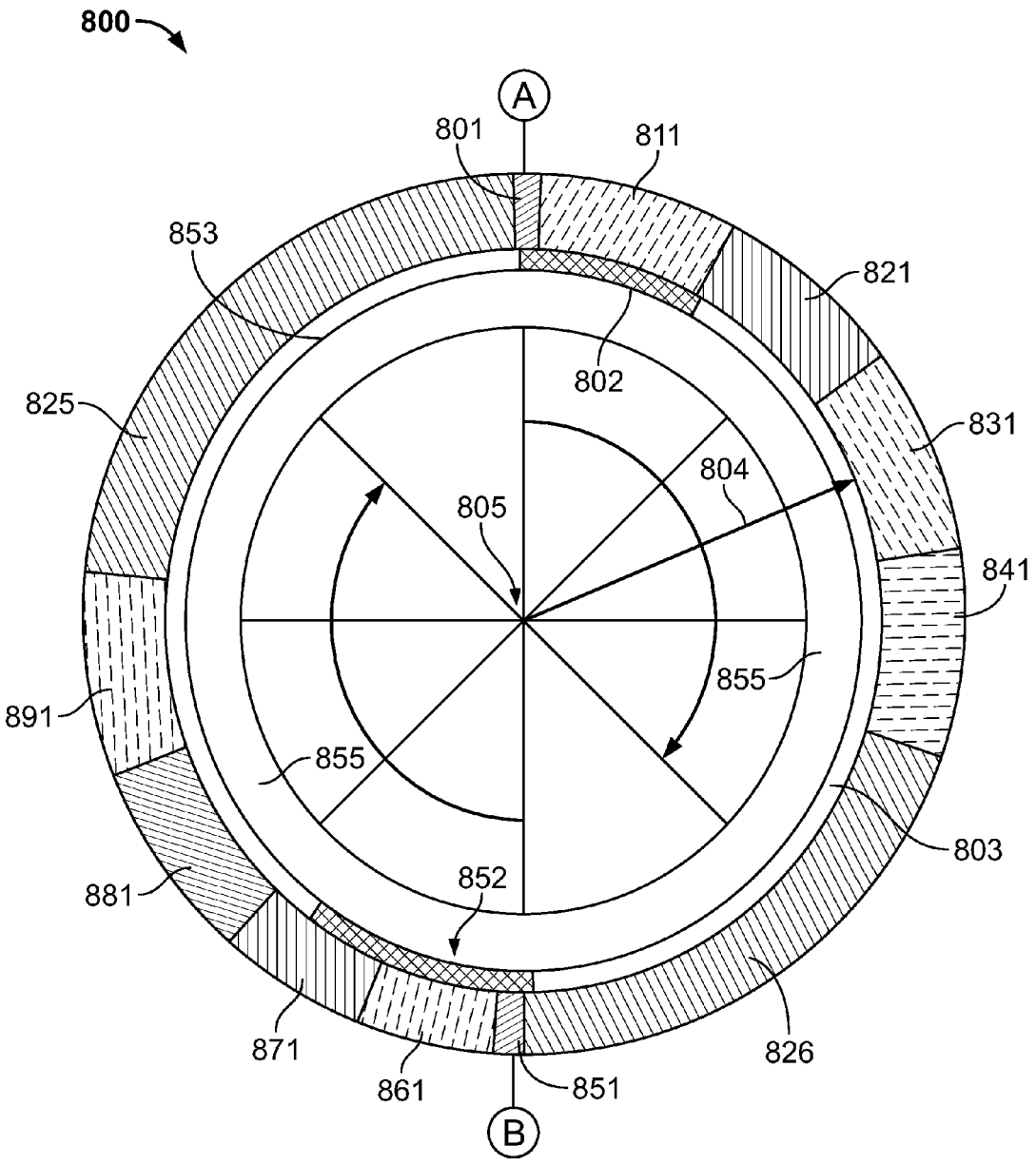
FIG. 18: Simplified rotary fast-acting commutating circuit breaker in which the stator electrodes and resistors make up wedge-shaped keystone sections of the stator wall.

FIG. 18 depicts an end-on view of a single stage, two zone rotary commutating circuit breaker 800 with resistors that are incorporated into the stator, but which is otherwise similar to the rotary commutating circuit breaker of FIG. 17. During operation, the commutating rotor (comprising 855, 803, 853, 802, and 852) rotates clockwise about its axis 805. In FIG. 18 hollow keystone-shaped stator electrode resistors (811, 821, 831, 841, 861, 871, 881, 891) act as both stator electrodes and resistors; these keystone-shaped stator electrode resistors actually form part of the inner walls of the stator and contact the commutating rotor (which is in this case a strong metallic hollow or solid shaft 855, selected to allow very high torque for maximum radial acceleration and very fast actuation). This design allows for individual resistive stator wall segments (811, 821, 831, 841, 861, 871, 881, 891) to be themselves constant resistivity throughout their entire volume (the simplest option), or individual stator electrodes might have a continuously graded resistivity within each stator electrode resistor, which eliminates sudden voltage increases due to discreet commutations through a series of different resistors, similar to the linear motion graded resistors of FIG. 13.

Resistance insertion occurs on both sides of the rotary commutating shuttle as the shuttle electrodes 802 and 852 turn clockwise out of contact with the liquid metal electrodes 801 and 851 (this is the first commutation, not synchronized on the A and B sides of the circuit breaker in this case, as rotor electrode 802 loses contact with on-state stator electrode 801 prior to rotor electrode 852 losing contact with on-state stator electrode 851). The liquid metal electrodes 801 and 851 are connected to Side A and Side B of the circuit breaker, and also electrically connected to the neighboring stator electrodes 811 and 861, which may be made of Nichrome alloy, cermet, quasicrystalline alloys, or amorphous carbon, for example. In a similar manner, stator electrode resistors 811 and 861 are also electrically connected to stator electrode resistors 821 and 871 and so on, up to the final stator electrode resistors 841 and 891. In each of these two series (Side A: 801 to 811 to 821 to 831 to 841; Side B: 851 to 861 to 871 to 881 to 891) the resistivity of the material forming each sequential stator electrode resistor may increase compared to the prior stator electrode resistor in the series, and may also have graded resistivity internally. After commutating through all the stator electrode resistors, there are two highly insulating portions of the stator (825, 826); the shuttle electrodes rotate under these highly insulating portion of the stator when the circuit is opened. In both FIG. 17 and FIG. 18, the total rotation of the commutating shuttle is 135 degrees during actuation of the circuit breaker from the on-state (closed) to the off state (open).

Although FIG. 18 shows all the stator electrode resistors as having the same outer diameter, the outer diameter of the various stator electrode resistors can vary according to the amount of energy each stator electrode resistor is expected to absorb during normal operation of the commutating circuit breaker; the first resistors to be switched into the circuit (811, 861) absorb far more energy than the last resistors (841, 891), and so should have higher mass. This can be accomplished by increasing the outer radius of 811 and 861. The outer radius of the intermediate stator electrode resistors (821, 831, 871, 881) would then be intermediate in terms of outer diameter between the diameters of the first resistors (811, 861) and the last resistors (841, 891). There are two ways to vary the resistance within a stator resistor as a function of angular rotation of the rotor electrodes 802 and 852: by varying resistivity or outside diameter of the stator resistors with angle of rotation.

As in FIG. 17, the outer surface of the rotor shaft 855 is coated with an insulating ceramic, glass, or polymer layer 803, 853 over most of its surface, but also is coated in two shuttle electrode regions 802 and 852 with suitable metals, as previously described. The outer wall of the commutating rotor extends out to radius 804, and is polished smooth so that there is at most only a very small unevenness in going from an insulating part of the wall (803, 853) to the neighboring conductive parts of the wall (802, 852). A tight clearance is maintained between the outer edges of the rotor and the keystone-shaped pieces forming the inner part of the stator (801, 811, 821, 831, 841, 826, 851, 861, 871, 881, 891, and 825), which occurs at radius 804; there may be a liquid or dry non-conductive lubricant at this interface. Said keystone-shaped pieces forming the inner part of the stator must be capable of passing the current between the electrodes in each commutation zone (for example 811,821, 831, 841 must be electrically connected at their interfaces) and so would either be glued together with a conductive adhesive or the interface could be bridged by a conductive liquid or elastomer in certain cases.

To get to a high voltage, large multistage commutating circuit breakers, which can be either large diameter rotors or long axial motion devices, are desirable. It is highly desirable to drive such large commutating shuttles from multiple areas on the surface of the commutating shuttle rather than by applying force at one or both ends of a long axial motion multi-stage breaker, or by applying torque to the shaft of a large diameter rotary breaker. For example, in a multistage rotary commutating breaker with multiple commutation zones along its outer surface (as in FIG. 6), designed for 800 kV the rotor will likely have to be more than a meter in diameter to allow adequate insulation between alternative electrical paths through the rotor. At that diameter, driving rapid rotation from a center shaft would require a great deal of torque, and structure to support that torque. Large diameter rotors are most effectively driven by many small springs or actuators all along the outer radius of the commutating shuttle that can distribute the needed force to accelerate the commutating shuttle over the surface of the commutating shuttle in such a way that the force needed to accelerate the commutating shuttle is delivered to the shuttle near to where it is needed to accelerate portions of the shuttle, as in FIG. 19.

Figure 19:
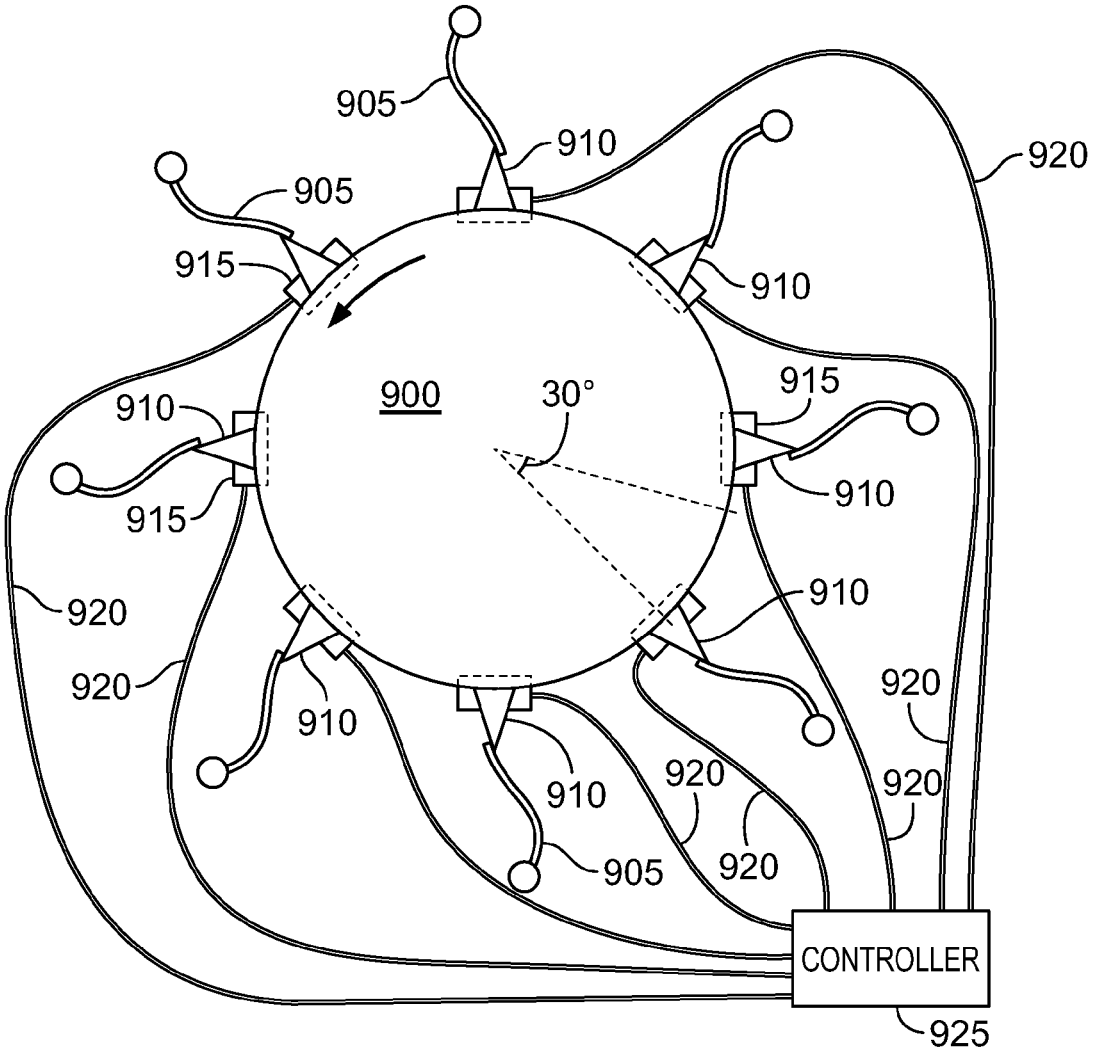
FIG. 19 shows the drive and control mechanism for a large diameter rotary commutating circuit breaker designed for high voltage, with multiple drive springs at the outer circumference.

FIG. 19 illustrates an actuation mechanism that is particularly well suited to drive a large diameter multistage rotary commutating circuit breaker similar to FIG. 6, or even a rotor two or more meters in diameter with ten or more commutation stages along the rim. Multiple flat or gently curved springs 905 are disposed around the outer radius of the commutating rotor 900. Each spring engages with the rotor via a matching feature 910 attached to the rotary commutating shuttle. The commutating rotor is held in place via quick release brakes 915 that restrain the rotor from moving until a signal from controller 925 traveling through control signal wires 920 releases the brakes. As discussed previously, the brakes are desirably based on piezoelectric actuators that apply a normal force against polished surfaces to resist movement by friction. When the controller 925 causes the piezoelectric actuators 915 to quickly change shape so as to relieve the normal force, the commutator rotates to open the circuit breaker.

Figure 20:
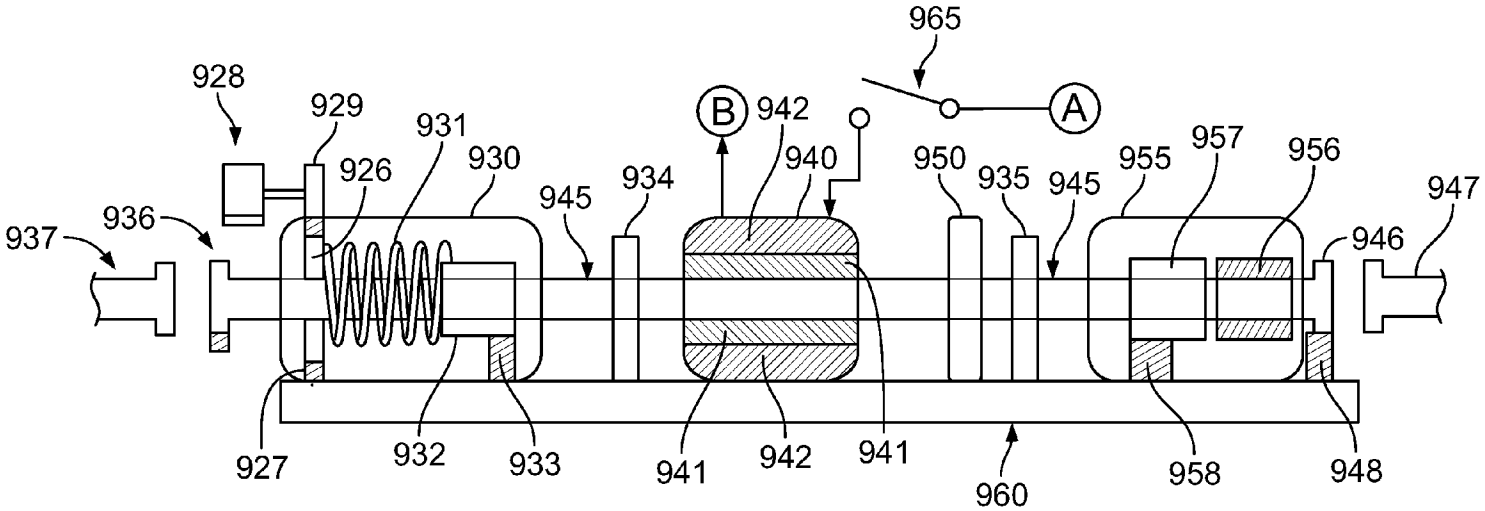
FIG. 20: Rotary commutating circuit breaker mounted on base plate, with torque driver, bearings, fast actuated release, and arresting brake.

FIG. 20 shows a general setup of a shaft-driven rotary commutating circuit breaker assembly. At the left, 930 is a torque drive that applies torque to the shaft 945, which drives the rotation of the rotary commutating circuit breaker 940 when the fast release brake 950 is released. Rotary commutating circuit breaker 940 can be of a variety of designs, such as FIG. 7, 18, or 19 for example; in FIG. 20, 941 is the rotating part and 942 is the stator part of 940. All components are mounted on a strong base plate 960 (which could also take the shape of a pipe or a truss that surrounds the commutating circuit breaker assembly). Torque source 930 can be a torsion drive spring 931 together with the fine adjustment spring winder 928 and 929 as shown as in FIG. 20, or in general the torque source 930 can also be a ring of flat springs acting on a drive wheel, as in FIG. 19, an electromagnetic, electromechanical or fluidic drive, or even a length of twisted shaft. The rotary commutating circuit breaker 940 is between two bearings 934, 935 which support the weight of the commutating rotor 941. The fast release brake 950 is on the opposite side of rotary commutating circuit breaker 940 from the torque drive 930, and holds back at least some of the torque from the torque drive 930 in the on-state of the circuit breaker, so that the torque that is applied to the shaft 945 by torque drive 930 is held in place at least in part by the fast release brake 950; as soon as the fast brake is released the shaft and the rotary circuit breaker rotate to an open position. In the on-state 950 applies an opposite torque on both the shaft 945 and the base plate 960 compared to the torque applied to shaft 945 and base plate 960 by drive 930. The shaft 945 extends beyond the fast release brake 950 to coupling spline 957 that links to an arresting brake 955 that can be in general a friction brake, a fluidic brake, or a spring that is cocked by the rotational momentum of the rotor, comprising commutating rotor 941 and shaft 945 (which rotate in unison). FIG. 20 shows the particular case in which arresting brake 955 is comprised of a torsion viscoelastic spring 956 combined with an anti-rebound feature 948. Arresting brake 955 is attached to the end of shaft 945 by a spline 957 and is so arranged that it does not encumber motion of the shaft until the shaft has turned through an angle A2; in most cases, this will occur after the opening of the circuit by the commutating circuit breaker is complete. After spline 957 engages the arresting brake 955 stops the forward rotation of the rotor (comprised of shaft 945 and commutating rotor 941). In the case that any type of spring is used as the arresting brake, it is important to capture and restrain the shaft near its maximum rotation to prevent rebound and reversal of the shaft rotation (which could reclose the circuit breaker); this is accomplished in FIG. 20 by a ratchet or gear 948 that engages with the shaft of the arresting torsion spring 956 (956 could also be a non-elastomeric spring in general). Since torsion spring 956 is connected to the end of shaft 945 by spline 957, winding of the torsion spring 956 does not begin until shaft 945 has turned to angle A2. The resting position of torsion spring 956 is determined by stop 958, which is shown in more detail in FIG. 22. In the resting state of torsion spring 956, the spring is twisted somewhat so that it does not cycle through zero strain (this improves fatigue life of any spring). In the case that torsional spring 956 is elastomeric, it is ideally a bonded elastomer annulus between the inner shaft 946 and an outer metal annulus (not shown in detail in FIG. 20), such as the Torsilastic® spring which was previously produced by BF Goodrich Aerospace. Using a torsional elastomeric spring as the arresting brake is a particularly gentle way to arrest the motion of the commutating rotor 941 without transmitting sharp vibrations to the circuit breaker base 960 or from there to the mounting structure that holds 960 in place. By using a torsional elastomeric spring as the arresting brake, a particularly quiet rotary commutating circuit breaker can be designed. In this case, after the rotor (941+945) is arrested by the ratchet or gear 948 a no-load electrical switch 965 is opened to de-energize the rotary commutating circuit breaker so that it can safely be reset.

The arresting brake 955 can also be a friction brake, similar to brakes used on an automobile or truck. In this case, there will be no rebound, and there will in this case be no need for the ratchet or gear 948 to prevent rebound.

The shaft 945 couples through spline 957 to the inner shaft 946 of the torsional elastomeric spring 956; 946 incorporates at its end a feature that mates with retractable drive system 947. Drive system 947 is used for re-setting the arresting brake to a desired initial conformation. In the particular case of FIG. 20, drive system 947 is not connected to shaft 946 during the arresting of the ballistically spinning rotor (941+945), but it may alternatively remain connected at all times, as described in the discussion of FIG. 25.

After the arresting brake is returned to its original state at angle A2, resting against reverse stop 958 by whatever means are employed (I have discussed a few ways this can be done, but there are of course other means that could be employed as well), it is then necessary to re-cock the rotor (945+941) to its starting position. In the case that the torque drive is a stepper motor, said stepper motor can also return the rotor to its starting position. FIG. 20 illustrates the specific case that drive spring 931 provides the torque to accelerate the rotor; in this case, the shaft 945 must be twisted back to its starting position where the twist angle of 945=zero degrees by re-cocking the drive spring 931 after the circuit breaker has opened. This re-cocking operation occurs with zero-load switch 965 in the open position, and is accomplished by retractable drive 937, which mates with a feature 936 at the end of shaft 945 during re-cocking During the re-cocking the fast release brake 950 remains disengaged, but after the shaft is twisted back to twist angle zero, the fast brake is re-engaged. After the fast brake is re-engaged, the re-cocking drive 937 must be disengaged carefully, so that there is no significant acceleration of the portion of the shaft 945 occurs between the point of attachment of drive spring 931 to the shaft 945 through spline 932 and the area where fast release brake 950 engages with shaft 945 as the re-cocking driver is disengaged. During disengagement of 937, one portion of shaft 945 twists more, and a second portion twists less as the torque is transferred from the portion of shaft 945 between the re-cocking driver 937 and the spline 932 where the drive spring 931 couples to the shaft 945, to the part of the shaft between the drive spring shaft coupling 932 and the fast brake 950, which causes the shaft in this region to twist more. (That means, the torque must be transferred from the re-cocking drive 937 to the fast brake over a period of time so that no significant shock loading occurs when the retractable drive 937 is retracted and decoupled with shaft 945.)

Finally, the drive spring 931 torque is expected to reduce over time via creep and stress relaxation, so a drive spring torque adjusting system comprised of components 926, 927, 928, and 929 is also included in FIG. 20. Feature 926 is a gear that couples to the opposite end of the drive spring 931 compared to the point that spring 931 couples to shaft 945 via spline 932. Gear 926 goes around shaft 945 but not rigidly coupled to it; it may be slidably coupled to shaft 945 by a bearing for instance, or it may simply be a hollow gear that does not touch shaft 945. Gear 926 is restrained by a ratchet 927 that only allows gear 926 to move in the direction which tightens spring 931. Torque is transmitted through ratchet 927 to the base plate 960. Feature 929 is a gear that meshes with the gear 926 to which the 931 is connected. When the spring is re-cocked by drive 937, a measurement of the torque needed to re-cock the spring can be made (either routinely, or during regularly scheduled maintenance). If the cocking torque is too low, drive 928 can twist spring 931 tighter to compensate for creep and stress relaxation of the spring. Drive 928 can either be a permanent part of the circuit breaker, or it can comprise a tool used during regularly scheduled maintenance.

Supporting base 960 could be tied strongly to the Earth or some other large mass, in which case the momentum effect of accelerating/decelerating the rotor assembly (941, 945) will pass through to the structure holding the circuit breaker, which may produce an undesirable noise, vibration, and stress on the mounting structure. It is also possible and desirable to mount the base 960 flexibly to the structure, in such a way that the acceleration and deceleration of the commutating rotor 941 involves primarily momentum exchange between the rotor (941+945) and the base 960, with very little of the momentum transferred to the structural supports of the commutating circuit breaker.

This arrangement with spline 932 and stop 933 only allows drive spring 931 to apply torque to shaft 945 at angles between the on-state (angle zero) and A1; this prevents drive spring 931 from oscillating through zero strain during operation of the circuit breaker, and keeps drive spring 931 in a stressed state at all times. Similarly the arresting brake energy absorbing spring 956 can desirably exist in a pre-stressed state at all times if it is bonded to spline 957 which is held by a stop 958 with opposite angular orientation to stop 933 that couples spline 957 to the base 960. Stop 958 prevents spring 956 from fully discharging its elastically stored energy even when the commutating rotor 941 is returned to its on-state position. This arrangement with spline 957 and stop 958 only allows energy-absorbing arresting brake 955 to apply torque to shaft 945 at angles greater than an initial rotation angle A2; this prevents arresting brake 955 from oscillating through zero strain during operation of the circuit breaker, and keeps arresting brake 955 in a stressed state at all times, which maximizes fatigue life.

The two critical rotation angles A1 (where drive spring 931 hits a stop) and A2 (where spring 956 is lifted off its stop) can overlap (A2<A1), be equal (A2=A1), or be well separated (A2>A1).

1. In the case A2<A1, a region of angles between A2 and A1 exists where the torque exerted by drive spring 931 acts directly against arresting brake 955:
   a. In this scenario, the movement of the drive spring is partially arrested by the elastomeric arresting spring 956, starting when the rotor has reached angle A2 where it lifts off its stop 958, prior to encountering the hard stop 933 which limits maximum twist of the drive spring 931; such a setup will produce two audible sounds during circuit breaker operation as rotation encounters A2, then A1;
   b. There has to be a means to define the at rest orientation of the commutating rotor, which could either be a second reverse rotation stop built into 933 or a correlated magnetic domain energy well that defines the on-state position without using a mechanical stop. It is possible to dispense with the drive spring arresting stop 933, but not the elastomer spring arresting stop 958; such a setup will produce one audible sound during circuit breaker operation as rotation encounters A2;
2. the case that A1=A2 the arresting brake 961 is lifted off its stop 958 at A2 at the same moment that drive spring 931 hits its stop 933; this case produces two simultaneous sounds rather than two time separated sounds.
3. In the case that A2>A1, the commutating rotor is flung forward by the drive spring 931 from an initial angle zero which is held in place by fast release brake 950 until the breaker is triggered. At the angle A1 the drive spring hits a stop 933; after that the rotor/shaft assembly 941, 945 is in free ballistic rotation for a while, until angle A2 is reached at which time arresting spring 956 is lifted off its stop 958, and arrests the forward motion of the commutator/shaft assembly 941, 945. (This is the particular case illustrated by FIG. 22.)

In all the cases above, a specific starting point where the electrodes are lined up as needed for the efficient on-state operation of the circuit breaker is defined as angle=zero, and is set by the cocking sequence, and then held in place by the fast release brake 950 until the breaker is triggered. At the end of travel of the commutator/shaft assembly 941, 945, a ratchet assembly 948 (or some alternative means, as discussed below) restrains the commuter/shaft from rebounding. After the circuit is opened by the commutating breaker, a no-load switch 965 is opened, which allows the device to be returned to its original cocked state in an electrically inactive circuit by the retractable drive 937, which returns the rotary electrodes to their starting positions, as described above. The arresting brake 955 must also be returned to its on state configuration, which requires that ratchet 948, where used, must be released. FIG. 20 illustrates a second retractable drive 947 that may be used to gently return the shaft 946 of the arresting spring 956 to its on state position, resting against reverse rotation stop 958.

The fast release brake 950 can be a variety of different prior art mechanical or frictional brakes or ratchet mechanisms that are released by electromagnetic, electromechanical or fluid actuated means. Fast release brake 950 can desirably comprise a piezoelectric brake as described elsewhere in this disclosure, or a combination of one or more fast release brakes with correlated magnetic domains that hold back part of the applied torque. It is possible to apply the principle of matching printed magnetic domains to hold a commutating shuttle stationary while stress is applied, either in a rotary mode of actuation or a linear mode of actuation. This is based on a method of printing matching magnetic domains that has been developed by Correlated Magnetics of New Hope, Ala. (see for example, U.S. Pat. No. 8,098,122). Using this concept, a "fingerprint" pattern of matching magnetic domains can be created on the commutating shuttle and the mating stator of a commutating circuit breaker, whether motion of the commutating shuttle is axial or rotary. For example commutator 941 can be restrained by matching magnetic domains inside stator 942; or magnetic domains can be printed directly onto shaft 945, and be restrained by matching domains inside the bushings 934, 935; or the correlated magnetic domains could be printed into portions of the rotor and sleeve that form the body of fast release brake 950. Said correlated magnetic domains would be so oriented as to restrain the rotation of the commutating shuttle in respect with the stator because of a large aggregate attractive force between the correlated magnetic domains; let us assume that the matching magnetic domain patterns can prevent rotation of the shuttle out of the "magnetic energy well" up to an applied torque of $T_C$. It is then possible to combine the braking effect of piezoelectric actuators with the correlated magnetic domains; in this case, a torque would be applied by drive 930 that is slightly greater than the maximum that can be restrained by the correlated magnetic domains alone, for example $1.1(T_C)$ would be applied by drive 930, which is partially restrained by correlated magnetic domains, and partially by piezoelectric actuators that apply force perpendicular to polished metal or ceramic tabs, as in feature 915 of FIG. 19. As soon as the piezoelectric actuators are released, the shuttle begins to move, because the applied torque exceeds the maximum that can be resisted by the correlated magnetic domains alone. This reduces the normal force that needs to be applied by the piezoelectric actuators, which is economical. This design with on-state torque>$T_C$ retains the same desirable failure mode in case control power is lost, as in the case for piezoelectric brakes, as spring torque alone will knock the shuttle out of the magnetic energy well and open the circuit if the control circuit power to the piezoelectric actuators is lost.

Correlated magnetic domains have the additional important feature that they can accurately position the commutating shuttle rotor in a precise relationship to the commutating stator (within 10 microns). Thus, correlated magnetic domains provide an alternate method to hold the commutating rotor in the optimum on-state position, prior to clamping down on the fast brakes, without using a mechanical stop of some kind to determine the starting condition (a mechanical stop can of course also be used, but mechanical stops can also lose accuracy with wear, unlike correlated magnetic domains). Accurately setting the on-state rotation angle is especially important in versions of commutating circuit breakers that use thin liquid metal electrodes, which must be accurately aligned in the on-state. It is easy to arrange things so that once the commutating shuttle begins to move, the magnetic domains do not restrain the motion significantly, and yet a second set of correlated magnetic domains can optionally arrest the commutating shuttle in a desired off state at the end of its rotation.

The principle of matching printed magnetic domains to hold a commutating shuttle stationary while stress is applied, via matching "magnetic fingerprints" is also capable of restraining linear motion of a commutating shuttle such as FIG. 1, 4, 5, 8, 9, 10, 11, 12, or 13. The matching magnetic domain patterns can prevent motion of the shuttle out of the "magnetic energy well" up to an applied force of $F_C$. There are two distinct possibilities as to how these correlated magnetic domains can be used in a fast-acting linear motion commutating circuit breaker. The first option is to use correlated magnetic domains in a fast axial motion commutating circuit breaker so as to combine the holding effect of piezoelectric actuated brake shoes with correlated magnetic domains that are not quite able to restrain motion of the shuttle by themselves (as was discussed in relation to rotary motion in the discussion of FIG. 20 above). In this case, an applied force that is greater than the maximum that can be restrained by the correlated magnetic domains alone, for example $1.1(F_C)$ is applied to the shuttle of a commutating circuit breaker that is (partially restrained by correlated magnetic domains, and partially by piezoelectric actuators that apply force perpendicular to polished metal or ceramic tabs, as in feature 915 of FIG. 19. This method of partial restraint via magnetic domains could also be applied for example to replace the magnetic restraint features 119 and 121 in FIG. 1, or to supplement the restraining force applied by piezoelectric actuators to hold feature 466 of FIG. 12. As soon as the piezoelectric actuators are released, the shuttle begins to move, but the piezoelectric actuators only need to provide about 10% of the total restraining force, which is economical. This method has the advantage that if control power is lost, the circuit breaker will open automatically, so its failure mode is far less dangerous than if the triggering mechanism must be in working order to trigger the breaker.

The second way to use correlated magnetic domains in a fast axial motion commutating circuit breaker is to use actuation springs which apply a force below that which would release the shuttle from the magnetic energy well, for example $0.95(F_C)$; the magnetic domains are in this case adequate to restrain motion of the shuttle out of the magnetic energy well. A relatively small additional force of only 5% or more of the spring force can be applied to knock the commutating shuttle out of its "magnetic energy well" after which it will be rapidly accelerated by the springs. This additional force could be applied electromagnetically (as in FIG. 1), by piezoelectric actuators, or by gas pressure for example. This method of restraint of a linear motion commutating shuttle can be applied for example to replace the magnetic restraint features 119 and 121 in FIG. 1. This method could also be applied to a rotary-type commutating breaker, with the "kicker torque" being supplied by a stepper motor for example.

The various "Side A" and "Side B" descriptions in this document refer to the points where electrical power enters and leaves an individual commutating circuit breaker, and in all the figures, Side A and Side B can be reversed. Thus, to be clear, this document uses the terms Side A and Side B to mean the relatively + and − poles of an individual commutating circuit breaker.

The figures in this disclosure depict single pole breakers in the sense that "pole" is normally used in electrical engineering, meaning a connection to one leg of the power supply. In a DC supply, there are two poles, and there also two poles in a single phase AC power supply. There are three poles in a three-phase AC power supply. In the most general sense there should be a circuit breaker for each pole, however in low voltage single phase AC or DC systems such as home AC wiring or the electrical system of an automobile, one pole is grounded for example, the negative pole of a car battery is grounded to the car body, and one pole of a typical low voltage single phase AC home-based wiring system is typically grounded. In these special scenarios, only one circuit breaker is needed for each piece of equipment or sub-circuit on the circuit; such a circuit breaker is not safe for DC voltage above about 48 volts or single phase AC voltage above about 250 volts, because different paths to ground can develop dangerous voltage gradients. Thus, at voltage higher than 100 volts in particular, it is common for DC circuits to use a "floating neutral" or a grounded midpoint voltage; in this case DC circuit breakers must interrupt both poles simultaneously for safety reasons. These two electrically independent circuit breakers are not necessarily mechanically independent.

FIGS. 5 and 6 show a two stage and a three stage commutating circuit breaker. The mechanical linkage nearly synchronizes the individual stages. FIGS. 5 and 6 both show the stages hooked up in series, so that as drawn these breakers would shut off only one pole, but it is also possible that each stage can be hooked to a different pole of the power supply; so for example 157 could control the + pole of a DC power supply and 219 could control the minus pole in FIG. 5; or the three stages 220, 240, 260 of FIG. 6 can be connected across each of the three AC phases, so that all three phases see resistance increase in synchronization with the other three poles.

In any commutating circuit breaker, the motion of the variable resistance shuttle or the commutating shuttle implies rapid acceleration, which will cause a mechanical jolt unless two opposed motions with equal and opposite momentum changes are combined into a single circuit breaker. In order to minimize fatigue of the connections between the breaker and its enclosure, or the mounting fasteners holding the enclosure to the building or vehicle structure, and to reduce noise and vibration due to opening a commutating circuit breaker, it is desirable to have two opposed and balanced motions, so that the momentum that must be transferred to the circuit breaker enclosure and the structural supports of the enclosure are minimized.

Three mechanisms to contain the momentum effects of commutating circuit breaker actuation within the housing of the commutating circuit breaker moving core (whether the moving core is a variable resistive element or a commutating shuttle) are possible:

1. Accelerating two linear variable resistance shuttles or commutating shuttles in opposite directions within a common stator housing (which is capable of absorbing the shock loading that will result when the shuttle cores reach the end of their travel and must be arrested) which will contain the momentum effects of two symmetrical and balanced cylinders which move axially in opposite directions;
2. In the case of rotating shuttles (which may comprise rotating variable resistors or shuttle commutators), balancing the momentum effects perfectly would require coaxial counter-rotating discs; it is much easier however, to use two opposed counter-rotating shuttles on a common support base; the modest twisting forces due to having the centers of rotational momentum of the two disks offset slightly can be tolerated; this precession force is small compared to the rotational momentum required to accelerate and decelerate the rotating commutating shuttles, which can be balanced;
3. For either linear motion or rotating commutating circuit breakers, the balancing momentum component can be a mass that is not a commutating circuit breaker per se; for example the rotary commutator 941 may be twisted by acting against the momentum of the base 960 primarily; or the mechanical function of 960 can be accomplished by a pipe-shaped shell that surrounds the rotor and is symmetrical about the same axis of rotation. In such a case, the support base may desirably have greater rotational momentum about the axis of rotation than the rotor (the shaft and commutating rotor together), so that the twist experienced by the base is opposite to, but less than the twist of the rotor. In this case, when the rotor reaches the end of its rotation, it will react against the support base and the two momentum effects will cancel. If the support base is flexibly mounted to the enclosure, it will be as if the base is quickly twisted but its momentum is canceled as soon as it gets too its final twist state, allowing the flexible base to return the circuit breaker to its original position without any large forces having been transferred from the support base to the building or enclosure structure.

It is important in most circuit breakers to deal with the inrush of current in a dead short. A complete analysis requires an understanding of the entire electrical system in which the circuit breaker is imbedded, including especially system voltage response, capacitance, resistance, and inductance in a fault. The rate at which current can increase in a fault is moderated primarily by inductance and resistance, and it is always possible in principle to add inductance to slow the inrush of current in an anticipated fault. There is a trade-off between speed of operation that is required for the circuit breaker and system inductance. Adding inductance can allow the insertion of resistance to be slower while still clamping the current inrush at an acceptable level, but at a cost: both for the inductor per se, but also adding inductance can increase the mass of resistors that are needed to squelch the current. The commutating circuit breakers of the present invention work best when the ratio of system voltage V (in volts) to inductance L (in Henries) is less than 40 million; more preferably the ratio of V/L should be less than or equal to 8 million. Higher ratios than 40 million can be allowed in fast hybrid circuit breakers such as that of FIG. 15.

Figure 21:
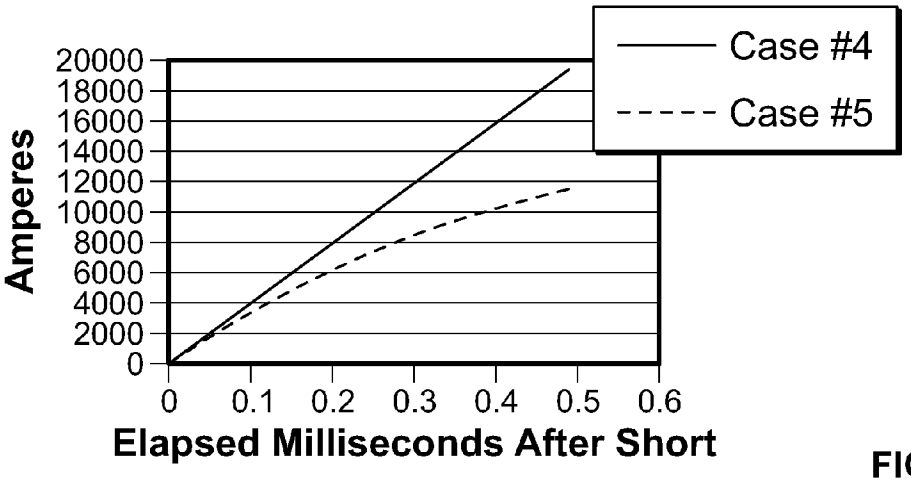
FIG. 21: Semi logarithmic plot comparing current versus time in a worst case dead short (no voltage sag, no resistance) versus a circuit with internal resistance.

Let's consider several specific design approaches for an MVDC commutating circuit breaker for 2 kA and 6 kV. These basis assumptions are used in developing Examples 1 to 4:

Full load=2000 amps;

6 kV voltage source; two cases were modeled, as per FIG. 21: Case #4 has no voltage sag due to internal resistance (a worst case assumption, similar to a large capacitor bank); Case #5 has the current come from a large battery bank with realistic internal resistance of 0.36 ohms);

normal full load resistance of (6 kV)/(2 kA)=3 ohms

Maximum design amps in dead short=10 kA (this determines how fast the commutation to switch in the first resistance level must be);

Maximum voltage during commutation=12 kV (double the normal system voltage; occurs due to switching in resistance)

First resistance switched in is (max voltage)/(max amps in a fault)=1.2 ohms (just high enough to clamp the current and reverse dI/dt in a worst case short circuit)

1.0 microhenries is the assumed worst case system inductance $L_0$ in a dead short;

Additional inductance is $L_x$ is added as needed to slow the inrush of current; different values of $L_x$ are considered in each of Examples 1 to 4.

Table 3 shows calculated times to go from full load (2 kA) to maximum overload (10 kA) in two different overload cases (illustrated in FIG. 21 with no added inductance; 1.0 microhenry):

Case #4: a worst case dead short, zero resistance, no voltage sag; the increase of current with time follows equation (3)

Case #5: power supplied by batteries, with internal battery resistance=0.36 ohms; the increase of current with time follows equation (4).

TABLE 3

Time to Max Amps (10 kA) for Various System Inductances (6 kV, 2 kA circuit)

| example | System inductance, mH | Time (2 kA→10 kA), ms Case #4 | Time (2 kA→10 kA), ms Case #5 |
|---|---|---|---|
| Example 1 | .001 | .00133 | .00163 |
| Example 2 | .150 | .200 | .333 |
| Example 3 | .750 | 1.00 | 1.63 |
| Example 4 | 3.750 | 5.0 | 8.17 |

At time zero, resistance goes to zero in Case #4 (a worst case dead short), after which only the system inductance constrains the current rise dI/dt. In Case #4, the fault current I(t) is a linear function of time after the fault, given by (4); on the other hand if the circuit contains resistance R (Case #5), the increase of current with time follows equation (5):

(Case #4)

$$I(t)=Vt/L \rightarrow dI/dt=V/L \tag{4}$$

(Case #5)

$$I(t)=(V/R)\{1-\exp[-t/(L/R)]\} \tag{5}$$

FIG. 21 shows a plot of these two equations for an intermediate inductance case (150 microhenries, corresponding to Example 2 below); up to normal full load of 2 kA, the two plots are nearly the same, but they diverge significantly at higher current, longer time. Given the very low assumed value of minimum system inductance L (1.0 microhenries; see above assumptions used in developing Examples 1 to 4), in the absence of added inductance, dI/dt (change of current with time in a dead short) is six billion amps/second. In order to limit this current rise to no more than 10 kA (starting from 2 kA, normal full load), it would be necessary to insert the first resistance at 1.33 microseconds. This is not possible for a mechanical system; only hybrid designs such as FIG. 15 with the very fastest types of switches (IGBT transistors, superconducting fault current limiters, or vacuum tubes) can work in less than two microseconds as is needed if system inductance is only one microhenry.

Time to the first resistance insertion (commutation) is an important attribute of a commutating circuit breaker, because the first resistance reverses or greatly slows the increase of current; this is true whether it is a standalone commutating circuit breaker or a hybrid design as in FIG. 15; or indeed for any DC circuit breaker based on sequential insertions of resistance. There are also many types of faults in an AC system that can be very fast as well (lightening strikes for example) where the inrush of current is too fast to wait for an ordinary AC-type circuit breaker to work. If the first inserted resistance is (max voltage)/(max amps in a fault)=1.2 ohms in the case of the above basis assumptions, and if this resistance is inserted on or before the time when the design maximum 10 kA current in the circuit is reached (Table 3), the first voltage spike will be less than or equal to the maximum design voltage, and current will decay back from that point onwards. If current=10 kA, then after switching in the 1.2 ohm resistor, the voltage across the resistor will be 12 kV. The selected resistance for the first insertion is just high enough to clamp the current and reverse dI/dt, but without causing voltage to increase above 12 kV. As discussed in detail above around FIG. 6 and Table 1 (which relates to a high inductance transmission system), one then must allow enough time for the current to decay down to some desired level before the next commutation. Adding in extra inductance $L_X$ slows down not only the inrush of current in the short (as in Equations 3 and 4), but also extends the time until the circuit is opened (since current decays as exp[−t(R/L)].

Figure 22:
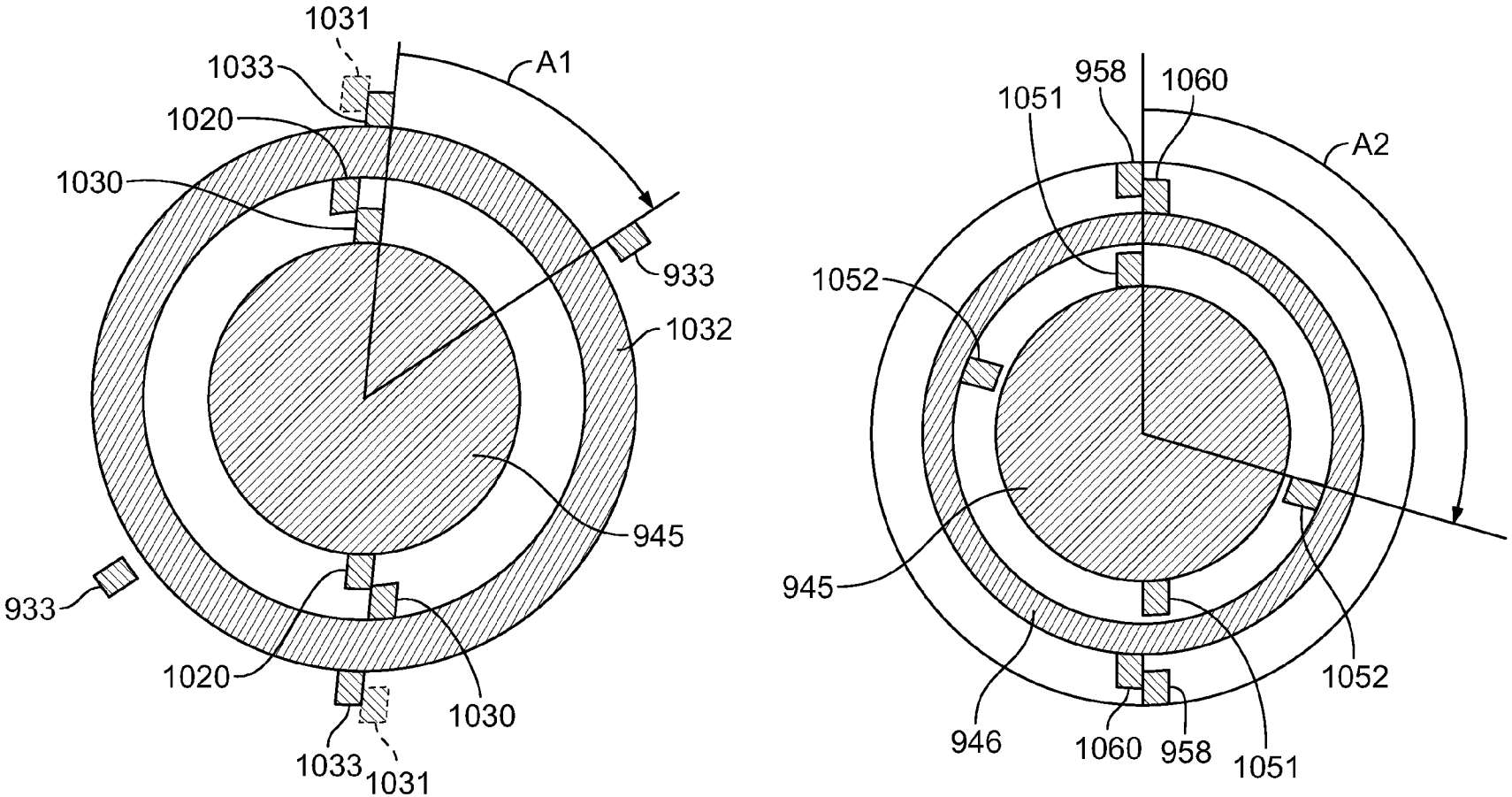
FIG. 22: Shows the splines to accomplish a particular set of rotation angles for engagement and disengagement of the commutating rotor from the drive spring and the arresting spring of FIG. 20; accomplished via spline engagement and disengagement as the shaft turns.

FIG. 22 shows end-on illustrations of the two splines 932 (on left in both FIG. 20 and FIG. 22) and 957 (on right in both FIG. 20 and FIG. 22) that together with stops 933 and 958 control the range of angles of rotation where the drive spring 931 and the arresting brake 956 are mechanically coupled to the rotor (945+941). FIG. 22 is based on inserting the rotary commutating breaker of FIG. 18 as feature 940 in FIG. 20. In FIG. 22, A1=45 degrees, A2=105 degrees, but this is not a general requirement. All angles are defined in respect to the zero angle defined as the on state position, determined by the set point of fast release brake 950. As described above, there are three distinct cases for how these stops can be positioned; FIG. 22 shows the case where A2>A1. When 950 is released drive spring 931 accelerates the rotor (945+941) via the spline shaft 1032 through two sets of meshing tabs 1020 (on the inside of spline shaft 1032) and 1030 (on or connected to the outside of shaft 945) from angle zero to angle A1. At angle A1 two stops 933 (connected to base 960) restrain the further rotation of 1032 via restraining tabs 1033; collision of the 1033 tab into the 933 tab arrests both 1032 and drive spring 931; after that, the rotor (941+945) spins freely ("ballistically") until a second stop 958 (which is part of the arresting brake 955 in FIG. 20) is encountered which engages the arresting torsion spring 956 at angle A2 (shown on the right of FIG. 22).

FIG. 22 shows the two types of splines that would be used in the rotary ballistic breaker of FIG. 20 to implement the insertion of the FIG. 18 commutator design. Spline 932 delivers torque from the drive spring 931 to the rotor (945+941); in the case of FIG. 22 imagine that commutating rotor 941 is further comprised of components 855, 803, 853, 802, and 852 as shown in FIG. 18. At zero degrees, the rotor electrodes 802 and 852 are properly aligned in the on-state with the stator electrodes 801 and 851. One means to enforce this alignment could be to employ a reverse movement stop 1031, as is shown with dotted lines in FIG. 22. It is more desirable however to index the starting position of the rotary commutator 941 using correlated magnetic domains (to position the rotor accurately) and fast-release piezoelectric brakes to hold the pre-stressed rotor at zero degrees in the on-state; a sudden movement of the piezoelectric brakes releases the pre-stressed rotor next to spline coupling 957.

When the rotor is released, drive spring 931 accelerates the rotor clockwise from angle zero to angle A1, through spline assembly 932, as shown on the left side of FIG. 22. When the angle of rotation reaches A1, the motion of the spline coupling 1032 is arrested by the stop 933. In FIG. 22, stop 933 is positioned at 45 degrees for purpose of illustration, but this angle can have other values. In the particular case illustrated in FIG. 22, the rotor is in free ballistic flight between angle A1 (45 degrees), where the acceleration by the drive spring 931 is stopped; to angle A2 (105 degrees), where the inner shaft 946 of arresting spring 956 is engaged by spline 957 via the collision of tabs 1051 and 1052. Tabs 1060 on the outside of shaft 946, but not on the part of 946 covered by elastomeric torsion spring 956, are resting against tabs 958 (which are connected to the support base 960) in the on and ready state, which holds the arresting spring 956 at angle A2 until it is lifted off 1060 tabs by the collision of tabs 1051 and 1052.

Figure 23:
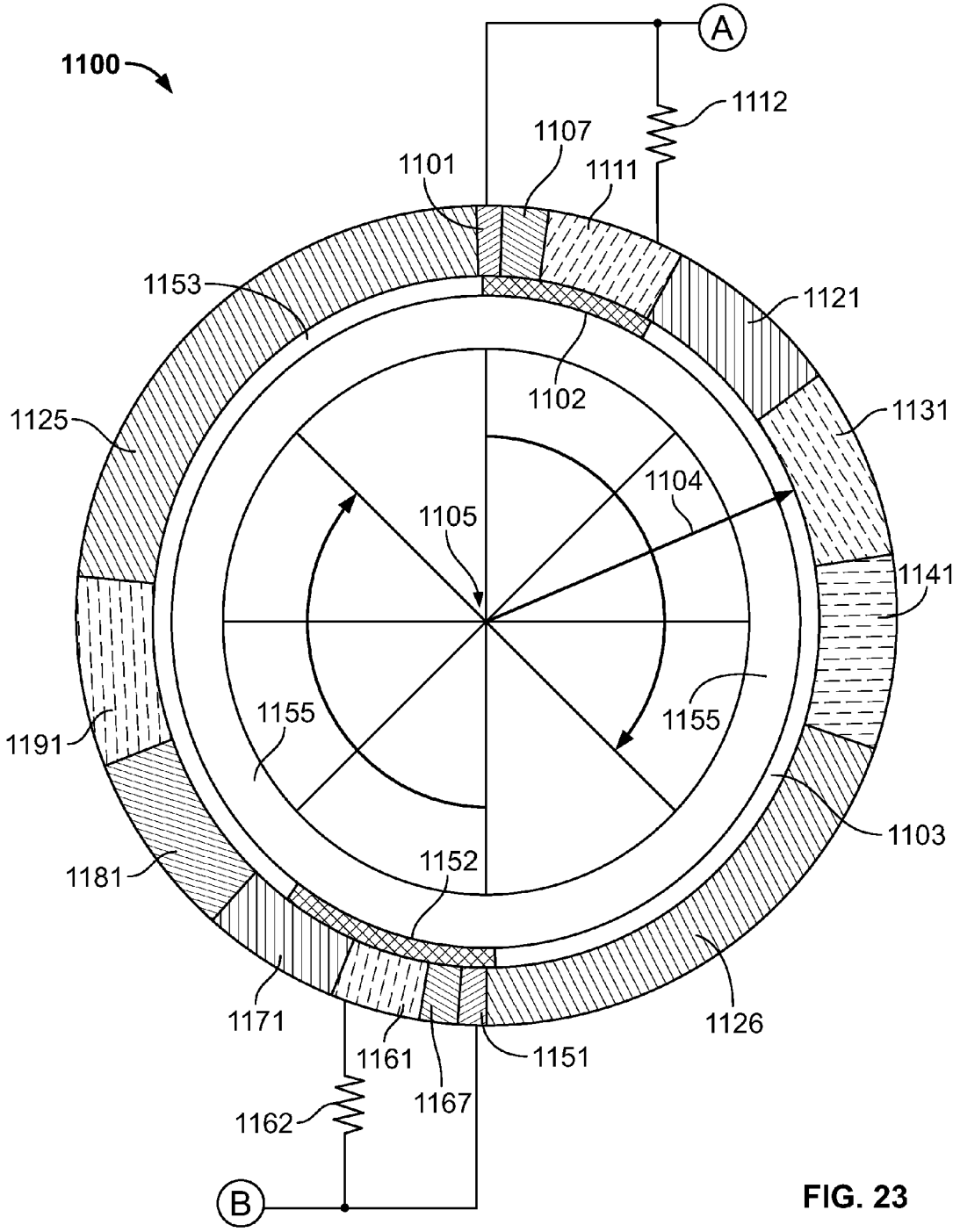
FIG. 23: Hybrid breaker in which the first resistors commutated into the circuit are external to the stator, but the others are built into the stator.

FIG. 23 illustrates a concept that blends the designs of FIG. 17 (which commutates through discrete external resistors as the commutating circuit breaker rotates) and FIG. 18 (where the resistors are built into the stator walls that surround the commutating rotor). This blended design commutates the electric power through two stationary resistors, first resistor 1112 then through both 1112 and 1162 in series, and then after that through resistive elements in the walls of the stator similar to the rotary commutating circuit breaker of FIG. 18.

FIG. 23 is a modification of FIG. 18, where the only changes are near the power-in and power-out points of attachment A and B; this design essentially hybridizes the breakers of FIG. 17 (with discrete, insulated stator electrodes) and FIG. 18 (with connected resistive stator segments in the wall per se). The commutating rotor is in this case a strong metallic hollow shaft 1155, selected to allow very high torque for maximum radial acceleration and very fast actuation. The outer surface of this shaft is insulated over most of its surface by insulating sleeves 1103 and 1153, but has two conductive regions 1102 and 1152 which are electrically connected to each other through the metallic shaft 1155. The center of rotation of the commutating rotor is 1105, and the outside radius is 1104; this outside radius is constant over the entire commutating rotor, which implies that the outer surfaces of both the insulators 1103 and 1153, and the conductors 1102 and 1152 are polished smooth, and are flush across the interface.

The on-state stator electrodes 1101 and 1151 carry the bulk of the on-state power, and may be metal matrix electrodes, liquid metal electrodes, or weak solidified liquid metal electrodes (weak enough to be fractured by the drive spring when torque is applied). A small portion of the on-state current passes through the parallel circuit through the next stator electrodes 1111 and 1161 (which are metallic-matrix electrodes), as per equation 2. On the clockwise side of the two on-state electrodes, insulating wedges 1107 and 1167 have been added, to isolate the on-state electrodes 1101 and 1151 electrically from the next neighbor metallic electrodes 1111 and 1161 that connect to the A and B poles of the commutating circuit breaker through resistors 1112 and 1162. The remaining stator electrodes on each side of the breaker: 1121, 1131, and 1141 are connected to pole A via direct connection to metallic electrode 1111; and 1171, 1181, and 1191 stator electrodes are connected to pole B via direct connection metallic electrode 1111. Once the commutating rotor spins far enough to the right that rotor electrode 1102 is completely beyond the last semiconductive electrode 1141, or the rotor electrode 1152 is completely beyond the last semiconductive electrode 1191, then the circuit is opened. The sections of the stator wall 1125 and 1126 are highly insulative materials; when electrodes 1102 and 1152 are beneath these insulative stator segments 1125 and 1126 the circuit is open. This design allows for the first resistive steps to be through external resistors that can be larger than are convenient to build into the walls of the stator; these first two resistive insertions through resistors 1112 and then 1112+1162 absorb most of the inductively stored energy, as can be seen from Table 1, and so together must comprise more than half of the total mass of resistors deployed, if all the resistors increase temperature about the same during opening of the circuit (as is desirable).

Note that although FIG. 23 depicts a particular hybridization of the device of FIG. 17 (with discrete, insulated stator electrodes) and FIG. 18 (with connected resistive stator segments in the wall per se), other versions are also possible. For example there could be two electrically insulating segments between discrete stator electrodes that connect to two external resistors on each side of the commutating circuit breaker rather than just one electrically insulating gap on each side as shown in FIG. 23 (1107 and 1167), prior to subsequent connection through resistive sections of the stator wall such as 1121, 1131, and 1141 in FIG. 23.

Figure 24:
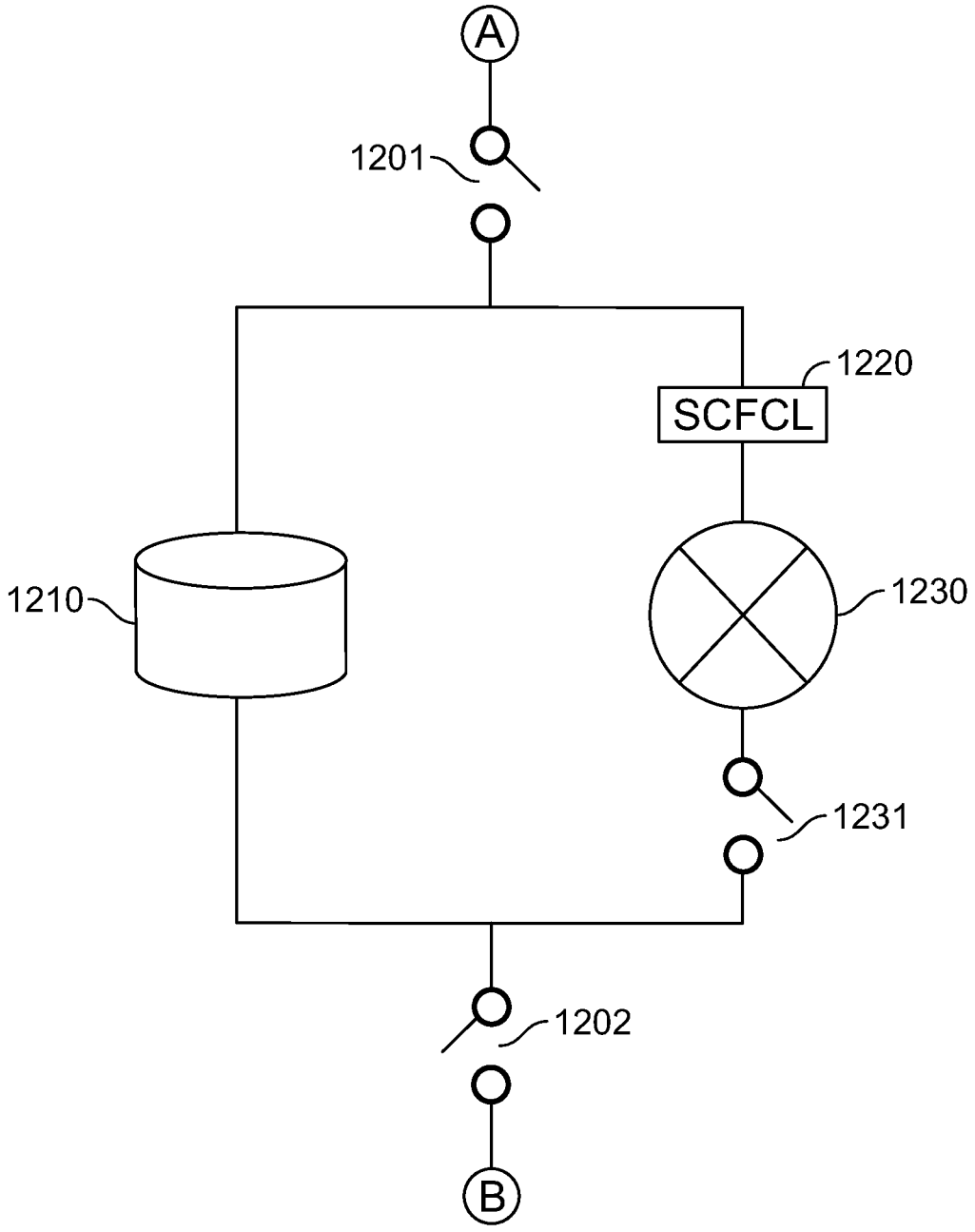
FIG. 24: based on FIG. 15, but with three switches in a row rather than just the fast switch.

FIG. 24 shows a desirable implementation of a hybrid circuit breaker of FIG. 15, with additional features that are particularly valuable for use in high voltage DC (HVDC) systems. Two zero-load switches 1201 and 1202 are placed on both the A and B sides of the circuit breaker; these switches are never opened when power is flowing, but are only used to isolate the device for maintenance or to reset the various components that make up the hybrid breaker after it has opened the circuit; during normal operation 1201 ad 1202 are closed. It is desirable to isolate both sides of a high voltage circuit breaker for maintenance, especially where two-way power flows may occur. There is a parallel circuit in the FIG. 24 device between a commutating circuit breaker 1210 on the left and three series connected elements on the right, a superconducting fault current limiter (SCFCL) 1220, a fast switch 1230 that can desirably be an IGBT, an IGCT, or a cold cathode vacuum tube, and a fast mechanical switch 1231. Each of the switches on the right has different functions, but when any one of them is open the current flows through the commutating circuit breaker on the right, which can then open the circuit with minimal voltage surges (lower than a metal oxide varistor, "MOV"). Commutation to the breaker on the left can occur via the SCFCL, in which case commutation is very fast, but dumb, that is, the SCFCL only responds to current and is not under the control of the SCADA (supervisory control and data acquisition) system. The second switch on the right 1230 is under control of the SCADA system, and can respond to faults that do not cause high current; the fact that this switch is protected from high current by the SCFCL means there is a maximum current that fast switch 1230 must withstand; this simplifies the design of 1230 and reduces its cost. The fast mechanical switch 1231 can be opened after either 1220 or 1230 has opened the circuit, sending the power through the commutating breaker 1210; this is useful for resetting the SCFCL without current flowing during the reset, or it can protect relatively delicate electronic switches (IGCTs in particular) from the voltage spikes that occur as the commutating circuit breaker 1210 opens the circuit and quenches the stored inductive energy.

Figure 25:
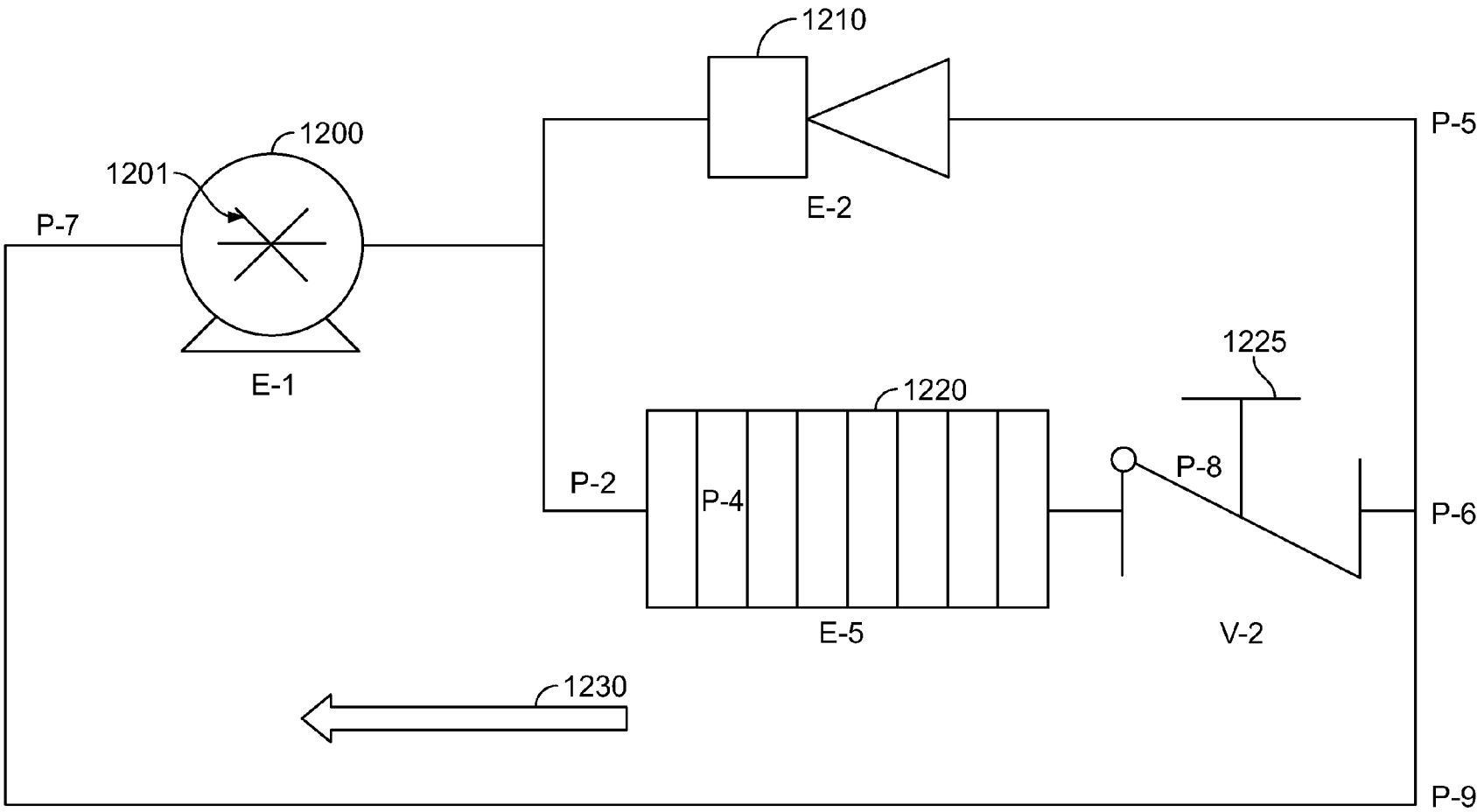
FIG. 25: hydraulic system to facilitate gentle return of an arresting spring to its ready state.

FIG. 25 shows a mechanism that can be used to modify the FIG. 20 design that simplifies the design and allows the elimination of three mechanisms that are shown or required per FIG. 20, this includes the ratchet or gear 948 which keeps shaft 946 from rebounding after the kinetic energy of the spinning rotor is absorbed by torsion spring 956, but also includes two other mechanisms implied but not shown in FIG. 20:

The mechanism to engage/disengage shaft coupling 947;

The mechanism to release the ratchet mechanism of 948.

All three of these mechanisms can be eliminated by attaching the mechanism shown in FIG. 25 to the end of shaft 946. Shaft 1301 shown in FIG. 25 connects to shaft 946 at the same point as 947 would do when engaged, but remains connected to shaft 946 throughout normal operation of a commutating breaker using a torsion spring such as 956 as the arresting brake. The critical function of any drive system connected to shaft 946 is to gently return the shaft 946 back to its initial position (rotated backwards until it rests on stop 958), after the rotary commutating circuit breaker has opened.

FIG. 25 shows a positive displacement hydraulic pump 1300 that is linked to shaft 1301. Hydraulic pump 1300 can pump through one-way valve 1310 in the direction indicated by arrow 1330 with little resistance when the shaft 1301 rotates in the forward direction (the direction a connected rotary circuit breaker moves when it opens the circuit; clockwise in FIGS. 17, 18, and counterclockwise in FIGS. 7 and 19); however the one way valve will not allow fluid flow in the reverse direction. A second hydraulic circuit that bypasses the one way valve 1310 is shown, with an optional flow restriction 1320 in series with a control valve 1325. The one-way valve 1310 prevents rapid rebound while the alternative loop provides a means to allow slow leakage flow so that positive displacement pump 1300 can move backwards in a slow, controlled manner, allowing the spring 956 to return to its on state ready position, backed up against stop 958. The valve 1325 provides a control point that prevents resetting the circuit breaker until valve 1325 is opened by an operator or the SCADA system. It is feasible for valve 1325 alone to be in the bypass loop, simply by being an appropriately sized small valve. Alternatively, valve 1325 could be eliminated, in which case after circuit opening the arresting break will spontaneously return to its starting position after circuit opening; this is probably a preferred mode of action for low voltage (less than 2000 volts), but less desirable for HVDC systems, where the possibility of striking an arc increases as the commutating rotor 941 is rotated backwards. If valve 1325 is closed when the commutating circuit breaker trips, then the valve must be opened to allow the resetting of the arresting brake to occur.

Said flow restriction may for example be selected so that it takes 10-20 seconds for torsion spring 956 to return shaft 946 to its original position at A2, so that the reverse velocity of the rotor is low enough that it is not flung backwards past angle A2 so as to re-close the circuit. This combination of a gear pump, a one-way valve, and a fluid reverse flow path through a flow restriction acts like a one-directional fluid shock absorber that does not restrain forward motion of shaft 1301 much, but does slow reverse motion of shafts 1301 and 946 (which is driven back to its original position at A2 by torsional arresting spring 956).

Commutating circuit breakers for relatively low power circuits may desirably incorporate the resistors into the moving variable resistance shuttle, such as FIGS. 1 and 13; this principle may also be used in rotary commutating circuit breakers, by using a variable resistance rotor. Commutating circuit breakers for relatively high power circuits (more than about 100 kW) are preferably made with a commutating shuttle that connects the current through a sequence of increasing resistance paths by making sequential contacts through stator electrodes connected with multiple stationary resistors, as in FIGS. 4, 5, 6, 8, 9, 11, 12, 17, and 18. This is especially true in the case of circuits with high system inductance (such as HVDC transmission lines), since the inductively stored energy must be dissipated as heat during opening of the circuit, which can imply a need for hundreds of kilograms of resistors.

It is desirable in some cases to have a snubber circuit integrated into the commutating circuit breaker that has the effect of minimizing the voltage spike that occurs when the contacts slide off the connection (whether direct or indirect) from one set of resistors onto the next set of resistors of higher resistivity. I have discussed using graded resistivity on the trailing edge of the electrodes to soften the voltage spikes due to commutation, but there are also numerous known snubber circuits that can reduce or "filter" voltage transients, such as varistors, Zener diodes, capacitors, capacitors connected to the circuit through diodes, and other known types of snubber. A snubber circuit can be added to any of the commutating circuit breaker designs of this disclosure.

EXAMPLES OF THE DISCLOSURE

Example 1

Consider a circuit breaker of the style of FIG. 15, in which the fast switch is a cold cathode vacuum tube of the type disclosed in U.S. Pat. No. 7,916,507. Such a tube has an on-state voltage drop of about 10 volts, which implies energy loss of about 1‰ or ~0.17% of transmitted power (better than an IGBT and not needing water cooling), for the basis assumptions cited above Table 3. This kind of tube can switch in less than 0.1 microsecond, easily commutating power to the commutating circuit breaker before the current inrush passes the 10 kA maximum level at 1.3 microseconds after the short for Case #4, or to 1.6 microseconds after the short for Case #5, even at one microhenry inductance, provided of course that it can be triggered fast enough.

In this case, the vacuum tube is doing the first commutation, and if the system inductance is only one microhenry, then there is very little inductive energy to dissipate: only 100 joules if the current is interrupted at 10 kA, so that a small capacitor or varistor could be used to absorb this energy. The advantages offered by the commutating circuit breaker would be negligible in this case, except if (as is often the case) the inductance of the fault could be highly variable depending on its location. If the inductance in a fault is highly variable, one can rely on the vacuum tube to clamp down on the inrush in case of a low inductance fault, and the commutating circuit breaker can be optimized for the maximum expected inductance, so as to minimize voltage spikes during opening the circuit breaker. In particular, voltage spikes can be kept below the voltage that would be experienced if a varistor were used to absorb the inductive energy.

Example 2

Consider the case of minimum inductance in a fault being 150 microhenries. This implies very fast actuation and movement of a commutating circuit breaker to get to a first commutation in 200-333 microseconds (per the basis assumptions of Table 3). This is so fast that (as is the case for Example 1) only a hybrid commutating circuit breaker in a parallel circuit with a fast electronic switch (as in Example 1 and FIG. 15) can feasibly reach the first commutation within 200 microseconds, but in the case that 333 microseconds are available to reach the first commutation (in Case #5 of a circuit with internal resistance) it is feasible (but difficult) to use a fast commutating circuit breaker to get to the first commutation within this time. These calculations are predicated on use of the fastest known method to actuate release of a rotating commutating circuit breaker, a piezoelectric actuator that moves 20 microns in 20 microseconds. In the case of a rotary device, the torque required per unit angular acceleration scales with radius squared, whereas the circumferential distance (available for placing electrodes) scales with radius. Therefore, for a given available torque the fastest actuation will occur for the smallest workable radius of commutating rotor. To push the limits of a rotary commutating circuit breaker in which torque is applied through a shaft towards the fastest possible actuation, it is thus desirable to minimize the radius of the commutating shuttle. This in turn means minimizing the number of stator electrodes, the width of the stator electrodes, and the stand-off distance between the stator electrodes, because each stator electrode and each separator between neighboring stator electrodes must fit along the circumference of the rotating shuttle. The wider is each stator electrode, and the higher the number of stator electrodes, the longer must be the circumference. As this example is designed to probe the limits of speed of action of a commutating circuit breaker, it uses several simultaneous tricks, as detailed below and shown in FIG. 18.

The release of the rotor of FIG. 18 which is under high torque is assumed to occur within 50 microseconds of the fault, which includes 30 microseconds for the control computer to detect the fault and deactivate a pair of piezoelectric actuators to release the normal force clamping against a polished metal or ceramic brake that is also part of the rotary commutating shuttle, but outside the region where the shuttle electrodes are found, and on the opposite side of the rotary commutating shuttle from the device that applies the torque (as in FIG. 20). Ordinary springs will not suffice to apply the torque for such fast motion; only elastic stress in a very stiff material can keep up with the needed motion; for example, a twisted titanium alloy tube or a tube-shaped carbon fiber reinforced composite that is the same diameter as the rotary commutating shuttle can supply the spring force and keep up with the motion of the rotary commutating shuttle.

For purpose of calculation I took the axial length of the rotary commutating shuttle of FIG. 18 to be 10 cm, which implies a needed circumferential overlap of the rotor electrodes 802 and 852 with the liquid metal stator electrodes 801 and 851 of less than one mm in the closed circuit on-state; this may be too small a contact area for accurate routine alignment of the electrodes in an industrial circuit breaker; therefore, for purposes of this discussion I took the circumferential width of the liquid metal stator electrodes 801 and 851 to be 2.0 mm, which allows for modest misalignment between the rotor electrode trailing edge and the leading edge of the liquid metal electrode. At the selected outer radius of the rotating shuttle (2 cm), this implies that the shuttle must rotate by 5.73 degrees (0.100 radians) to the first commutation (where the shuttle electrodes 802 and 852 slide off the liquid metal electrodes 801 and 851); in order to achieve that movement in 150 microseconds, the radial acceleration must be 8.89 million radians/second. This would require a torque of 2158 newton-meters which is higher than the maximum torque that can be applied to even a solid titanium beta-C shaft of 2 cm radius. (For purposes of calculation, the entire rotor which contains the 10 cm long rotary commutator is assumed to be equivalent to a 20 cm long titanium beta-C alloy shaft, 4 cm in outside diameter and 20 cm long, and weigh 1.214 kg.) In the case of a resistive circuit (Case #5), the internal resistance delays the crossing of 10 kA in a dead short, so that 283 microseconds is available to reach the first commutation (after the 50 microseconds allowed for fault detection and release of the piezoelectric brakes); this reduces the needed angular acceleration to 2.5 million radians per second and the required torque to 606 newton-meters, which is just barely within the strength limitations of the assumed solid titanium alloy rotor. This is not a practical design, but it does show that it is technically feasible to reach the first commutation within 333 microseconds using the rotary design of FIG. 18.

Example 3

Consider the case of minimum inductance in a fault in the circuit of Table 3 being 750 microhenries. I will continue the discussion based on a rotary commutating circuit breaker of FIG. 17, which has identical rotor dimensions as Example 2. Increasing minimum inductance in a fault to 750 microhenries increases the time for current to rise to 10 kA from the presumed starting current of 2 kA by a factor of five: for the worst case, zero resistance fault (Case #4) this gives 1.0 milliseconds to reach the first commutation, and for the Case #5 circuit, 1.63 milliseconds. Using the same assumptions described above for Example 2 (50 microseconds for releasing the brake, rotary moment of inertia equivalent to a 20 cm long titanium beta-C alloy shaft 4 cm in outside diameter and 20 cm long), this drops the needed angular acceleration to 222000 radians/second for Case #4 fault, and 80100 radians/second for the Case #5 fault. The corresponding torque for these accelerations is 54 and 19 newton-meters; within a range of practical torques. In fact, these torques do not require such a strong solid titanium shaft as would be needed in Example 2, which means a hollow aluminum alloy shaft can be used, which reduces both weight and moment of inertia of the rotor, which reduces the needed torque even more. Note though that the speed of actuation required here will still rule out conventional multi-turn steel coil springs for actuation; a fast acting spring will still be needed though not quite as fast as in Example 2. This demonstrates that practical rotary commutating circuit breakers with about a one millisecond time to first commutation can be manufactured.

After the first commutation away from the liquid metal electrodes in FIG. 17, the other eight stator electrodes are not liquid metal electrodes, and as a consequence have to be wider than the liquid metal electrode in order to carry the fault current safely and without damage to the electrodes. Further, as is illustrated by Table 1 and FIG. 7 for a different but similar case, the optimum interval between commutations also changes as the current and stored inductive energy are quenched by repeated resistance insertions. I have not taken the step to couple the equation of motion of the rotor 650 with optimized times for resistance insertion, so as to calculate the optimal width between each pair of stator electrodes for the assumed worst case fault (10 kA, zero system resistance). I note though that this is a straightforward calculation once the details of the torque source and the rotor are known. FIG. 17 illustrates this principle by the fact that the first two metal sliding stator electrodes 680 and 720 are wider (one cm wide in the circumferential direction) than either the initial liquid metal stator electrodes 675, 676 (which are 0.2 cm wide) or the three subsequent stator electrodes 690, 700, 710, 730, 740, 750 (which are 0.6 cm wide). In this case, the two sets of stator electrodes (those from 720-750 and those in from 680-710 are equal in size to their counterpart electrode in the opposite commutation zone. Syncopation of switching between commutating zone 680-710 and commutating zone 720-750 is accomplished by making the width of the first insulating gap 682 (between liquid metal stator electrode 675 and stator electrode 680) 0.45 cm, whereas all the other insulating gaps (including the insulation gap 692) are 0.30 cm; this offsets the commutations of rotor electrode 672 off of the stator electrodes (680, 690, 700, 710) in the upper right commutation zone by 4.30 degrees behind the corresponding commutations of rotor electrode 673 off of the metal sliding electrodes (720, 730, 740, 750) in the lower left commutation zone. Using this method to create the syncopated commutations has the advantage of standardizing the stator electrode widths, and allowing the commutating rotor to have a nearly symmetrical design. This is not an optimized configuration, but illustrates the principle of using asymmetric stator electrode circumferential spacing to make the commutations in two different commutation zones occur at different times during operation of a commutating circuit breaker; and shows that altering the gap spacing between only one set of stator electrodes can achieve syncopated commutations between one commutating zone (at the upper right in FIG. 17) and a second series-connected commutating zone (at the lower left in FIG. 17).

The best available conductors near room temperature are silver and copper; silver-matrix electrodes in which silver is infiltrated into a sintered porous metal substrate of chromium or tungsten are well known, for example. If silver or copper is used in contact against liquid metal electrodes, it can react; silver reacts with gallium and mercury, so even if one made silver-mercury electrodes for example, the surface of the silver electrode will be a silver-mercury amalgam. Silver can be used with the sodium-potassium low melting eutectic, but this introduces safety concerns. A particularly desirable surface for the shuttle electrodes 672, 673 so that the electrode surface is compatible with mercury or a gallium alloy is to cold spray silver onto a non-oxidized aluminum or aluminum composite substrate in a moderate thickness layer 100-1000 microns thick, and then to polish the surface smooth before applying a molybdenum layer, which can desirably be accomplished by physical vapor deposition (PVD) methods to lay down a fairly thin film (1-5 microns) on the polished silver surface, which PVD-applied film reflects the surface finish of the silver substrate below, and does not require further polishing. Plasma spray techniques can also be used to apply a thicker molybdenum surface layer (for example 200-1000 microns thick) on a copper, silver, aluminum/SiC composite, or chromium substrate, followed by grinding and polishing of the thicker molybdenum layer. Plasma co-spraying of a substrate metal and molybdenum can be used to create a fuzzy boundary layer between the substrate metal and molybdenum to reduce the chance of delamination. However, a thick layer of molybdenum on a silver, copper, or aluminum substrate is intrinsically unstable due to the difference in thermal expansivity of the molybdenum compared to the substrate. In either case, the reason to apply a surface film of molybdenum is to coat the solid electrode with a non-oxidizing metal (below about 600° C.) which does not react with gallium or mercury to form an amalgam.

Because the electrode layers 672, 673 on the surface of the commutating rotor 650 of FIG. 17 are relatively thin (less than two mm), and also for simplicity of manufacturing, it is desirable for the entire thickness of the electrodes to be composed of molybdenum that is plasma sprayed onto the substrate metal tube 651. In this scenario, the insulating layer 671 could logically be a plasma sprayed alumina layer (the surface of the commutating rotor would in this case be ground smooth after plasma spaying). Because molybdenum and alumina both have low thermal expansivity compared to conductive metals, it is desirable to minimize the thermal expansivity of the substrate conductive tube or shaft 650 in the commutating circuit breaker of FIG. 17. Two potential materials for the core of a rotary commutating circuit breaker such as that shown in FIG. 17 were considered:

Solid shaft made of AlSiC-9 infiltrated composite;

Hollow titanium shaft for high shock loading capabilities.

These two shaft materials have very similar thermal expansivities. AlSiC-9 is an aluminum-infiltrated silicon carbide composite from CPS Technologies that has 8-9 ppm (parts per million per degree Celsius) thermal expansivity from 30° C. to 200° C. (less than half the thermal expansivity of aluminum), and titanium has 8.6 ppm (parts per million) thermal expansivity from 30° C. to 200° C. Both materials form bonds with plasma sprayed alumina and molybdenum. Using a solid shaft made of AlSiC-9 for the core of the commutating rotor 651 in FIG. 17 leads to a resistance between the two shuttle electrodes of about 0.0026 micro-ohms, with a corresponding resistive heat dissipation of only 0.01 watts at 2 kA. To compare a solid AlSiC-9 shaft to a hollow titanium tube, the tube wall thickness that gave the same moment of inertia about the axis of rotation as the solid AlSiC-9 shaft was calculated; in this case the mechanism to accelerate both tubes can be the same, as is desirable in comparing the two options economically. The titanium tube wall thickness (pure titanium) that matches the moment of inertia of a solid AlSiC-9 solid shaft (outside diameter of both is 4.00 cm), is only 0.149 cm thick. At a pure titanium tube wall thickness of 0.149 cm, the resistance between the two shuttle electrodes would be about 88.5 micro-ohms, which implies on-state losses at maximum full load (2000 amps) around 350 watts just from resistance heating of the 10 cm long titanium shaft section between electrodes 672 and 673. The same type figures for a titanium beta-C alloy tube with the same rotary moment of inertia as a pure titanium tube were also calculated; because of the slight density difference from titanium (see Table 2), the wall thickness is a little less for a titanium beta-C alloy tube (0.138 cm): the resistance between the two shuttle electrodes would in this case be about 365 micro-ohms, which implies on-state losses at maximum full load (2000 amps) around 1,460 watts just from resistance heating of the 10 cm long titanium shaft section between electrodes 672 and 673. (Though I consider this to be unacceptable, it only corresponds to 0.01% of the transmitted energy, far less than would be dissipated by an IGBT switch or even a cold cathode tube switch.) I note that the resistance for a titanium tube core rotating electrode can be greatly reduced by inserting an aluminum or sodium core inside the titanium tube shell in such a way as to avoid any oxides at the interface.

In the case where very fast actuation is required, which also implies shock loading, it is necessary to use a very strong, shock resistant material as the substrate for the commutating rotor of FIG. 17 or 19, such as titanium or a titanium alloy tube electrically bonded to an aluminum alloy core. In any scenario where the commutating shuttle can be protected from shock loading, AlSiC-9 will be a more appropriate material for the core of a rotating shuttle such as 650 of FIG. 17, and aluminum alloy tubes may also be used in many cases. (Using an alumina/molybdenum coated aluminum alloy tube works well within a defined set of temperatures such as −40° to 250° C.)

Example 4

In this example, minimum system inductance is taken to be five times higher than the minimum inductance of Example 3 (3.75 mH). According to Table 3, this allows 5 ms to the first commutation in Case #4, or 8.13 ms to the first commutation in Case #5. Given the same dimensions for the rotor and stator electrodes of FIG. 17 as in Example 3, and given the same estimates for the total moment of inertia for the rotor of FIG. 17 made for Examples 2 and 3 above (corresponding to a 20 cm long, 4 cm diameter solid shaft of titanium beta-C alloy), the angular accelerations needed are 8160 radians/second for Case #4 (required torque=2.0 newton-meter), or 3060 radians/second for Case #5 (required torque=0.7 newton-meter). These accelerations and torques are within the range that can be actuated by standard steel coil springs.

Example 5

In this example we place two separate commutating circuit breakers on a single common shuttle so as to simultaneously interrupt power from both the positive side of the power supply and the negative side of the power supply. For this example, the two stage axial circuit breaker of FIG. 5 is modified to break two circuits simultaneously by eliminating the direct connection between the two stages 182 and wiring the two now electrically independent halves 157 and 219 to break the circuit on the positive side and the negative side of the DC circuit simultaneously. In this scenario, link 182 becomes a protected load rather than a wire. Similarly, a rotary commutating circuit breaker can also be designed to open two circuits simultaneously. Such a rotary 2-pole circuit breaker cannot use a conductive shaft that is in the circuit as in FIGS. 17 and 18, but would instead need to maintain electrical separation between the stages, similar to FIG. 6.

Example 6

The three commutating stages in FIG. 6 can also be adapted to interrupt all three phases of a three phase AC circuit simultaneously, by eliminating the series-connecting wires 236 and 256 and instead connecting each stage of the rotary commutating circuit breaker (shown as 220, 240, and 260 in FIG. 6) to one phase of the three phase circuit.

Example 7

Consider the specific case of an implementation of FIG. 20 where the mechanism of FIG. 25 is attached via shaft 1201 to shaft 946, and where 930 contains a torsional drive spring 931 with very slow stress relaxation, and 955 contains a torsional energy-absorbing elastomeric spring 956 with fast stress relaxation, such as an elastomeric spring made of butyl rubber. When the fast release brake 950 is released, drive spring 931 twists the shaft 945 and the commutating rotor 941, accelerating them in respect to the base 960, unencumbered by opposition from energy absorbing arresting brake 955. This is desirably accomplished by spline 957 that provides the connection between 945 and 955, which is configured so that the shaft 945 rotates freely until an angle of rotation of 105 degrees (A2) is reached where spline 957 (inside module 955 and attached to energy absorbing spring 956) is engaged, at which time spring 956 begins to decelerate the shaft 945 and the attached commutating rotor 941 so that the maximum angle turned by shaft 945 is around 135 degrees. Valve 1225 is a control valve operated by the SCADA System; depending on whether the opening of the circuit went as expected, the SCADA system may hold the commutating rotor at 135 degrees, where the safety margin against arc formation is greater than at angle A2 (105 degrees rotation of shaft 946 in this case). I have described several specific implementations of my invention. These are not meant to limit the invention. Any rapid mechanical commutation of power through a series of increasing resistance paths, to open a live circuit, is in the most general sense an example of this invention.

A number of embodiments have been described. However, there are many other implementations which have not been described in detail that will be apparent to a person skilled in the art utilizing the design principles elucidated herein.

What is claimed is:

1. A commutating circuit breaker that is capable of being triggered so as to open, comprising:

a stator having two or more first electrical contacts;

one or more shuttles that are movable with respect to the stator and adapted to move simultaneously when the breaker is triggered to open, each shuttle having two or more second electrical contacts;

a series of resistors each electrically coupled to at least one first electrical contact and at least one second electrical contact;

a launching system arranged to move a shuttle relative to the stator between an operational position where the breaker presents relatively little electrical resistance in a circuit that includes the breaker, and an open position in which the breaker presents a very high electrical resistance in the circuit that includes the breaker;

wherein shuttle motion between the operational position and the open position changes the electrical path through the breaker such that current is sequentially shunted into paths of increasing resistance;

wherein the motion of the shuttle can either be rotational or linear; and wherein the resistors are connected in a stack formed from alternating metallic and semiconductive layers that are attached to each other electrically and mechanically.

2. The commutating circuit breaker of claim 1 comprising two shuttles, wherein the launching system is adapted to move the shuttles linearly in opposite directions.

3. The commutating circuit breaker of claim 1 wherein the moving shuttle has continuously variable resistivity that accomplishes increasing resistance between two stator electrodes as the shuttle moves from a starting position toward an ending position.

4. The commutating circuit breaker of claim 1 wherein the moving shuttle causes the current to flow through different stator electrodes and thereby through different resistive paths which have increasing resistance to decrease the current to zero by small steps selected to control voltage surges within defined limits.

5. The commutating circuit breaker of claim 4 wherein at least one of the shuttle electrodes is wide enough to contact two stator electrodes at once, and has a gradient of increasing resistivity leading up to its trailing edge to commutate the current from the first stator electrode to the next resistive path through the second stator electrode prior to the final separation of the shuttle electrode from said first stator electrode, to avoid formation of an arc as the shuttle electrode separates from said first stator electrode.

6. The commutating circuit breaker of claim 4 wherein at least one of the shuttle electrodes is wide enough to contact two stator electrodes at once, and at least the first of these two stator electrodes has a gradient of increasing resistivity leading up to its trailing edge to commutate the current from the first stator electrode to the next resistive path through the second stator electrode prior to the final separation of the shuttle electrode from said first stator electrode, to avoid formation of an arc as the shuttle electrode separates from said first stator electrode.

7. The commutating circuit breaker of claim 4 wherein the commutating shuttle moves in a circular rotary fashion, with power coming onto the shuttle through one connection, then off the shuttle through a shuttle electrode that is electrically connected to said first connection, but surrounded by insulation at the surface of the shuttle, and which connects with a series of stator electrodes as the shuttle rotates.

8. The commutating circuit breaker of claim 7 wherein power passes onto the rotary commutating shuttle through a slip ring on the shaft, then off of the rotary commutating shuttle through one or more shuttle electrodes that are either on the outside radius of the commutating rotor or on the flat sides of a disc-shaped commutating rotor to a series of stator electrodes that connect the power through a series of paths with increasing resistance as the commutating circuit breaker shuttle rotates.

9. The commutating circuit breaker of claim 7 wherein power passes onto the rotary commutating shuttle from at least one stator electrode to a shuttle electrode that is either on the outside radius of the commutating rotor or on the flat sides of a disc-shaped commutating rotor, through an insulated path to a second shuttle electrode on a different portion of the shuttle, then off the rotatable shuttle from said second shuttle electrode to a series of stator electrodes that connect the power through a series of paths with increasing resistance as the commutating circuit breaker shuttle rotates.

10. The commutating circuit breaker of claim 7 wherein the resistors are connected in series.

11. The commutating circuit breaker of claim 4 wherein the shuttle moves in a linear fashion with power coming onto the shuttle through one connection, then off the shuttle through a shuttle electrode that connects with a series of stator electrodes that connect the power through a series of paths with increasing resistance as the shuttle moves.

12. The commutating circuit breaker of claim 11 wherein power passes onto the shuttle through a wire or a slip ring, then off of the shuttle through a shuttle electrode that is electrically connected to said wire or slip ring, but surrounded by insulation at the surface of the shuttle, and which connects with a series of stator electrodes that connect the power through a series of paths with increasing resistance as the commutating circuit breaker shuttle moves.

13. The commutating circuit breaker of claim 11 wherein power passes onto the shuttle through at least one stator electrode to a shuttle electrode that is on the outside surface of the shuttle, through an insulated path to a second shuttle electrode on a different portion of the shuttle, but surrounded by insulation at the surface of the shuttle, and then off the shuttle from said second shuttle electrode to a series of stator electrodes that connect the power through a series of paths with increasing resistance as the shuttle moves.

14. The commutating circuit breaker of claim 13 wherein the shuttle has a plurality of commutation zones along the longitudinal axis of the shuttle.

15. The commutating circuit breaker of claim 1 wherein the breaker is arranged in a parallel power circuit with a fast commutating switch that is used to perform a first commutation of the current to the breaker at an initial resistance level that is able to control the inrush of current in a dead short.

16. The commutating circuit breaker of claim 15 wherein the fast commutating switch is selected from the group of commutating switches consisting of a fast electrodynamic switch, a MEMS switch, a transistor switch, a high voltage tube switch, a superconducting surge limiter, a vacuum circuit breaker and a fast acting ballistic switch.

17. The commutating circuit breaker of claim 1 comprising a plurality of breaker stages which are electrically coupled in series and mechanically moving together as a rigid body.

18. The commutating circuit breaker of claim 17 wherein the shuttle comprises a commutator that rotates less than 180 degrees, and commutates the power through a plurality of series-connected sequences of resistors.

19. The commutating circuit breaker of claim 17 wherein the shuttle is generally cylindrical, and moves in a linear fashion.

20. The commutating circuit breaker of claim 19 wherein the shuttle has a plurality of commutation zones radially separated in the form of longitudinal sections on the surface of the shuttle.

21. The commutating circuit breaker of claim 19 wherein the launching system comprises springs.

22. The commutating circuit breaker of claim 21 further comprising a shuttle latching mechanism that comprises piezoelectric actuators that relieve the normal force on a polished interface of high modulus materials to achieve very rapid actuation of the onset of movement of the shuttle.

23. The commutating circuit breaker of claim 22 in which correlated magnetic domains on the shuttle and the stator hold back most of the force exerted by the springs, so that the latching mechanism based on piezoelectric actuators only needs to restrain a fraction of the total force exerted by the spring.

24. The commutating circuit breaker of claim 1 further comprising a pressurized electrically insulating fluid surrounding the shuttle.

25. The commutating circuit breaker of claim 24 wherein the fluid is selected from the group of fluids consisting of mineral oil, kerosene, silicone oil, a perfluorocarbon fluid, vegetable oil, biodiesel, a liquid that has high resistivity and high dielectric strength, and a dry SF.sub.6-gas containing gas mixture.

26. The commutating circuit breaker of claim 1 wherein the stator surrounds a shuttle.

27. The commutating circuit breaker of claim 26 wherein the stator further comprises a low friction high dielectric strength material that creates force against the shuttle by an elastic member.

28. The commutating circuit breaker of claim 1 wherein the shuttle electrodes are wide enough so that they are in contact with at least one stator electrode at all times during operation of the breaker, except at the final opening of the circuit when current has been reduced significantly from its initial value.

29. The commutating circuit breaker of claim 28 wherein a first shuttle electrode is simultaneously in contact with a first stator electrode and a second stator electrode, and the trailing edges of at least one of the first shuttle electrode and the first stator electrode are composed of materials of increasing resistivity so that by the time of the final separation of the two electrodes, most of the current will have already been commutated from a first electrical path from the first shuttle electrode to the first stator electrode, to a second electrical path from the first shuttle electrode to the second stator electrode.

30. First and second commutating circuit breakers of claim 1 in which the shuttles of the first and second breakers are moved such that their combined momentum is less than two times the momentum of either shuttle.

31. A commutating circuit breaker that is capable of being triggered so as to open, comprising:

a stator having two or more first electrical contacts;

one or more shuttles that are movable with respect to the stator and adapted to move simultaneously when the breaker is triggered to open, each shuttle having two or more second electrical contacts;

a series of resistors each electrically coupled to at least one first electrical contact and at least one second electrical contact;

a launching system arranged to move a shuttle relative to the stator between an operational position where the breaker presents relatively little electrical resistance in a circuit that includes the breaker, and an open position in which the breaker presents a very high electrical resistance in the circuit that includes the breaker; and a plurality of commutation stages and commutation zones that direct the power through numerous different resistive paths during operation of the circuit breaker;

wherein shuttle motion between the operational position and the open position changes the electrical path through the breaker such that current is sequentially shunted into paths of increasing resistance;

wherein the motion of the shuttle can either be rotational or linear;

wherein the moving shuttle causes the current to flow through different stator electrodes and thereby through different resistive paths which have increasing resistance to decrease the current to zero by small steps selected to control voltage surges within defined limits;

wherein the commutating shuttle moves in a circular rotary fashion, with power coming onto the shuttle through one connection, then off the shuttle through a shuttle electrode that is electrically connected to said first connection, but surrounded by insulation at the surface of the shuttle, and which connects with a series of stator electrodes as the shuttle rotates; and wherein the launching system comprises springs disposed around the outer perimeter of a large rotary commutator.

32. A commutating circuit breaker that is capable of being triggered so as to open, comprising:

a stator having two or more first electrical contacts;

one or more shuttles that are movable with respect to the stator and adapted to move simultaneously when the breaker is triggered to open, each shuttle having two or more second electrical contacts;

a series of resistors each electrically coupled to at least one first electrical contact and at least one second electrical contact; and a launching system arranged to move a shuttle relative to the stator between an operational position where the breaker presents relatively little electrical resistance in a circuit that includes the breaker, and an open position in which the breaker presents a very high electrical resistance in the circuit that includes the breaker; and wherein shuttle motion between the operational position and the open position changes the electrical path through the breaker such that current is sequentially shunted into paths of increasing resistance;

wherein the motion of the shuttle can either be rotational or linear;

wherein the moving shuttle causes the current to flow through different stator electrodes and thereby through different resistive paths which have increasing resistance to decrease the current to zero by small steps selected to control voltage surges within defined limits;

wherein the commutating shuttle moves in a circular rotary fashion, with power coming onto the shuttle through one connection, then off the shuttle through a shuttle electrode that is electrically connected to said first connection, but surrounded by insulation at the surface of the shuttle, and which connects with a series of stator electrodes as the shuttle rotates; and wherein the rotation of the commutating rotor is initiated by a torsional drive spring and arrested by a second torsional spring.

33. The commutating circuit breaker of claim 32 in which said second torsional spring is an elastomeric spring.

34. The commutating circuit breaker of claim 32 in which a hydraulic drive which turns easily in the forward direction but slowly in the reverse direction is coupled to the shaft so that said second torsional spring returns slowly to its on state position at angle A2.

* * * * *